United States Patent [19]

Wendt et al.

[11] Patent Number: 4,927,991

[45] Date of Patent: May 22, 1990

[54] SUSCEPTOR IN COMBINATION WITH GRID FOR MICROWAVE OVEN PACKAGE

[75] Inventors: Dan J. Wendt, Lino Lakes; Jonathon D. Kemske, New Brighton; Peter S. Pesheck, Brooklyn Center, all of Minn.

[73] Assignee: The Pillsbury Company, Minneapolis, Minn.

[21] Appl. No.: 119,381

[22] Filed: Nov. 10, 1987

[51] Int. Cl.[5] ..... H05B 6/80

[52] U.S. Cl. ..... 219/10.55 E; 219/10.55 F; 219/10.55 R; 426/107; 426/243

[58] Field of Search ..... 219/10.55 R, 10.55 E, 219/10.55 F, 10.55 M; 99/DIG. 14; 426/107, 234, 243

[56] References Cited

U.S. PATENT DOCUMENTS

| | | | |
|---|---|---|---|
| 3,302,632 | 2/1967 | Fichtner | 126/390 |
| 3,946,188 | 3/1976 | Derby | 219/10.55 E |
| 4,122,324 | 10/1978 | Falk | 219/10.55 E |
| 4,190,757 | 2/1980 | Turpin et al. | 219/10.55 E |
| 4,196,331 | 4/1980 | Leveckis et al. | 219/10.55 E |
| 4,230,924 | 10/1980 | Brastad | 219/10.55 E |
| 4,266,108 | 5/1981 | Anderson | 219/10.55 E |
| 4,268,738 | 5/1981 | Flautt, Jr. et al. | 219/10.55 F |
| 4,283,427 | 8/1981 | Winters et al. | 426/107 |
| 4,369,346 | 1/1983 | Hart et al. | 219/10.55 E |
| 4,450,334 | 5/1984 | Bowen et al. | 219/10.55 E |
| 4,626,641 | 12/1986 | Brown | 219/10.55 E |
| 4,656,325 | 4/1987 | Keefer | 219/10.55 E |
| 4,676,857 | 1/1987 | Scharr et al. | 156/233 |
| 4,703,148 | 10/1987 | Mikulski et al. | 219/10.55 E |
| 4,713,510 | 12/1987 | Quick | 219/10.55 E |
| 4,777,053 | 10/1988 | Tobelmann | 219/10.55 E |

FOREIGN PATENT DOCUMENTS 2186478 8/1987 United Kingdom .

*Primary Examiner*—A. D. Pellinen
*Assistant Examiner*—Leon K. Fuller
*Attorney, Agent, or Firm*—Arnold, White & Durkee

[57] ABSTRACT

A food package for a microwave oven is disclosed which has a grid in combination with a susceptor means. The combination of the grid and susceptor means provides a heater element which substantially maintains its reflectance, absorbance and transmittance during microwave heating. Substantial uniformity of heating is also achieved. The reflectance, transmittance and absorbance can be adjusted by changing certain design factors, including hole size, susceptor impedance, grid geometry, spacing between the grid and susceptor, and the spacing between adjacent holes.

33 Claims, 33 Drawing Sheets

FREE SPACE SUSCEPTOR MODEL
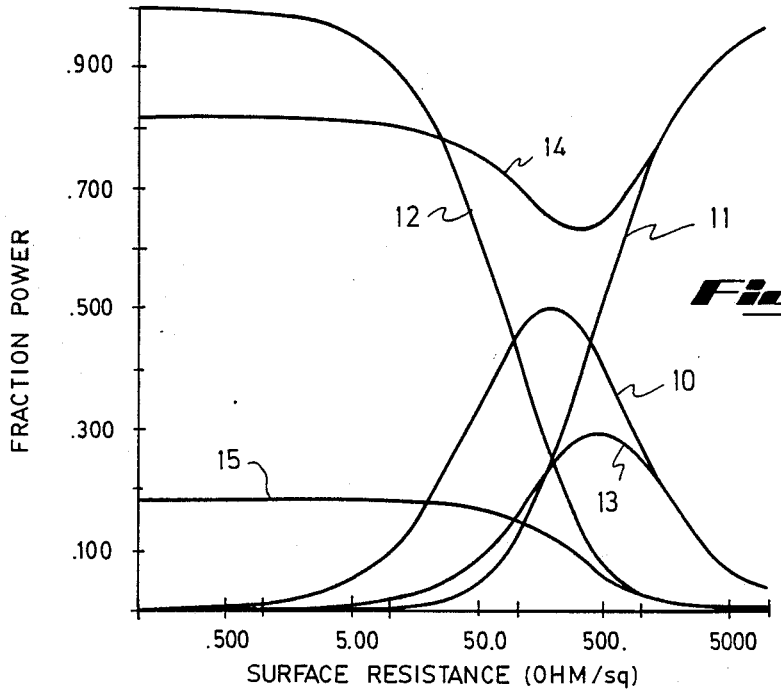
Fig. 1
PERFORMANCE SHIFT - NO GRID
BEFORE & AFTER HEATING
Fig. 2
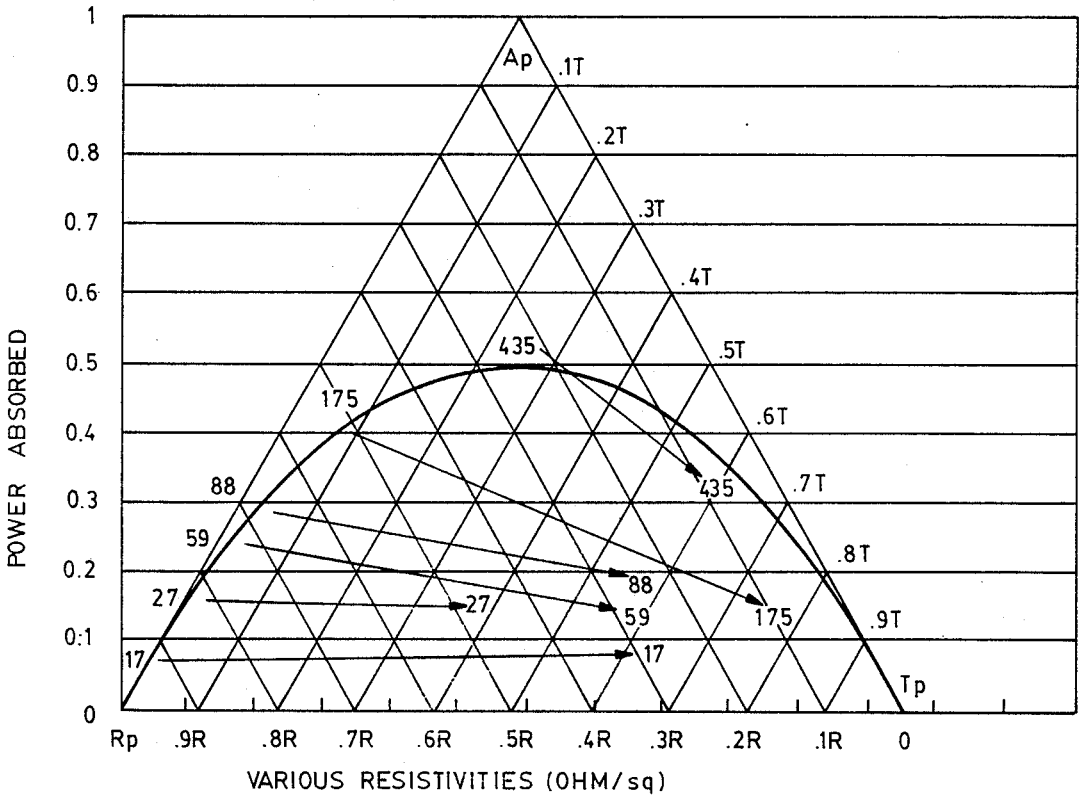

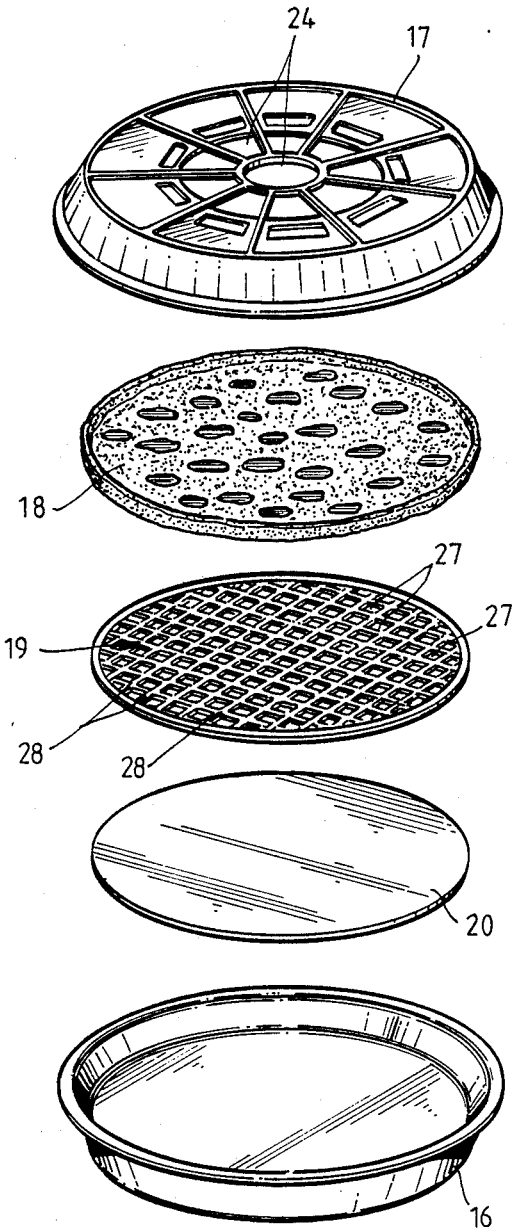
Fig. 3
Fig. 3A
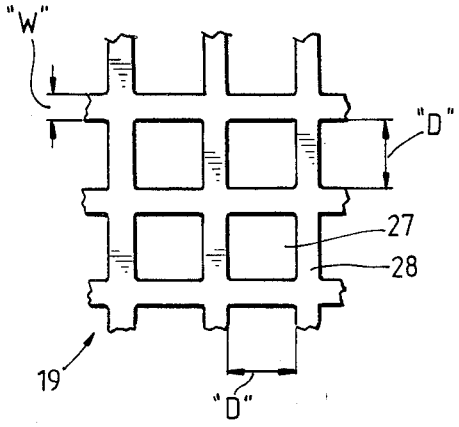
Fig. 4A
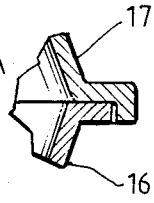
Fig. 4
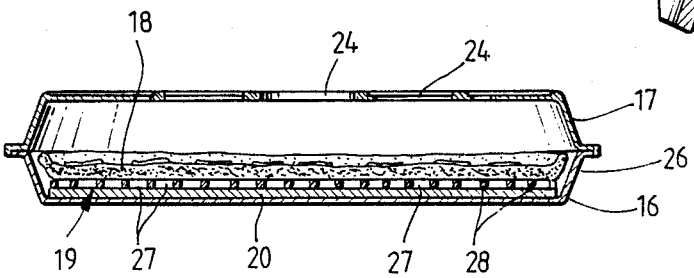

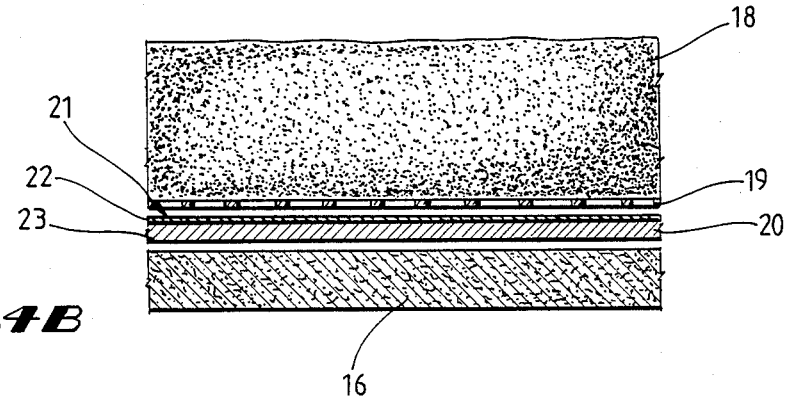
Fig. 4B
Fig. 5
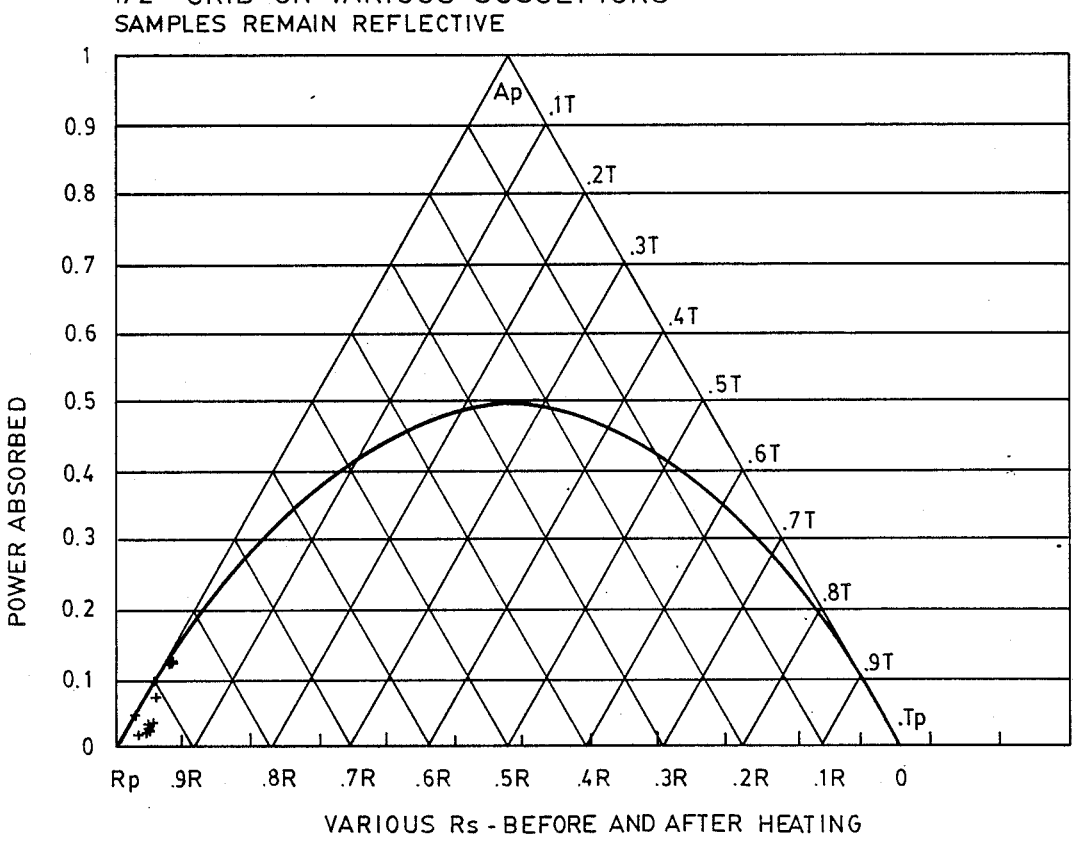

SUSCEPTOR RESISTIVITY AND GRID SIZE

NETWORK ANALYZER DATA

SUSCEPTOR RESISTIVITY AND GRID SIZE

LOW POWER EXPERIMENT PAPER SIDE

STAGGERED CIRCULAR HOLES
EFFECT OF FOIL THICKNESS

1/8" GRID
1/2" GRID
1" GRID
REFLECTANCE
1
0.9
0.8
0.7
0.6
0.5
0.4
0.3
0.2
0.1
0
0.0002
0.0006
0.001
0.0014
0.0018
0.0022
0.0026
0.003
THICKNESS (IN.)

SUSCEPTOR HEATING
VS HOLE SPACING
LOW POWER EXPERIMENT

TEMPERATURE DEGREES °C
57
56
55
54
53
52
51
50
49
48
0
0.4
0.8
1.2
1.6
2
2.4
HOLE SPACING (IN.)

INDUCTIVE COUPLING IN SUSCEPTOR GRID COMBINATION
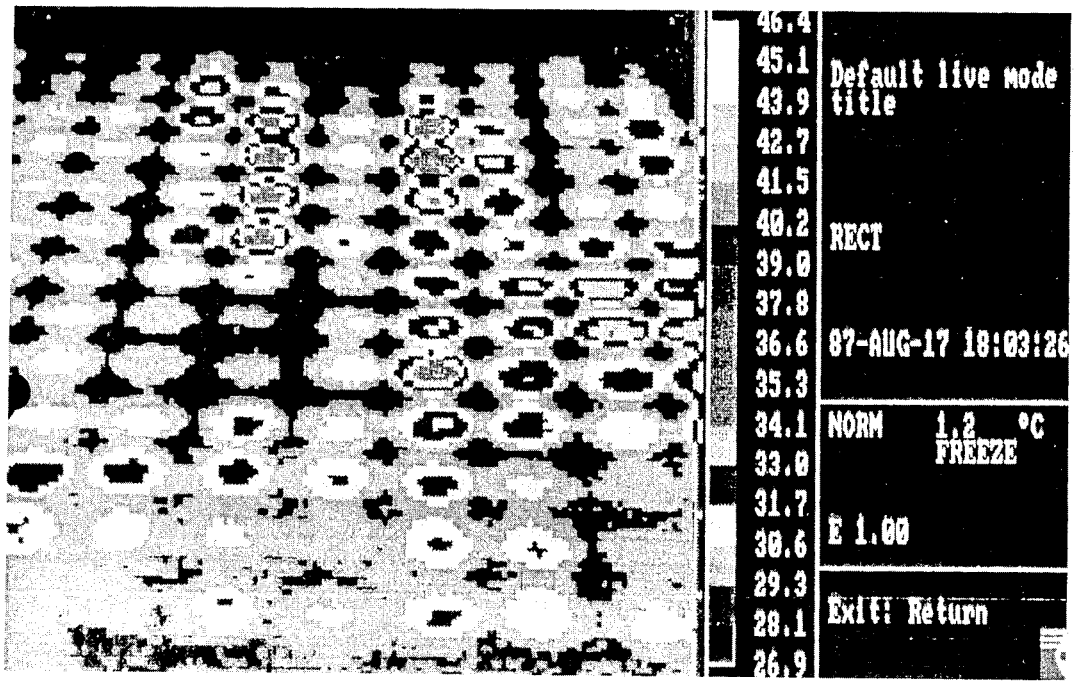
Fig. 14A RECTANGULAR ALIGNMENT OF HOLES
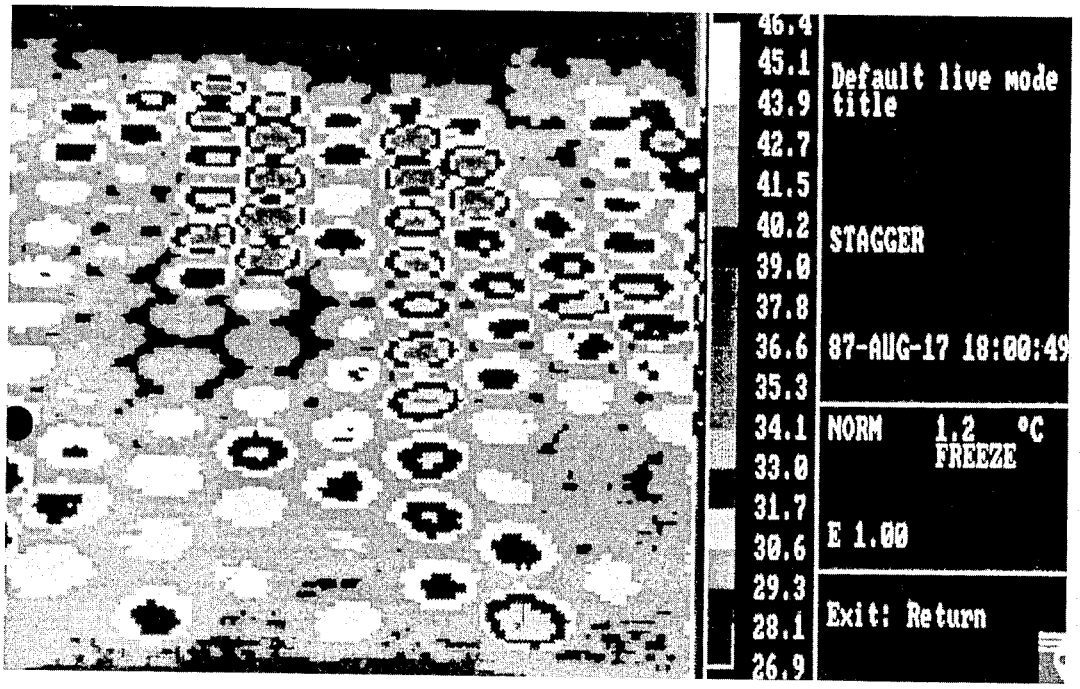
Fig. 14B STAGGERED ALIGNMENT OF HOLES Fig. 14D UNIFORM HEATING OF LID WITH SUSCEPTOR.
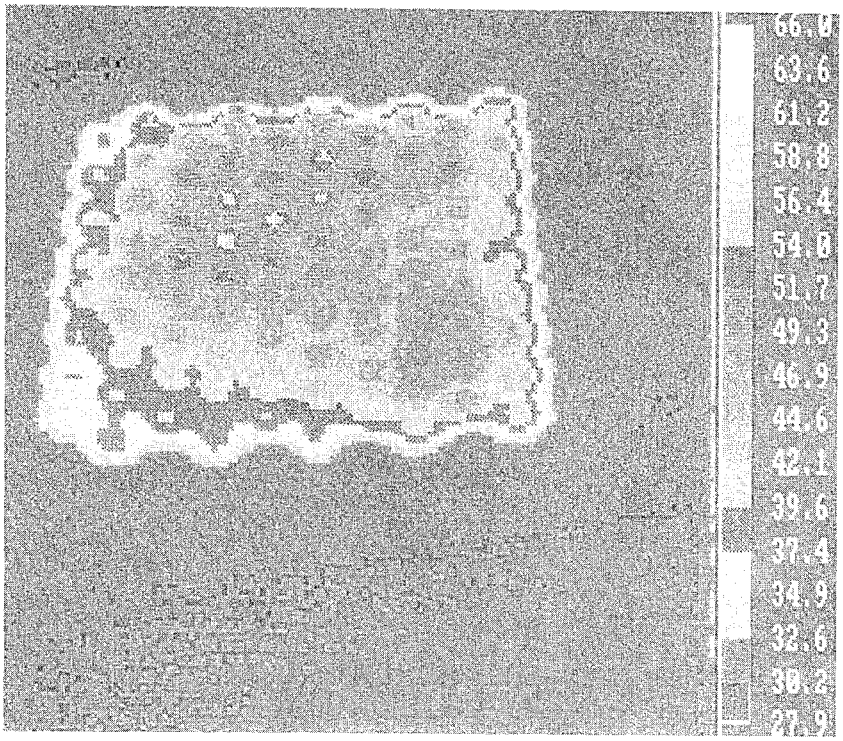
Fig. 14C NON UNIFORM EDGE HEATING OF SUSCEPTOR ALONE
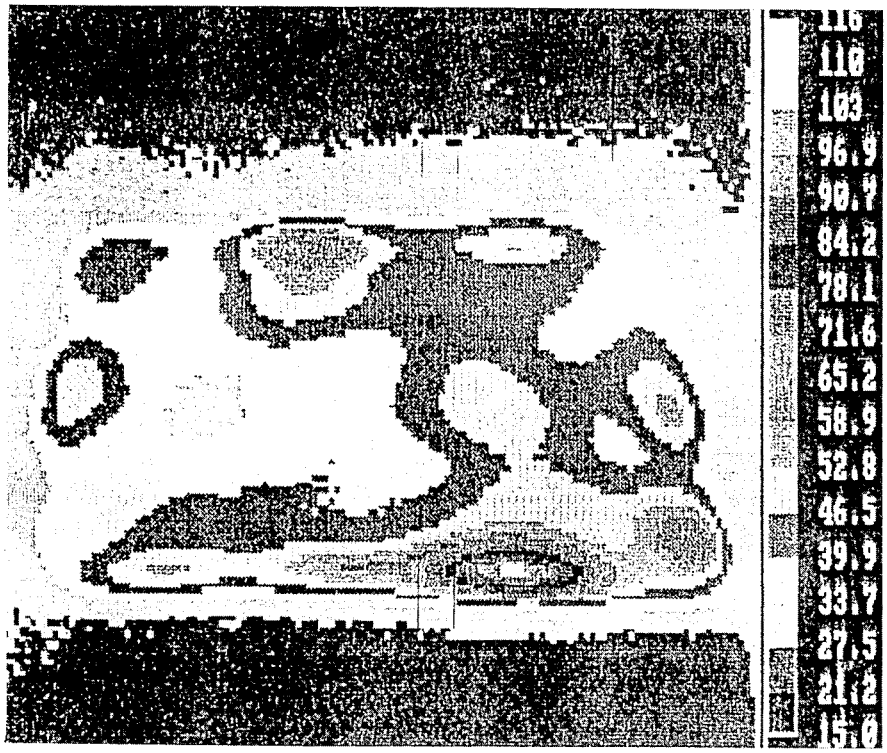

TRANSMITTED POWER
VS HOLE DIAMETER
FOR VARIOUS RESISTIVITIES (Ohms/Sq)

REFLECTED POWER
VS HOLE DIAMETER
FOR VARIOUS RESISTIVITIES (Ohms/Sq)

Fig. 29
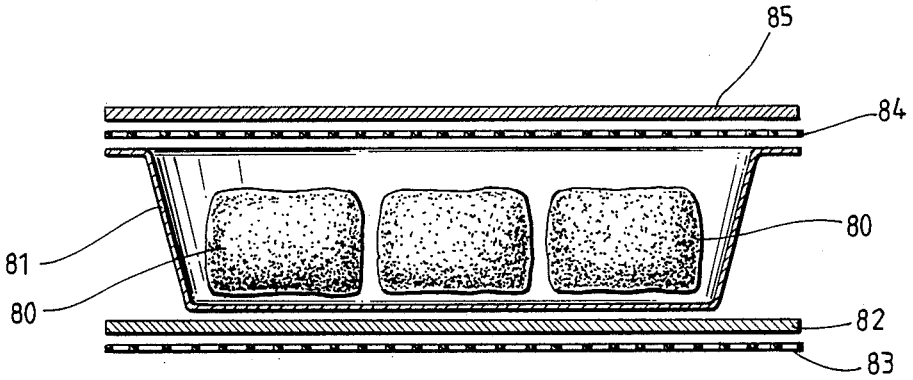
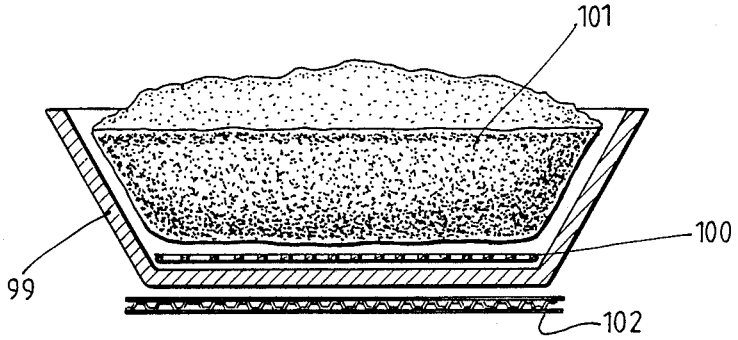
Fig. 29A

FRACTION OF POWER ABSORBED

ABSORBED POWER
0.30
0.28
0.26
0.24
0.22
0.20
0.18
0.16
0.14
0.12
0.10
0.08
0.06
0.04
0.02
0
98, SUSCEPTOR FIRST
97, GRID FIRST
0
0.02
0.04
0.06
0.08
0.10
0.12
0.14
0.16
0.18
0.20
GRID/SUSCEPTOR SEPARATION (IN)

EFFECT OF GRID/SUSCEPTOR SEPARATION
ON ABSORBED POWER

FRACTION POWER ABSORBED
.450
.350
.250
.150
.050
98', SUSCEPTOR FIRST
97', GRID FIRST
.050
.150
.250
.350
.450
GRID/SUSCEPTOR SEPARATION (IN)

MAGNETIC CRISPER BACKING
Fig.31
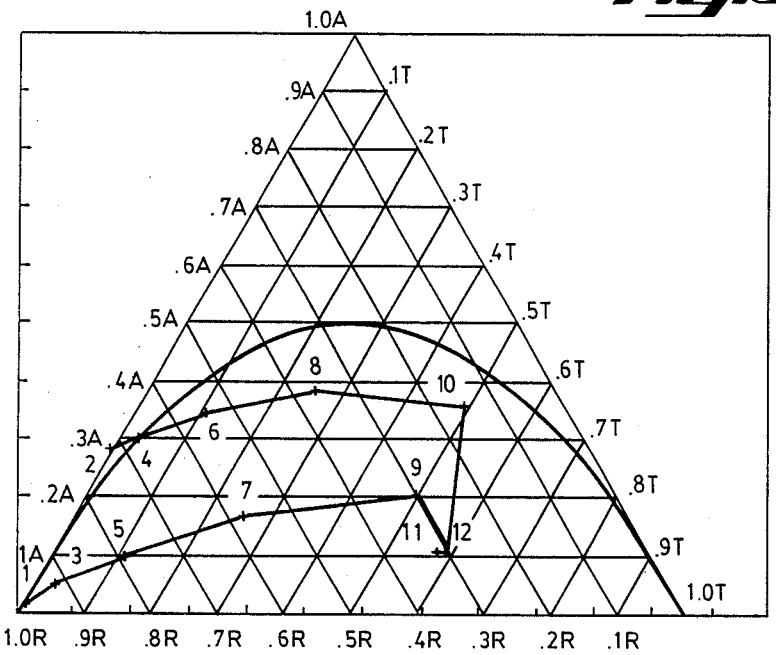
LABELS ON DATA ARE SAMPLE NO.
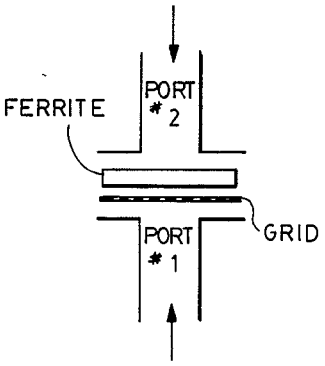
Fig.31A
PREDICTED POWER DISSIPATED IN A PARALLEL RLC CIRCUIT
Fig.36
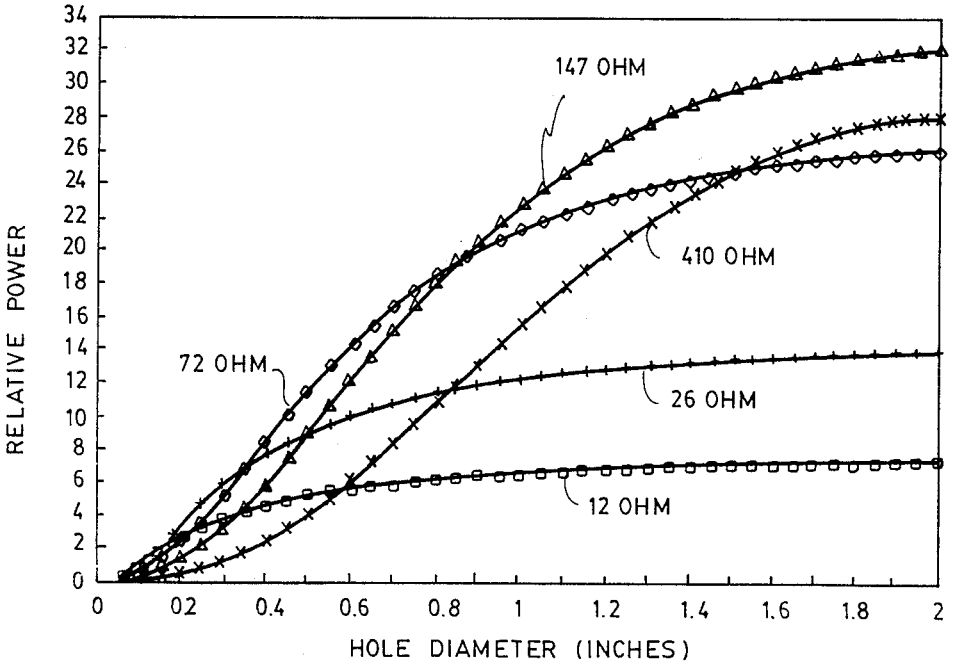

Fig. 32
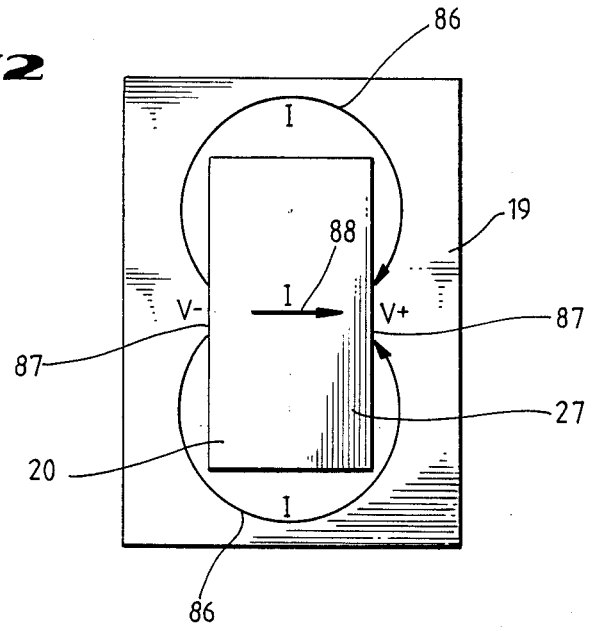
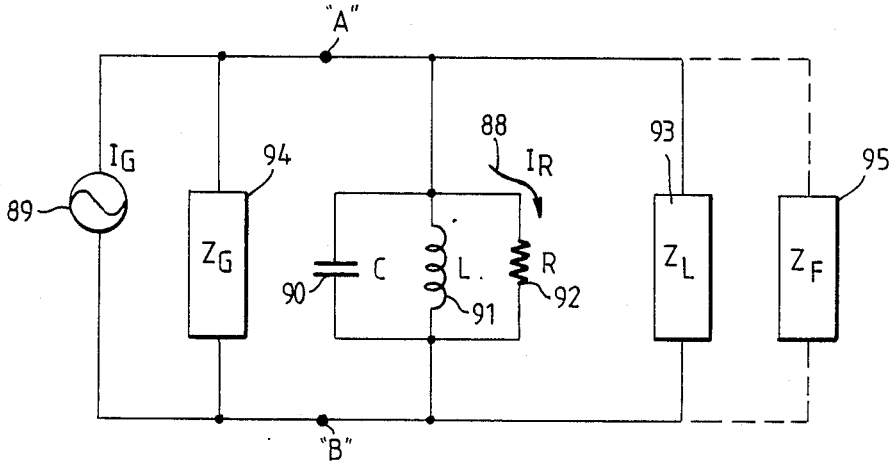
Fig. 33

PREDICTED POWER DISSIPATED IN A PARALLEL RLC CIRCUIT

COMPARISON OF CIRCUIT MODEL TO NETWORK ANALYZER DATA

UNIFORMITY COMPARISON OF SUSCEPTOR WITH AND WITHOUT GRID.
Fig. 37A
SUSCEPTOR
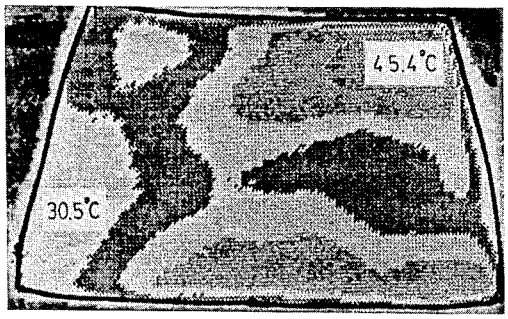
AVG.=36.6°C
STD.= 3.4°C
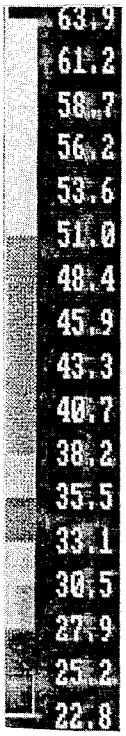
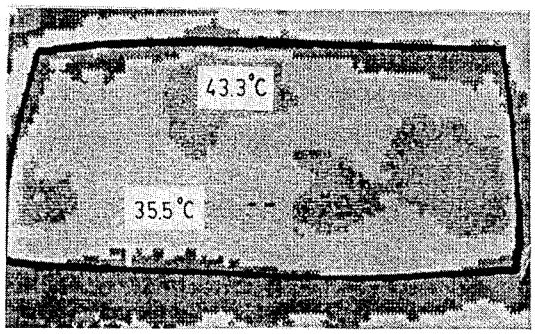
AVG.= 37.5°C
STD.= 1.6°C
Fig. 37B
1/4" GRID AND SUSCEPTOR Fig. 38A
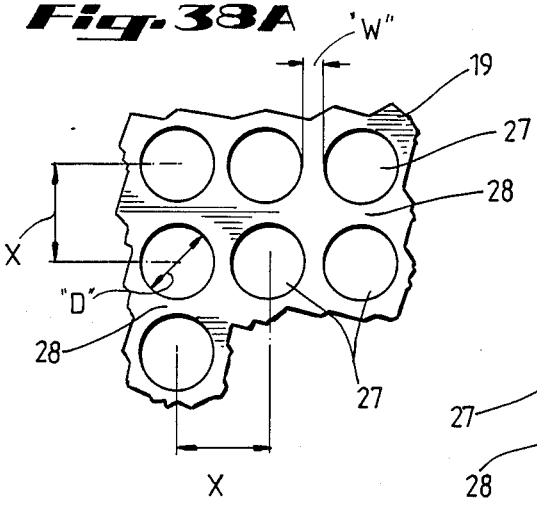
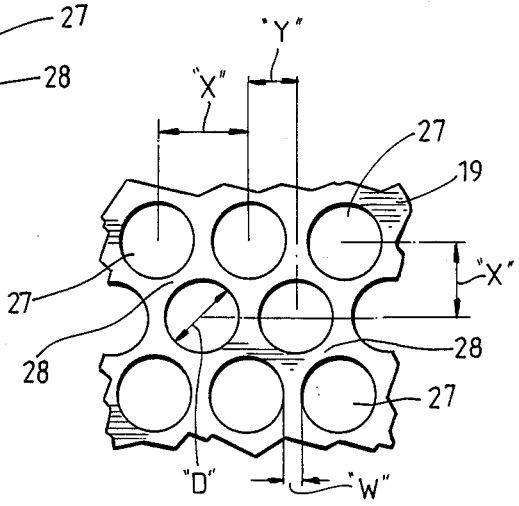
Fig. 38B
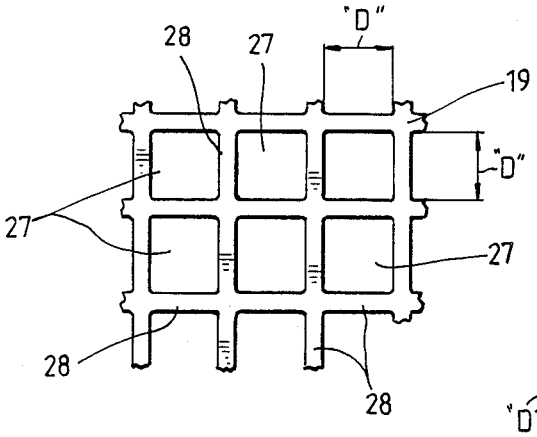
Fig. 38C
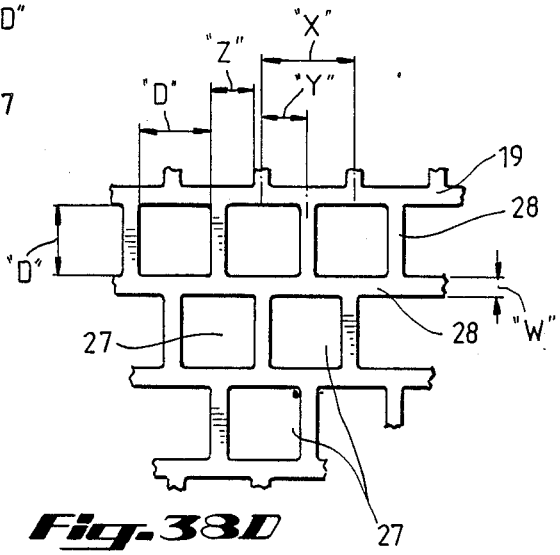
Fig. 38D Fig.39A
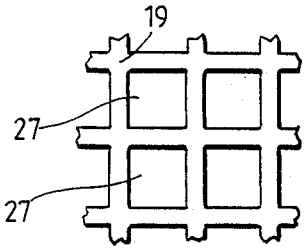
Fig.39B
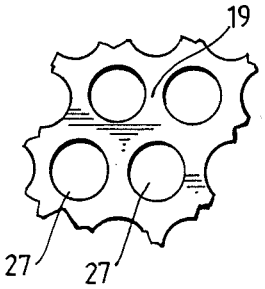
Fig.39C
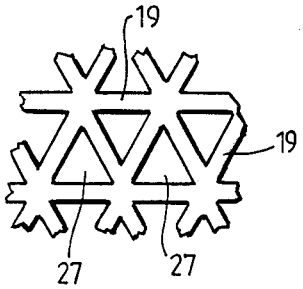
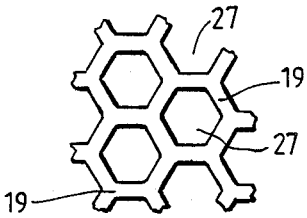
Fig.39D
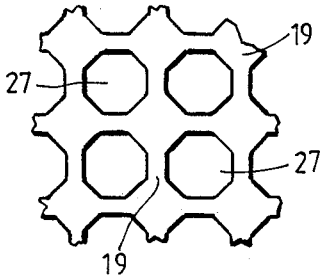
Fig.39E
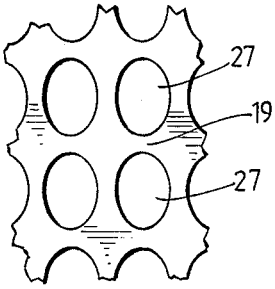
Fig.39F
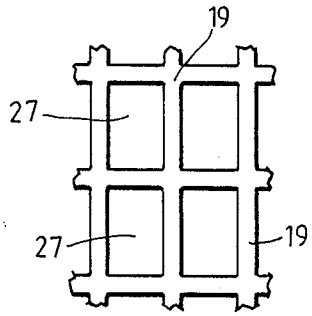
Fig.39G
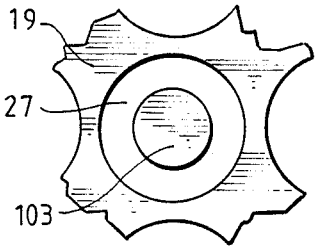
Fig.39H
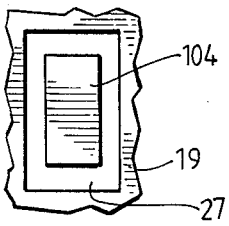
Fig.39I
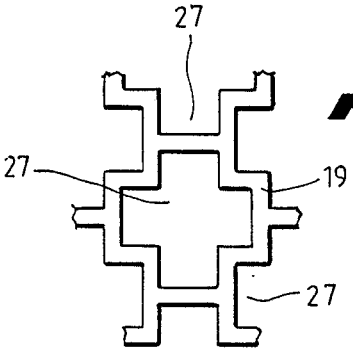
Fig.39J
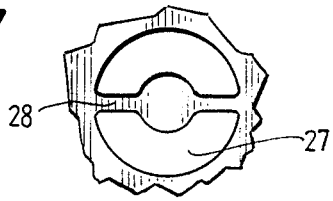
Fig.39K Fig. 40E
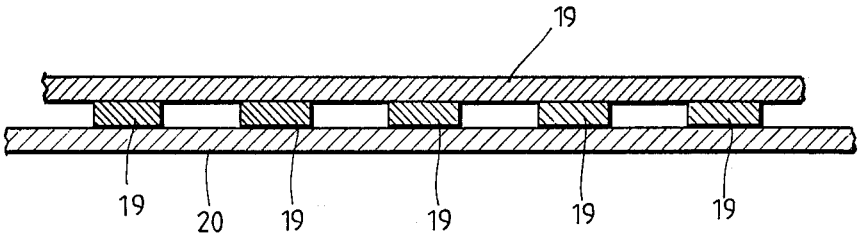
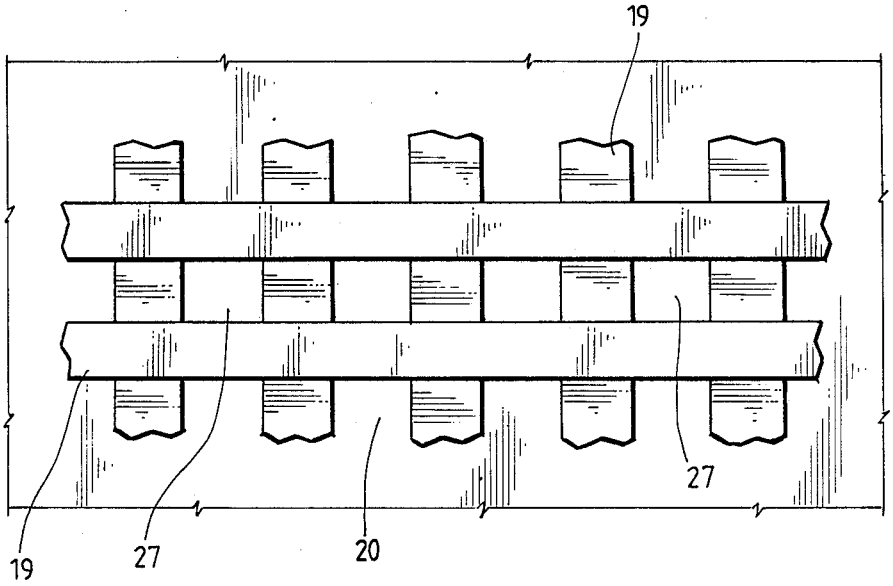
Fig. 40F EFFECT OF SUSCEPTOR REACTANCE
ON REFLECTANCE FOR GRID/SUSCEPTORS
IN WR (340) WAVEGUIDE WITH GRID
WITHOUT GRID
REFLECTANCE
1.0000
0.9000
0.8000
0.7000
0.6000
0.5000
0.4000
-300
-200
-100
0.00
REACTANCE, OHMS/SQUARE EFFECT OF SUSCEPTOR REACTANCE
ON TRANSMITTANCE FOR GRID/SUSCEPTORS
IN WR (340) WAVEGUIDE WITHOUT GRID
WITH GRID
TRANSMITTANCE
0.5000
0.4000
0.3000
0.2000
0.1000
0.0000
-300
-200
-100
0.00
REACTANCE, OHMS/SQUARE

SUSCEPTOR IN COMBINATION WITH GRID FOR MICROWAVE OVEN PACKAGE

BACKGROUND OF THE INVENTION

Microwave cooking often offers advantages of speed and convenience in heating foods. However, in the past, microwave cooking has been unsatisfactory for a number of food products. Because microwave cooking relies upon the dielectric heating of foods responsive to microwave radiation, the heating characteristics in a microwave oven for some food products is dramatically different from that experienced in a conventional oven. Problems with microwave cooking for a number of food products include the problem of undesirable temperature differentials. Oftentimes, food products cooked in a microwave oven will heat more in the interior due to dielectric heating caused by microwave radiation, than at the surface. This is directly contrary to the temperature differential achieved in a conventional oven, which is oftentimes desirable for foods which require a crisp surface or brown crust in order to have desirable taste characteristics. An additional problem with microwave cooking is that necessary temperatures for browning and crisping of the surface of food products have not been achieved. This is an old problem in the art, and many attempts have been made to solve it.

A related problem is the problem of moisture differentials which result in moisture migrating in an undesirable manner in a food product. Oftentimes, instead of evaporating or migrating from the surface of the food to the center of the food product, moisture will migrate the wrong way, i.e., from the center of the food product to the surface during microwave cooking. This has the effect of leaving the food surface soggy, which is oftentimes undesirable and detrimental to the texture and taste of the food.

Microwave cooking may also have a problem regarding the time characteristics of microwave cooking. For example, microwave cooking of cookies or bread may occur so rapidly that the cookie batter does not have time to spread properly, and the bread does not have time to rise properly.

In the past, attempts to solve some problems with microwave cooking have involved the use of susceptors which heat in response to microwave radiation. Typically, susceptors have been used which contain a thin film of metal, usually aluminum, deposited upon a substrate. Such susceptors typically have been characterized by surface resistivities in the range of 10 to 500 ohms per square. Such thin film susceptors have exhibited problems in the past related to the deterioration of such susceptors, when exposed to microwave radiation. Typically, susceptors deteriorate or break up, and become less reflective and more transmissive to microwave radiation as they are heated in a microwave oven. For many food products, this is undesirable. At present, there is no way known to applicants in which a practical and disposable susceptor can be manufactured economically which will not break up and significantly change its performance characteristics when exposed to microwave radiation. In the past, it has not been possible, to applicants' knowledge, to produce a susceptor with a particular combination of reflected, transmitted and absorbed power which would substantially remain at the same percentages of reflected, transmitted and absorbed power during microwave radiation. In the past, there has been no practical way of controlling deterioration of a susceptor during microwave irradiation.

Susceptors used in the past have also suffered from nonuniform heating. Thus, prior attempts to use susceptors to minimize some of the problems of microwave cooking have resulted in additional problems of food products which are overheated in some places and underheated in other places due to the nonuniform heating of the susceptor. For example, attempts to heat large pizzas have generally resulted in overheating of the outside of the pizza, and underheating of the center of the pizza.

In the past, there has been no practical way of controlling the rate of temperature rise of the susceptor. The only variables available to affect the temperature rise have been choosing the resistivity of the susceptor material, and the strength with which the metallized film is glued to its paper support. However, the surface resistance of the susceptor material changes during microwave irradiation, and the metal film breaks up. Thus, both variables available to affect the rate of temperature rise change during microwave heating.

From the above discussion it will be clear that prior art microwave cooking systems have been unsatisfactory in many respects.

SUMMARY OF THE INVENTION

The present invention permits a package to be designed for microwave cooking in which the percentage of reflected, transmitted and absorbed power can be predetermined. More importantly, during microwave cooking, the percentage of reflected, transmitted and absorbed power will remain relatively stable. The present invention provides a method for substantially maintaining performance characteristics in spite of the deterioration of susceptors used in connection with the invention. The deterioration of reflection, absorption and, most importantly, transmission characteristics can be controlled.

In addition, the present invention provides the advantage of uniform heating of a food product. The present invention also allows the rate of temperature rise to be controlled.

With the techniques and design flexibility provided by the present invention, a package can be designed to provide cooking characteristics desired for a particular food. A particular food may have a predetermined desired set of cooking characteristics, e.g., overall rate of heating, temperature, surface versus internal rate of heating, etc., for optimum preparation. The present invention provides techniques to design a package to conform to such desired characteristics. Significantly, the rate of internal dielectric microwave heating may be separately controlled from the rate of surface heating.

The present invention utilizes an electrically conductive grid in combination with a susceptor to produce desirable microwave cooking characteristics. Preferably, the grid and susceptor will be placed in close proximity to each other. The grid and susceptor may be used in combination with an otherwise totally or partially shielded food package. A grid/susceptor combination can also be used in combination with an unshielded food package.

BRIEF DESCRIPTION OF THE DRAWINGS

FIG. 1 is a graph depicting curves for reflected, transmitted and absorbed power for a susceptor in free space.

FIG. 2 is a graph depicting a tricoordinate plot showing absorbed power, reflected power and transmitted power for susceptors of various resistivities, both before and after heating.

FIG. 3 is an exploded perspective view of a preferred embodiment of a susceptor/grid combination useful for microwave cooking of pizza.

FIG. 3A is a partially cut-away top view of the grid shown in FIG. 3.

FIG. 4 is a cross-sectional view of the microwave package depicted in FIG. 3.

FIG. 4A is a partially cut-away cross-sectional view of the joint between the top and bottom of the package shown in FIG. 4.

FIG. 4B is a partially cut-away cross-sectional view of the grid, susceptor and food item shown in FIG. 4.

FIG. 5 is a graph depicting a tricoordinate plot of the transmitted, reflected and absorbed power characteristics of the grid/susceptor combination according to the present invention, both before and after heating.

FIG. 7A is a schematic cross-sectional representation of a preferred grid and susceptor combination for pizza and the like.

FIG. 14A is a copy of an image taken with an infrared camera showing the heating effects upon a particular grid geometry.

FIG. 14B is a copy of an image taken with an infrared camera showing the heating effects upon a particular grid geometry.

FIG. 14C is a copy of an image taken with an infrared camera showing the heating pattern for a susceptor alone, illustrating hot spots encountered with known susceptors.

FIG. 14D is a copy of an image taken with an infrared camera showing the heating pattern for a susceptor in combination with a grid, illustrating uniformity of heating which may be compared with FIG. 14C.

FIG. 29 illustrates an alternative embodiment of the invention.

FIG. 29A illustrates an alternative embodiment of the invention.

FIG. 30AA shows how measurements were made using the network analyzer to produce the graph shown in FIG. 30A.

FIG. 31 is a tricoordinate graph depicting measurements made with a network analyzer for a grid in combination with a susceptor means comprising a microwave magnetic absorbing material.

FIG. 31A shows how measurements were made using the network analyzer to produce the graph shown in FIG. 31.

FIG. 32 shows a top view of a single opening in a grid, in combination with a susceptor, used to develop an equivalent circuit model.

FIG. 33 is a schematic diagram of an equivalent circuit model for the grid/susceptor combination shown in FIG. 32.

FIG. 36 is a graph depicting relative power absorbed as a function of hole diameter for various values of susceptor resistivity, which are calculated based upon an equivalent circuit model.

FIG. 37A is a copy of an image taken with an infrared camera showing the heating pattern for the susceptor alone.

37B is a copy of an image taken with an infrared camera showing the heating pattern for a susceptor and in combination.

FIG. 38A shows a partially cut-away top view of a grid having circular openings in a square lattice configuration.

FIG. 38B shows a partially cut-away top view of a grid having circular openings in an equilateral triangular lattice configuration.

FIG. 38C shows a grid having square openings in a square lattice configuration.

FIG. 38D shows a grid having square openings in an equilateral triangular lattice configuration.

FIG. 39A shows a partially cut-away top view of a grid having square openings.

FIG. 39B shows a partially cut-away top view of a grid having circular openings.

FIG. 39C shows a partially cut-away top view of a grid having triangular shaped openings.

FIG. 39D shows a partially cut-away top view of a grid having hexagonal shaped openings arranged in an equilateral triangular lattice.

FIG. 39E shows a partially cut-away top view of a grid having hexagonal shaped openings arranged in a square lattice.

FIG. 39F shows a partially cut-away top view of a grid having oval shaped openings.

FIG. 39G shows a partially cut-away top view of a grid having rectangular openings.

FIG. 39H shows a partially cut-away top view of an opening in a grid having a patch of conductive material located in the center of the opening.

FIG. 39I shows a partially cut-away top view of a rectangular opening in a grid having a rectangular patch of conductive material therein.

FIG. 39J shows a partially cut-away top view of a grid having cross shaped openings.

FIG. 39K shows a partially cut-away top view of a grid having crescent shaped openings.

Figure 39L:
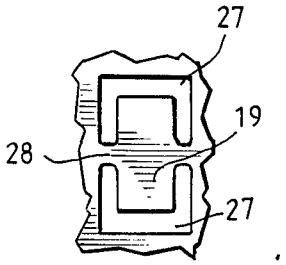

FIG. 39L shows a partially cut-away top view of a grid having U-shaped openings.

Figure 39M:
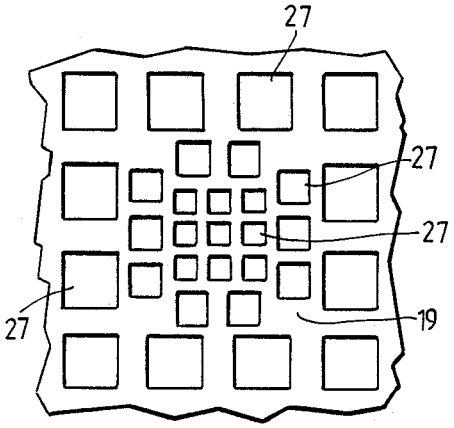

FIG. 39M shows a top view of a grid having square shaped holes arranged in a differential geometry.

Figure 39N:
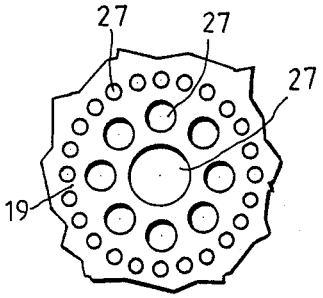

FIG. 39N shows a top view of a grid having circular openings arranged in a differential geometry according to differential sizes.

Figure 39O:
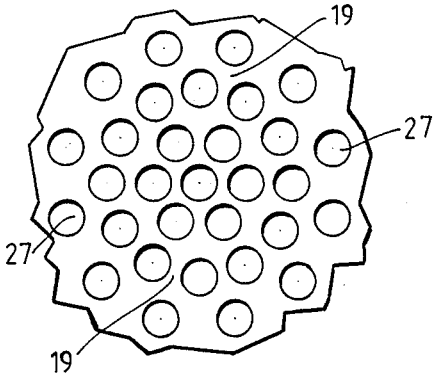

FIG. 39O shows a top view of a grid having circular openings arranged in a differential geometry according to hole spacing.

Figure 39P:
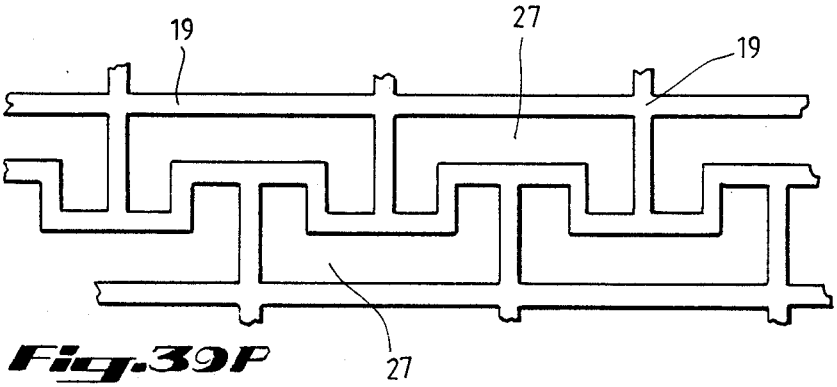

FIG. 39P shows a top view of a grid having U-shaped openings arranged in an offset and interlocking configuration.

Figure 40A:
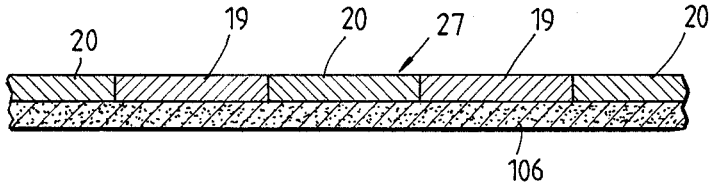

FIG. 40A shows a cross-sectional side view of an alternative embodiment of a grid and susceptor combination.

Figure 40B:
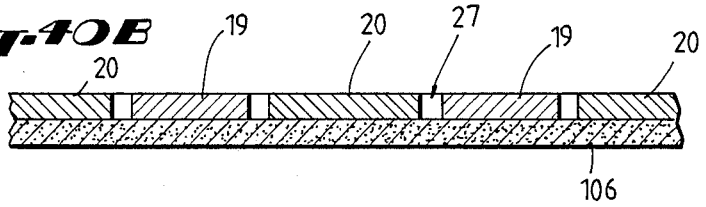

FIG. 40B shows a cross-sectional side view of an alternative embodiment of a grid and susceptor combination.

Figure 40C:
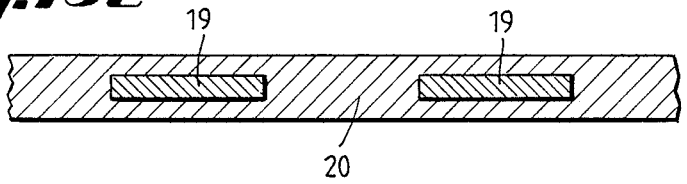

FIG. 40C shows a cross-sectional side view of an alternative embodiment of a grid and susceptor combination.

Figure 40D:
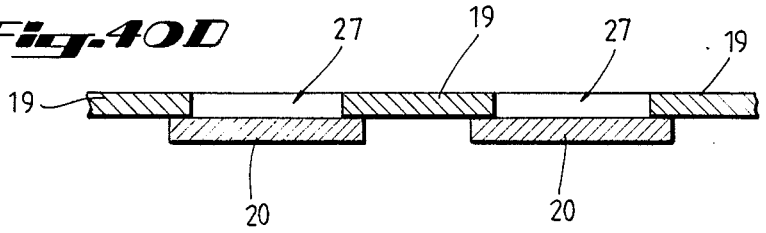

FIG. 40D shows a cross-sectional side view of an alternative embodiment of a grid and susceptor combination.

FIG. 40E shows a cross-sectional side view of a grid formed by strips of conductive material laid in a checkerboard pattern.

FIG. 40F is a top view of the grid and susceptor combination illustrated in FIG. 40E.

Figure 41:
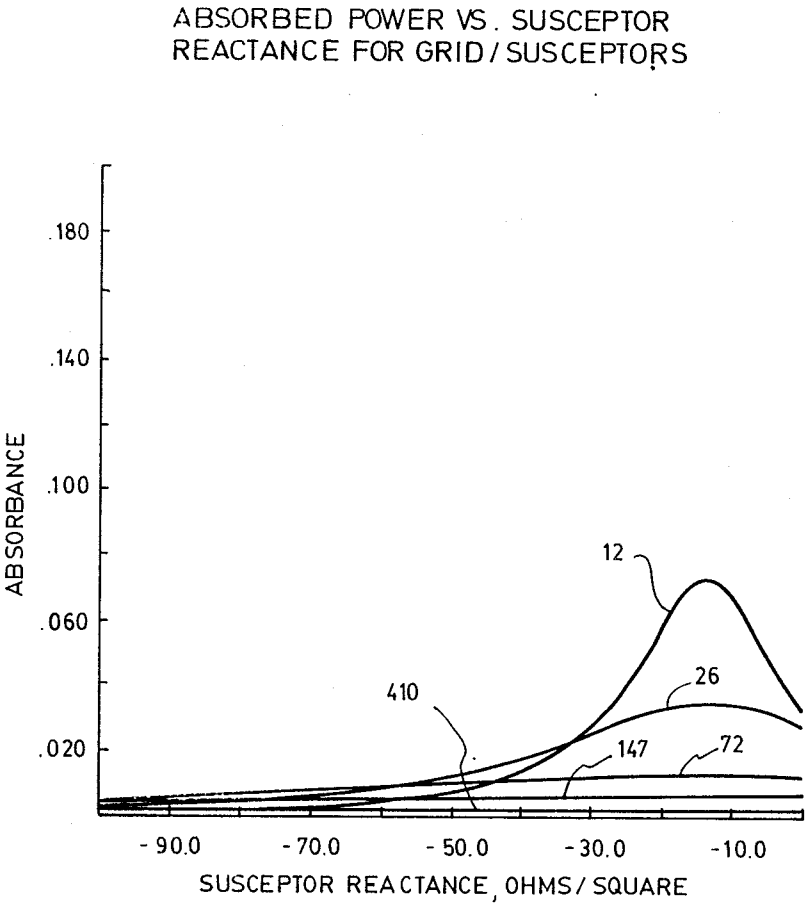

FIG. 41 is a graph depicting absorbed power versus susceptor reactance for various grid/susceptor combinations.

Figure 42:
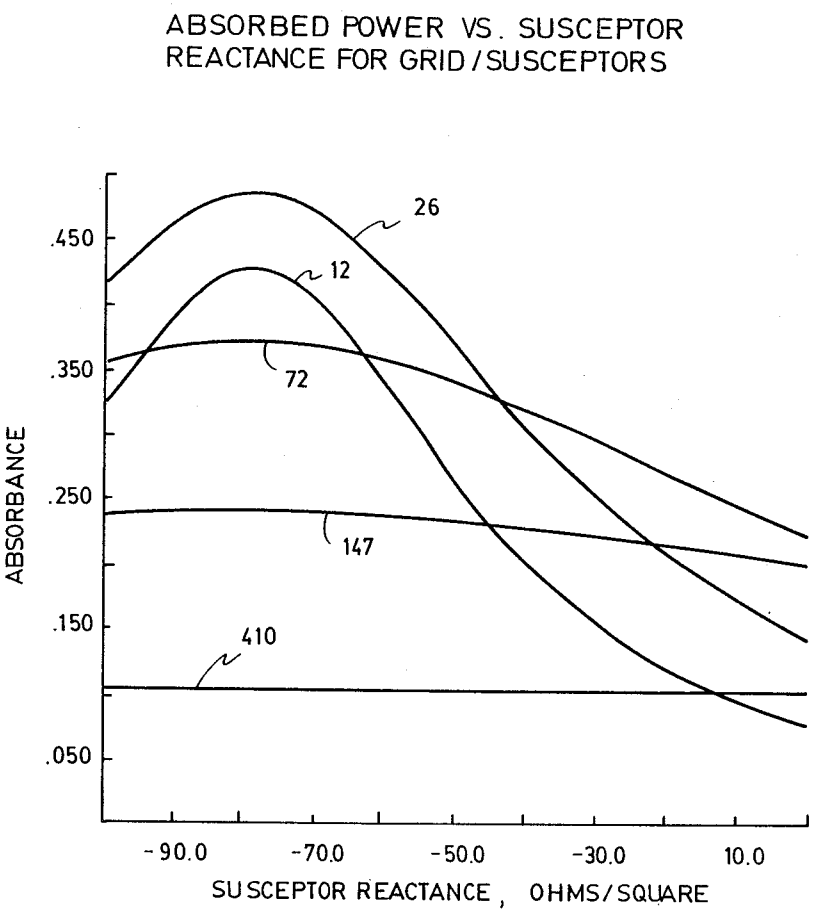

FIG. 42 is a graph depicting absorbed power versus susceptor reactance for various grid/susceptor combinations.

Figure 43:
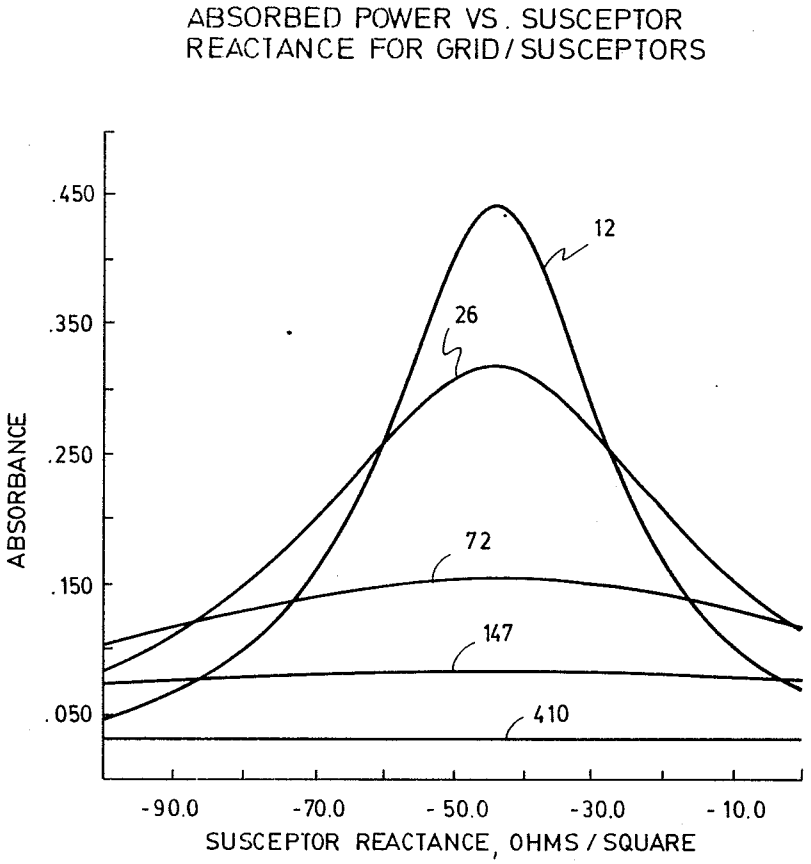
Figure 16:
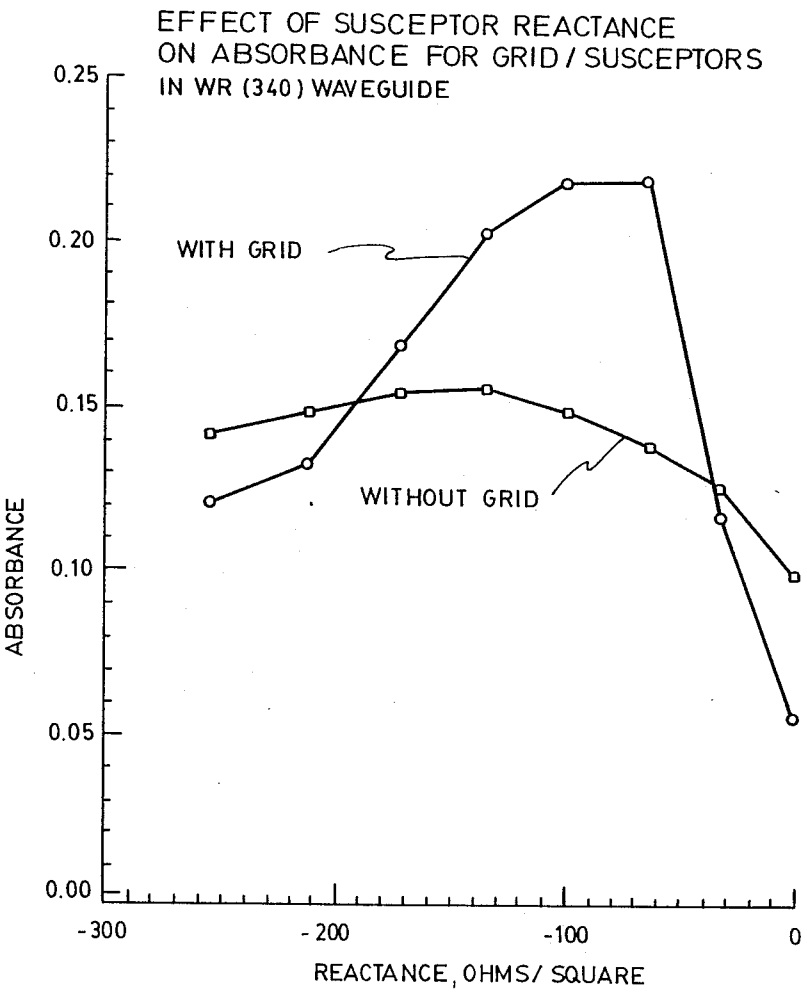
Figure 15:
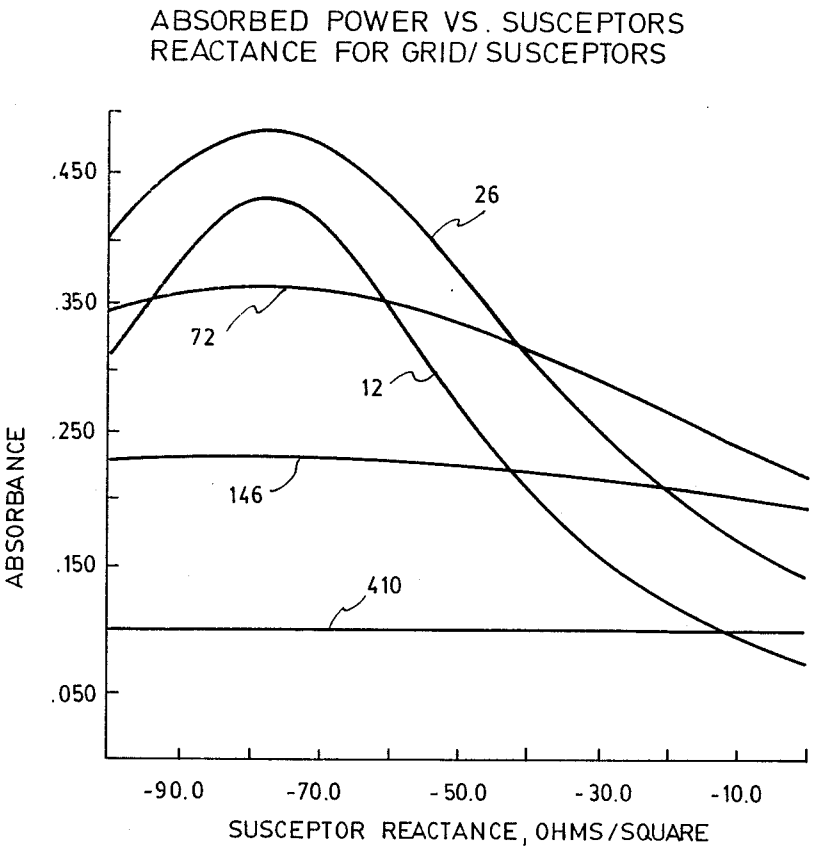

FIG. 43 is a graph depicting absorbed power versus susceptor reactance for various grid/susceptor combinations.

Figure 44:
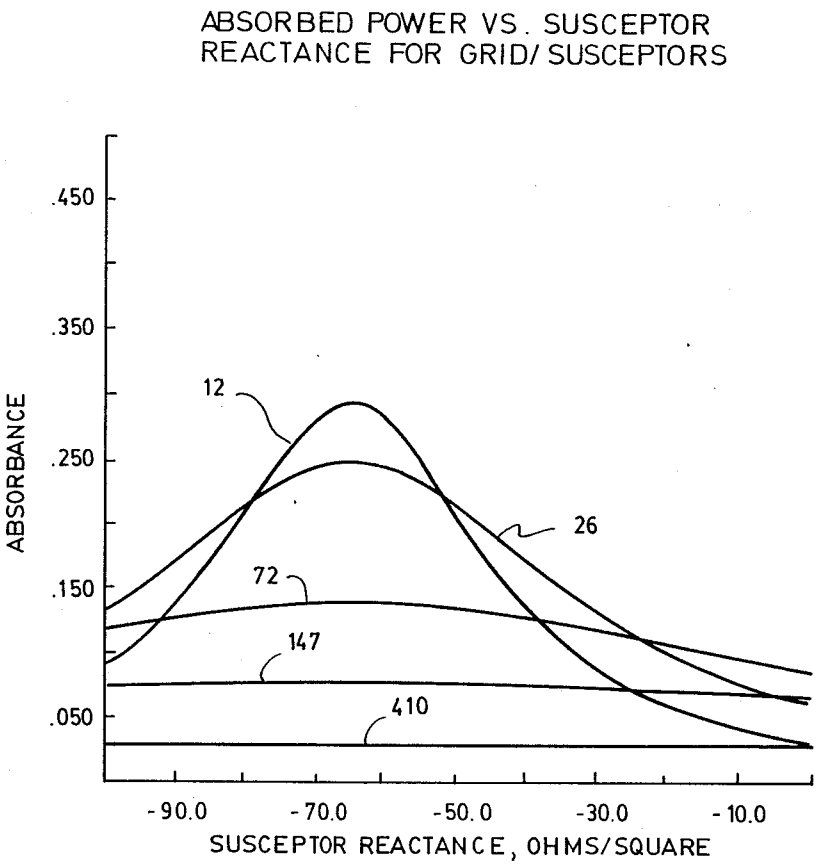

FIG. 44 is a graph depicting absorbed power versus susceptor reactance for various grid/susceptor combinations.

FIG. 45 is a graph depicting absorbed power versus susceptor reactance for various grid/susceptor combinations.

FIG. 46 is a graph showing absorbance as a function of susceptor surface reactance.

Figure 47:
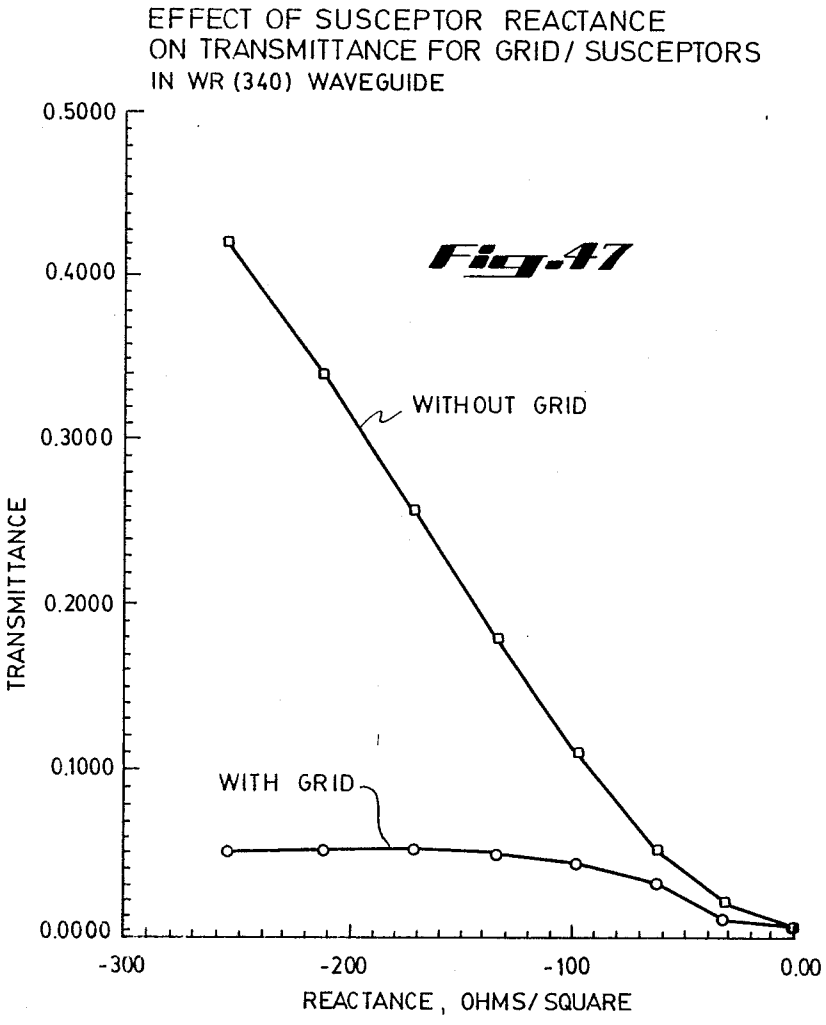

FIG. 47 is a graph showing transmittance as a function of susceptor surface reactance.

Figure 48:
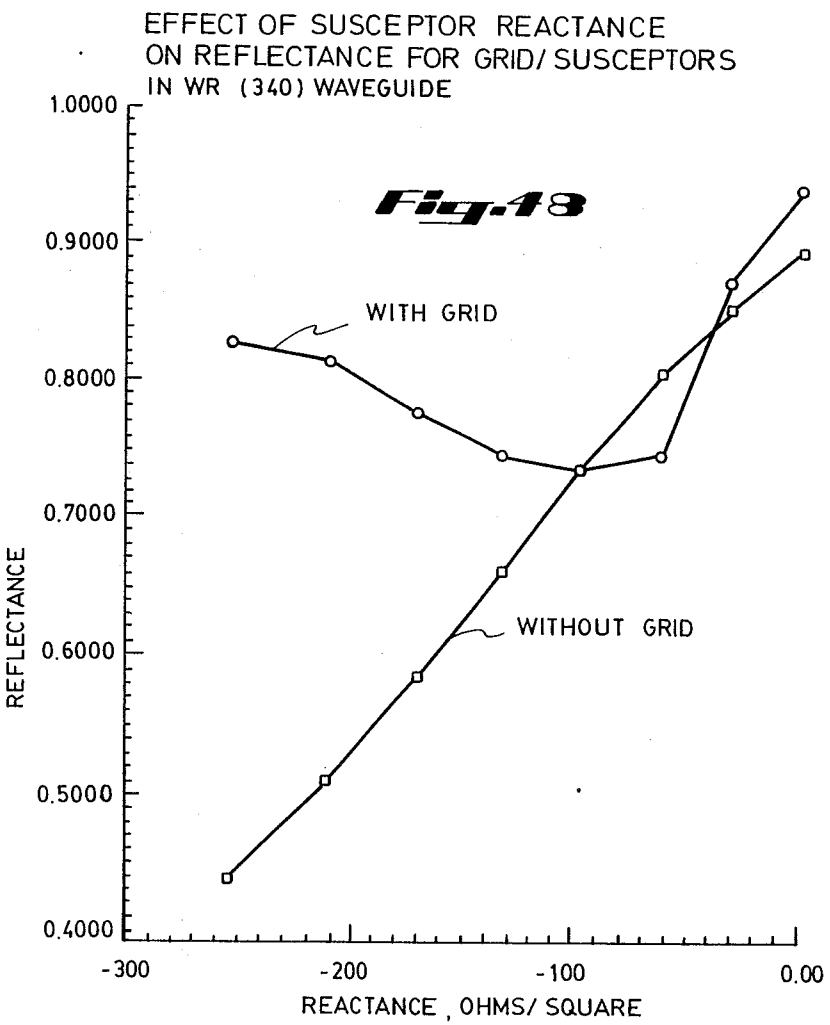

FIG. 48 is a graph showing reflectance as a function of susceptor surface reactance.

Figure 49:
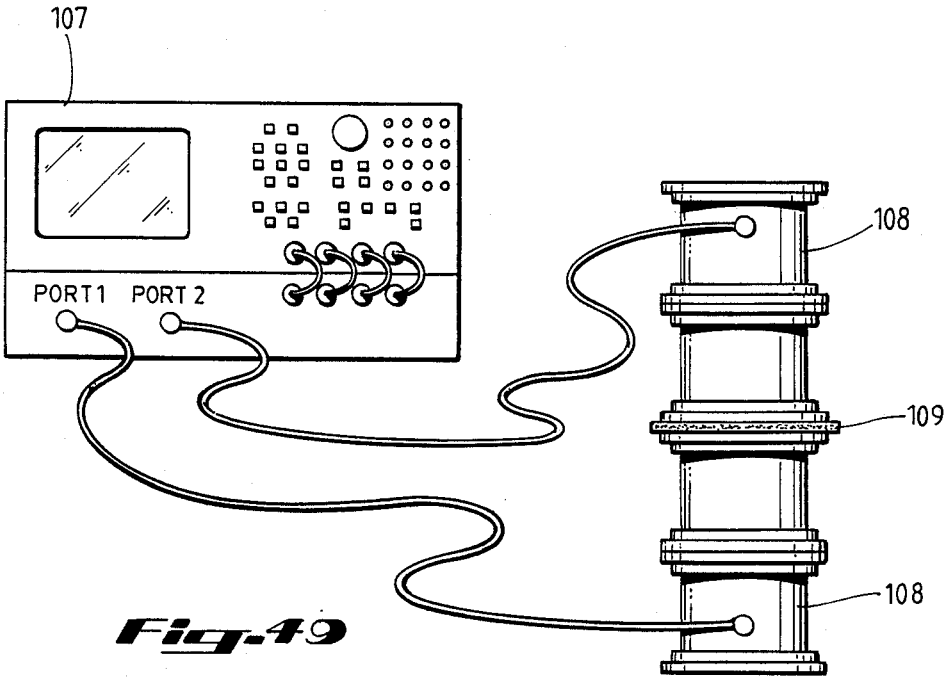

FIG. 49 is a front view of a network analyzer and waveguide showing how reflectance, absorbance, and transmissivity are measured.

Figure 50:
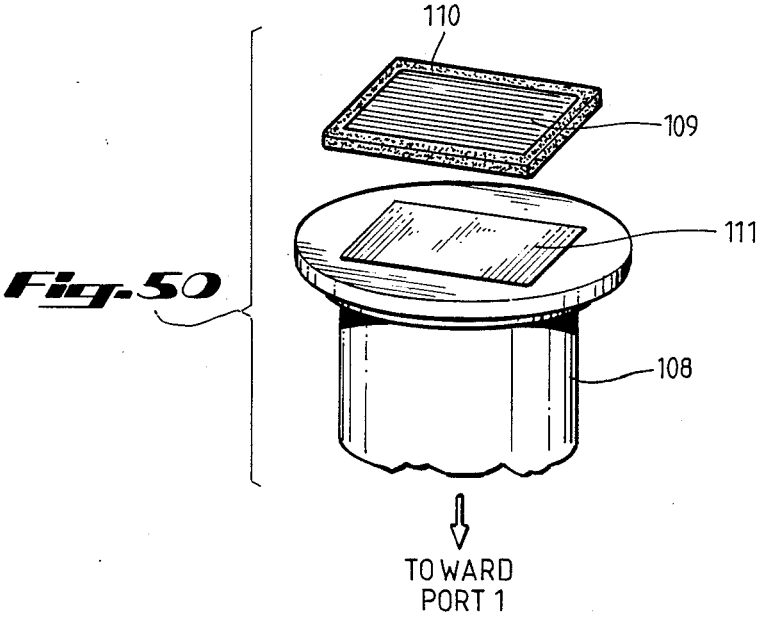

FIG. 50 is a perspective view of a sample and waveguide used in connection with the measuring equipment illustrated in FIG. 46.

DETAILED DESCRIPTION OF A PREFERRED EMBODIMENT

Some of the problems with prior art susceptors may be best described with reference to FIG. 1. FIG. 1 is a graph which depicts the reflected power, transmitted power and absorbed power for a susceptor, using a free space model.

Problems With Conventional Susceptors

A typical susceptor is made by depositing a thin film of metal upon a sheet of polyester. Thin film deposition techniques, such as sputtering or vacuum deposition, are typically used to deposit the metal film on the sheet of polyester. The metallized polyester may then be adhesively bonded to a sheet of paper, or paperboard if rigidity is desired. When the susceptor is exposed to microwave radiation, the susceptor can become relatively hot. The heat produced oftentimes causes dimensional changes, such as shrinkage, in the sheet of polyester. Cracks often form in the metallized polyester layer. These cracks are believed to cause conductivity breaks in the metallized film. This crack formation process, referred to as "breakup", is believed to be associated with irreversible changes which occur in the performance characteristics of the susceptor. The degree to which the susceptor heats, and the percentage of microwave power which is reflected, transmitted and absorbed, all change.

Prior to breakup, the curve for absorbed power for a susceptor will appear like the curve identified with reference numeral 10 in FIG. 1. In the curve depicted in FIG. 1, the percentage of absorbed power peaks at 0.5, or 50%, for a susceptor having a surface resistivity of about 180–200 ohms per square. The transmitted power for such a susceptor, according to this model, will generally follow the curve identified with reference numeral 11 in FIG. 1. Reflected power will follow the curve identified with reference numeral 12.

For a given susceptor, the surface resistance may increase during microwave radiation. Thus, the surface resistance will move toward the right on the graph shown in FIG. 1. The percentage of reflected power will decrease, and the percentage of transmitted power will increase.

It has been discovered that the electrical properties of susceptors change when exposed to microwave radiation during microwave cooking, and that such changes are generally deleterious to cooking performance. The metallized layer of a conventional susceptor will tend to break up. This creates a reactive component to the surface impedance, where the surface impedance may be expressed as $Z_S = R_S + iX_S$, where $Z_S$ is the surface impedance, $R_S$ is the surface resistance, and $X_S$ is the surface reactance. After breakup, the curve for absorbed power will tend to shift as shown by the curve identified with reference numeral 13 in FIG. 1. The transmitted power curve will tend to take the form of curve 14 in FIG. 1. The curve for reflected power will tend to take the form of the curve identified with reference numeral 15. The surface resistance will also shift to the right. Thus, it will be seen that the percentage of power which is transmitted through the susceptor greatly increases during microwave cooking. The percentage of power reflected greatly decreases. The percentage of power absorbed, and thus the heating of the susceptor, decreases. This is a result of the fact that the curve for the absorbed power changes from curve 10 to curve 13, and also that the surface resistance may increase sufficiently so that the susceptor moves down the right side of the curve 13.

This problem with prior art susceptors is further illustrated in FIG. 2. The graph shown in FIG. 2 depicts the changing characteristics for various susceptors having initial surface resistivities of 17, 27, 59, 86, 175 and 435 ohms per square, respectively. Although the surface resistivity changed after microwave heating, the plotted graph only identifies the various samples according to their initial resistivity for convenience of illustration.

It will be seen from FIG. 2 that a susceptor having a surface resistivity of 17 ohms per square initially began with over 90% reflected power, and only a few percent transmitted power. After microwave heating, the percentage of reflected power dropped to less than 40%, and the percentage of transmitted power was greater than 60%. The percentage of absorbed power remained roughly the same. Similar results were experienced for susceptors having other resistivities.

This change in the performance characteristics of a susceptor is undesirable in many applications. It would be desirable to have some mechanism for positioning microwave packaging material utilizing susceptor means at some point on the curve of FIG. 2, where the packaging material could remain in substantially the same position on the graph during microwave heating providing substantially unchanged reflected, transmitted and absorbed power characteristics. This has been substantially accomplished using the present invention.

A Preferred Embodiment

FIGS. 3 and 4 depict a preferred embodiment of the present invention. The illustrated embodiment is particularly useful for microwave cooking of pizza.

The embodiment illustrated in FIG. 4 includes a tray 16 and top 17 enclosing a food product 18. In this particular example, the food product 18 is a frozen pizza.

To achieve desirable microwave cooking characteristics of the pizza 18, a grid 19 and susceptor means 20 are provided in accordance with the present invention. As shown in FIG. 4B, the susceptor means 20 may include a thin metal film 21 deposited upon a polyester substrate 22, which are adhesively bonded to a board or face 23. The board 23 is preferably paper.

The grid 19 may serve at least two important functions.

First, the grid 19 controls the microwave transmissiveness of the grid/susceptor combination. When microwave radiation impinges upon the grid 19 and the susceptor 20, some of the microwave power will be transmitted through the grid 19 and susceptor 20, some of the microwave power will be absorbed by the susceptor 20, and some of the microwave power will be reflected back.

The percentage, or fraction, of incident microwave power which is transmitted through the grid/susceptor combination is referred to as the transmittance or transmissiveness of the grid/susceptor system. The percentage, or fraction, of microwave power which is reflected back from the grid/susceptor combination is referred to as the reflectance of the grid/susceptor system. The percentage, or fraction, of microwave power which is absorbed by the grid/susceptor combination is referred to as the absorbance of the grid/susceptor system.

Second, the grid can serve the function of achieving uniformity of heating. The grid 19 tends to spread the heating effects of the microwave radiation to achieve a more uniform heating of the susceptor means 20. Without the grid 19, a conventional susceptor would tend to develop hot spots and nonuniform heating. The grid 19 in combination with the susceptor mean 20 minimizes or eliminates the nonuniformity of heating which has been a significant problem in the past with microwave susceptors.

The grid 19 may also be referred to as a microwave field spreading and transmissiveness control apparatus 19. For purposes of this invention, an array of elements may function as a grid 19 when used to control transmissiveness of a susceptor system and to spread heating effects of microwave radiation. Any generally planar array of elements capable of redistribution of energy by mutual lateral coupling between adjacent elements should be essentially equivalent to the grid when used in the environment of this invention. "Planar", as used here, means a surface which does not necessarily have to be flat. For example, a sheet defining a grid 19 may be wrapped around a food item.

The susceptor means 20 may be a conventional susceptor 20 comprising a metallized polyester sheet 21, 22, which may optionally be adhesively bonded to a support member 23. The susceptor means 20 heats when exposed to microwave radiation. During microwave irradiation, the susceptor means 20 heats to a relatively high temperature. The heating effect of the susceptor means 20 can be used to crispen or brown the surface of a food substance 18 immediately adjacent to the susceptor means 20.

The susceptor means 20 in the example illustrated in FIG. 4 is shown more clearly in FIG. 4B. The susceptor means 20 in this example comprised aluminum 21, vacuum metallized onto 48 gauge polyester 22 which was adhesively bonded to 16 point SBS paperboard 23. Initial surface resistivity was measured at 50 to 70 ohms per square. The susceptor 20 was obtained from James River Corporation.

The grid 19 also serves as a diffusion means. When microwave energy passes through openings 27 in the grid 19, the microwave energy tends to be spread across the grid by coupling between adjacent holes (elements) in the grid. For purposes of illustration, the effect of the grid may be similar to that of light shining through a frosted glass. Alternatively, an explanation of this effect is that microwave energy tends to diffract when passing through the grid 19 in much the same manner that light diffracts when passing through pin holes in an opaque sheet. The reflectiveness of the grid 19 may be adjusted in order to adjust or control the percentage of power which is absorbed by the susceptor means 20. This, in turn, provides a measure of control over the rate of heating of the grid/susceptor combination which is used to heat the food product 18.

The tray 16 is generally transparent to microwave radiation, and is preferably composed of paperboard. The top 17 electrically is conductive, and is preferably composed of aluminum. An aluminum top 17 having a thickness of about 6 mils has given satisfactory results in practice.

The heating distribution of the pizza 18 may also be adjusted by providing microwave admitting apertures or openings 24. The size and position of the openings 24 may be adjusted to assist in achieving uniformity of heating of the food product 18. If more heating of the center portion of the food product 18 is desired, larger openings 24 may be made in the center of the top 17 to allow more microwave energy to reach the center of the food product 18. Conversely, if more heating of the outer edges of the pizza 18 is desired, then openings 24 could be provided around the outer rim of top 17. In the particular illustrated example, it has been found that the provision of openings in the center of the top 17 is desirable, as shown in FIG. 3.

The susceptor and grid configuration of FIG. 4 generally results in performance characteristics which do not substantially change during microwave heating. This is shown more clearly in FIG. 5. FIG. 5 depicts the shift in performance characteristics before and after microwave heating for a susceptor and grid combination in accordance with the present invention. The graph of FIG. 5 shows that the performance characteristics do not substantially change as a result of microwave heating. The superior stability of the present invention may be best understood by comparing the graph of FIG. 5, which represents the present invention, with the graph of FIG. 2, which represents conventional susceptor performance.

Figure 6:
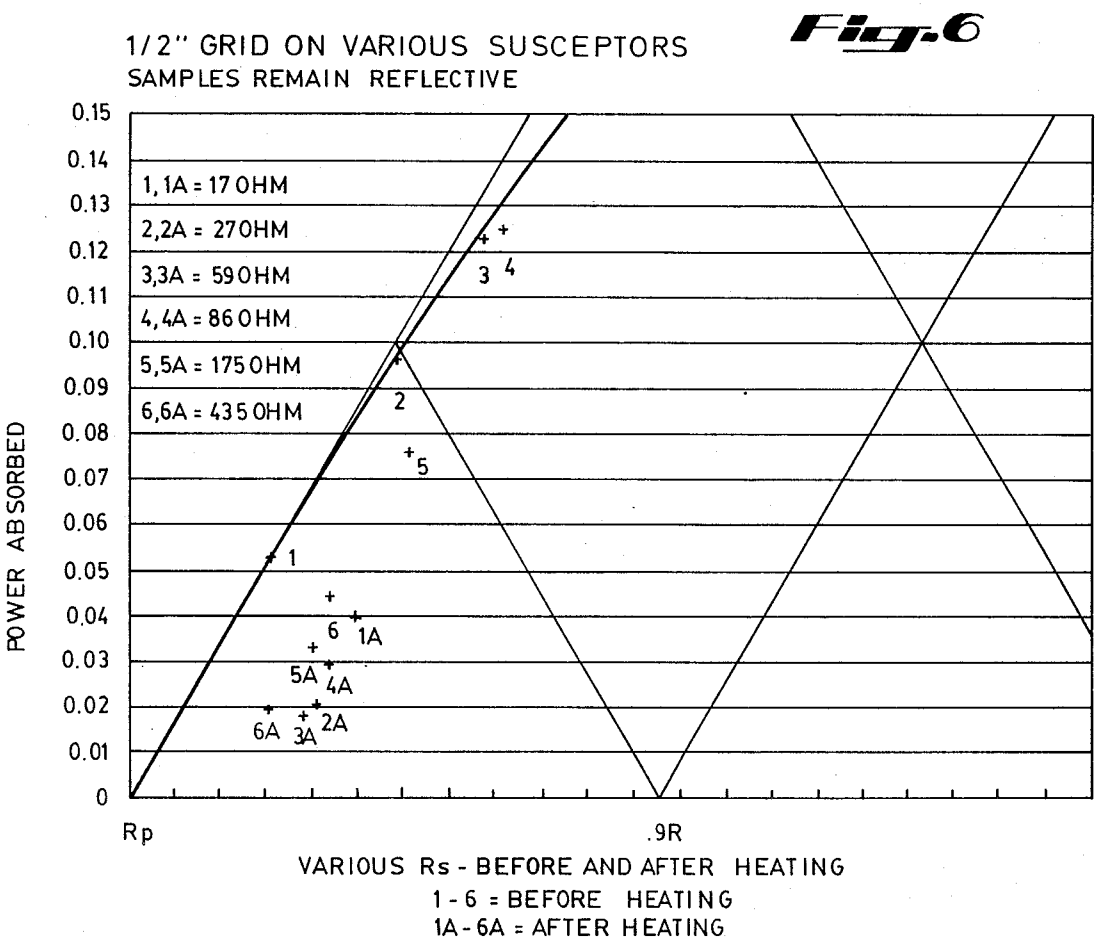
FIG. 6 is a graph depicting an expanded view of a portion of the graph shown in FIG. 5.

FIG. 6 is a graph depicting an enlarged view of a portion of FIG. 5. FIG. 6 shows the performance characteristics of a grid and susceptor combination before and after microwave heating. Susceptors having initial resistivities of 17, 27, 59, 86, 175 and 435 ohms per square were tested, both before and after heating. Measurements were made with a network analyzer, Hewlett Packard Model No. 8753A, where the grid was positioned toward port 1. The network analyzer test set up is illustrated in FIG. 49 and FIG. 50.

In FIG. 6, the point labeled 1 represents the measurement of microwave power reflection "R", absorption "A" and transmission "T" for a 17 ohms susceptor prior to heating. The point labeled 1A represents the R, A and T measurements for a 17 ohms susceptor after heating. Similarly, the points 2 and 2A represent the R, A and T measurements for a 27 ohms per square susceptor before and after heating, respectively. The points 3 and 3A represent the R, A and T measurements before and after heating, respectively, for a 59 ohms per square susceptor. The points 4 and 4A show the R, A and T measurements for an 86 ohms per square susceptor. The points labeled 5 and 5A, and the points labeled 6 and 6A, represent the R, A and T measurements for 175 and 435 ohms per square susceptors, respectively.

FIGS. 5 and 6 show that the present invention results in dramatic improvements during microwave heating in stability of the performance characteristics of the susceptor and grid combination in accordance with the present invention.

Referring again to the preferred embodiment illustrated in FIGS. 3 and 4, the present invention solves the problem of nonuniform heating which has plagued the prior art. Attempts to heat a large pizza 18 with a susceptor means 20 in the past have resulted in severe nonuniform heating of the pizza 18. Typically, the outer edges of the pizza 18 would be crispened or browned by the susceptor means 20, but the center portion of the pizza 18 would be soggy and undercooked. The crust of the center portion 18 would not be crispened. The grid 19 and susceptor means 20 combination surprisingly results in uniform heating of the pizza 18. Thus, the entire crust of the pizza 18 may be browned, and the pizza 18 evenly cooked.

The apertures 24 are used to fine tune the uniformity of heating of the pizza 18. In the illustrated example, the tray 16 is transparent to microwaves. Thus, some microwave radiation leaks in through the outer edges 26 of the tray 16. By providing apertures 24 generally concentrated at the center of the top piece 17, the dielectric heating of the food 18 may be compensated by the openings 24 so that the heating is substantially uniform.

When the package illustrated in FIG. 4 is placed in a microwave oven for microwave cooking, the microwave radiation is normally emitted into the oven cavity from a magnetron typically located above the package. Conventional microwave ovens have a microwave transparent shelf upon which the illustrated tray 16 rests. Below the shelf, a reflective oven cavity wall is typically located. Thus, microwave energy will enter the bottom of the tray 16 after being reflected from the bottom of the oven cavity wall. Some microwave radiation will also enter through the microwave transparent sides 26 of the tray 16, and through the openings 24 in the top 17.

During operation, the grid 19/susceptor 20 combination behaves substantially more like a conventional frying pan as it is heated by microwave radiation, than was the case with susceptors previously known to the art. One purpose of a susceptor is to provide a degree of surface heating, (to produce crispening or browning of the food item), which would not otherwise occur. A serious drawback of susceptor previously known to the art is that they became highly transparent during operation, as is seen in FIG. 2. This process generally resulted in more internal dielectric heating of the food item, and less surface susceptor heating, than was desirable. In contrast, the grid 19/susceptor 20 combination, by virtue of the low degree of transmission which it maintains throughout heating, provides a higher degree of surface heat relative to internal dielectric heating. In this way the grid 19/susceptor 20 functions substantially more like a frying pan than did susceptors previously known in the art. The metallized surface 21 substantially heats responsive to microwave radiation, and the composite grid/susceptor structure maintains a low percentage of transmission of microwave energy.

The heating effect of the susceptor 20 is substantially uniform due to the unique combination of a susceptor 20 with a grid 19. This hot cooking surface 21, or substantial "frying pan" effect, serves to uniformly brown or crispen the crust of the pizza 18. The topping and the crust of the pizza 18 are also cooked from a combination of the heat emitted by the susceptor means 20 and dielectric heating of the food 18 due to microwave radiation which enters through the openings 24 in the top 17, and through the sides 26 and bottom of the tray 16. This unique combination of a "frying pan" effect provided by the susceptor means 20, and dielectric heating of the food 18 by the transmitted microwave energy, significantly reduces the total cooking time for the pizza 18. For example, in a conventional oven a pizza which might require 30 minutes for proper cooking may be cooked using the illustrated embodiment of the invention in about 11 minutes. The resultant pizza 18 will possess desirable characteristics of moistness and amount of cooking, together with a substantially uniform browned and crispened crust.

The grid/susceptor combination achieves much more uniform heating of the food substance 18, than would be the case if a susceptor 20 was used without a grid 19. In the case of a grid 19 having openings or holes 27, a certain interaction between the openings occurs when exposed to microwave radiation. The interaction is generally more pronounced as the distance between the openings 27 decreases. Conversely, the interaction between openings 27 generally decreases as the openings 27 are moved apart. Thus, it is desirable, up to a limit, to place circular openings 27 in the grid 19 closer together to increase interaction between the openings 27. If the width of the strips 28, shown as "W" in FIG. 3A, is made too thin, the mechanical integrity of the grid 19 may be adversely affected. Also, the electrical conductivity of the strips 28 may be broken, and/or the electrical resistance of the strips 28 may become too large, thus adversely affecting the electrical integrity of the grid 19.

During operation, closely spaced openings 27 tend to share fields during microwave radiation. A certain amount of coupling occurs between adjacent openings 27. A high field located in the proximity of a particular opening 27, which would otherwise create a hot spot on the susceptor 20, will be partially coupled to adjacent openings 27 by the action of the grid 19. This coupling or sharing of fields between adjacent openings creates a more uniform heating effect on the food substance 18. The grid 19 creates a redistribution of energy by mutual lateral coupling between adjacent elements 27 of the grid 19. In a general sense, the term "elements" may be used to refer to the openings 27, because equivalent structures may be devised capable of accomplishing spreading of the heating effect by mutual coupling between adjacent elements.

Thus, heating of the food substance 18 is made more uniform as a spot on the susceptor means 20 located coincident with an opening 27 in the grid 19 has its field partially coupled to adjacent elements 27 of the grid. The adjacent openings 27 share fields to some extent, thereby distributing or spreading out the field to some extent to achieve a more uniform heating effect.

Since the susceptor 20 absorbs predominantly the component of the local electric field which is tangential to the susceptor surface, hot spots on the susceptor means 20 may be at a point where the predominant field has a particular local polarization. Most microwave ovens have a mode stirrer. In operation, a mode stirrer may cause the instantaneous polarization at any particular point to shift rapidly. What can be observed, in some cases, is a polarization effect resulting from the average value of the field at a given point. A particular local polarization at a hot spot may have an effect upon the sharing between adjacent openings 27 of the field at that point. The orientation of columns and rows of openings 27 will, therefore, affect the sharing of the field. Local polarization tends to affect the direction of sharing between adjacent openings 27. This is shown by FIG. 14A and FIG. 14B. FIG. 14A is a grid having circular openings 27 with a square lattice orientation. FIG. 14A represents a copy of an image taken with an infrared camera of a grid/susceptor combination during microwave heating. FIG. 14B is also a copy of an image taken with an infrared camera of a grid/susceptor combination during heating in a microwave oven. In FIG. 14B, the grid had circular openings 27 with an equilateral triangular lattice configuration. In both cases, sharing of the field between adjacent openings 27 is apparent, particularly along certain columns.

The original images taken with the infrared camera, from which FIGS. 14A and 14B were copied, were in color. The original color images are incorporated herein by reference. Black and white copies of these color images are used herein for convenience, and to avoid difficulties and unnecessary complications in printing this specification.

In the past, it has been necessary to specially formulate foods for a microwave oven application in order to obtain improved results in a microwave oven. One advantage of the present invention is that many products prepared for cooking in a conventional oven may be cooked in a package according to the present invention without changes in the composition of the product. Good results are obtained using the present invention in combination with foods prepared for cooking in a conventional oven.

The package illustrated in FIGS. 3 and 4 has been successfully used to cook conventional deep dish pizza having a diameter of about 10⅞ inches (27.6 cm), and a total net weight of about 1.75 pounds, (about 796 grams). The cooking time required was only 11 minutes. The success achieved with the present invention was surprising, because in the past it has been impossible to satisfactorily cook a large pizza in a microwave oven.

In operation, the present invention overcomes disadvantages experienced in the past during microwave cooking where undesirable temperature differentials and moisture movement has been experienced. In the present invention, the "frying pan effect" achieved by the susceptor 20 in combination with the grid 19 generates a persistent and highly localized heating at the surface of the pizza 18. This results in a temperature profile through the thickness of the pizza 18 where the temperature of the surface of the pizza 18 is believed to be significantly greater than the temperature of the interior of the pizza 18. This encourages moisture movement opposite that which had been experienced in microwave cooking of such pizzas in the past, and which more closely approximates the desired moisture movement which occurs in a conventional oven. The moisture either escapes into the oven atmosphere or migrates toward the interior of the pizza 18. Thus, the moisture content of the bottom surface of the pizza 18 is substantially reduced to produce a taste sensation which is perceived by a consumer as "crispness."

In an example in which an identical pizza was cooked in a microwave oven for 11 minutes using only a conventional susceptor, (no grid was used in combination with the susceptor), and the pizza was not covered during cooking, the results were unsatisfactory. The outer one inch annular ring of the crust was browned, and was so tough or hard that it was practically inedible. That portion of the pizza crust was virtually impossible to chew. The center portion of the pizza had barely been warmed during microwave heating. No browning of the center portion of the pizza crust was observed.

The present invention provides a means to achieve a desired degree of surface heating of the food substance 18. This is oftentimes desirable because, with some food substances, crisping or browning of the surface is desired. In other food substances, a certain amount of surface heating is desirable in order to maintain a particular temperature profile or moisture migration during heating. The present invention provides this desirable degree of surface heating in combination with a controlled degree of internal heating.

One problem with the use of conventional susceptors without utilizing a grid 19 in accordance with the present invention, was that conventional susceptors tend to break down during microwave heating. When conventional susceptors break down during microwave heating, the susceptors become highly transmissive and allow a large percentage of the microwave energy to pass through the susceptor and reach the food substance. The dielectric heating of the food substance which results causes an undesirable degree of internal heating. The present invention allows the transmissiveness of the grid/susceptor combination to be controlled. The present invention also maintains relatively stable performance characteristics during microwave cooking. Even though a susceptor is still believed to break down to some extent when used in combination with a grid, the grid/susceptor combination of the present invention appears to control break down so that the composite characteristics of the grid/susceptor combination can be substantially controlled. The present invention allows the microwave transmission and absorption characteristics of the grid/susceptor system to be controlled, changed, and manipulated as desired in order to achieve a desired degree of surface heating in combination with a desired degree of internal heating. With a conventional susceptor alone, it was very difficult and sometimes virtually impossible to balance the degree of surface heating against the degree of internal heating. The present invention solves this problem.

In the illustrated embodiment, the grid 19 has a diameter of 10.25 inches (26 cm). A cross-hatching of metal strips 28 define a plurality of openings 27. The openings 27 in the grid 19 are squares having a length and width, shown as "D" in FIG. 3A, of about ½ inch (1.27 cm). The illustrated hole geometry is square openings 27 arranged in a square lattice. The grid 19 was made from a sheet of aluminum foil by cutting the openings 27 in the foil. The metal strips 28 separating the openings 27 of the grid 19 have a width "W" of about 3/16 inch (0.48 cm), as shown in FIG. 3A. Thus, the spacing between holes is about 3/16 inch. In the illustrated example, the grid 19 has an open area defined by the total area of the individual openings 27. The closed area, or microwave opaque area, is defined by the area of the metal strips 28 of the conductive grid 19. In the illustrated example, the ratio of open area to microwave opaque area was about 52.9%. In other words, the grid 19 had about 53% open area.

Preferably, the separation between the strips 28 of the grid 19 is sufficient to avoid arcing during microwave cooking. The required spacing will depend somewhat upon the load, which is a function, inter alia, of the amount and composition of the food substance 18 and the thickness of the food substance 18.

In practice, a metal thickness of about 1 to 4 mils (0.0025 to 0.01 cm) for the strips 28 of the grid 19 has given satisfactory results. Thickness as small as 0.275 mils (0.0007 cm) have also given satisfactory results in practice.

Susceptors 20 having an initial resistivity of about 50 to 120 ohms per square have given satisfactory results in practice.

FIG. 4A shows a detailed view of the interface between the top 17 and the tray 16.

Alternative Grid and Susceptor Arrangements

Figure 7A:
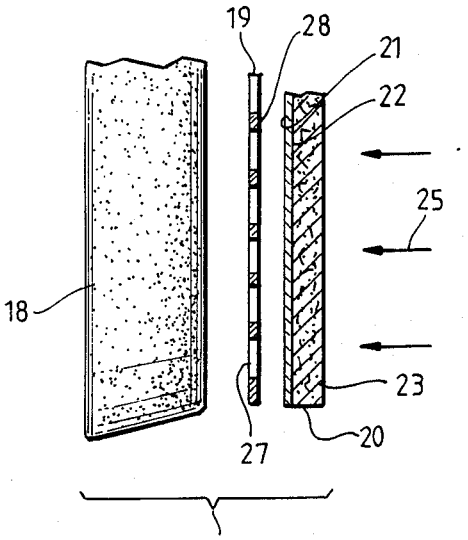

FIG. 7A schematically depicts the configuration of the grid 19 and susceptor means 20 configuration for the pizza container shown in FIGS. 3 and 4. In this example, microwave power primarily impinges upon the grid/susceptor combination from the direction indicated by the arrow 25. Although some microwave radiation is admitted through the openings 24 shown in FIG. 4, it is substantially completely absorbed by the lossy pizza 18 in this particular example.

Figure 7B:
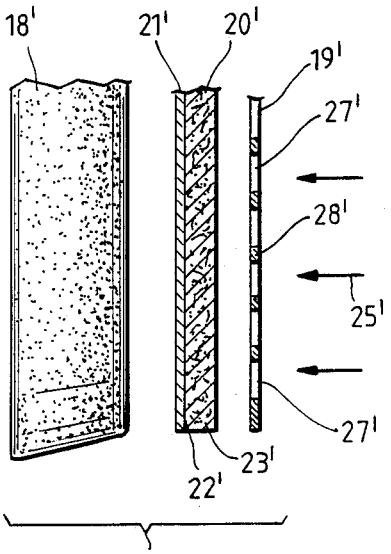
FIG. 7B is a cross-sectional schematic representation of an alternative grid and susceptor configuration.

FIG. 7B illustrates an alternative embodiment of the present invention having a grid means 19', and susceptor means 20' in a configuration where microwave energy from the direction indicated by the arrow 25' impinges upon the grid 19' prior to the susceptor means 20'. Of course, the susceptor means 20' may be composed of a thin film of metal 21' deposited upon a polyester substrate 22', which is adhesively bonded to paperboard 23'. The metallized polyester 21', 22' is immediately adjacent to a food substance 18'. In order to prevent microwave energy from impinging from the left of FIG. 7B, a shielded food container may be utilized in combination with the grid 19' and susceptor 20'.

Figure 7C:
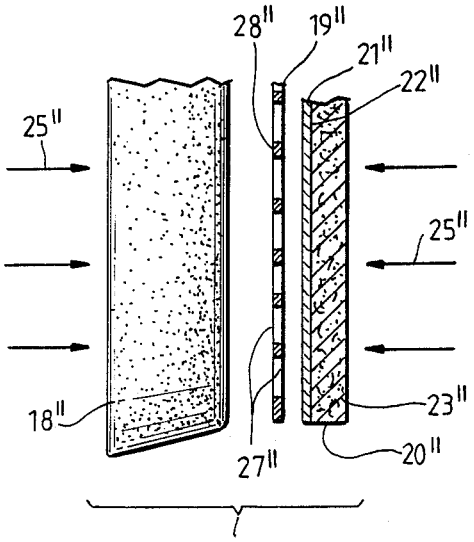
FIG. 7C is a cross-sectional schematic representation of a grid and susceptor combination for use with an unshielded food container.

FIG. 7C schematically depicts an alternative embodiment of the present invention utilizing an unshielded food container. Microwave energy impinges from two sides, as generally indicated by the arrows 25''. In this example, a grid 19'' and susceptor means 20'' is provided similar to the configuration shown in FIG. 7A.

Figure 7D:
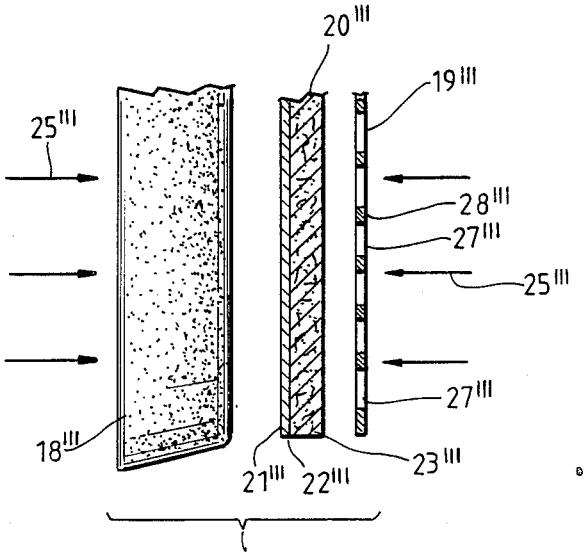
FIG. 7D is a schematic cross-sectional representation of a grid and susceptor combination for use with an unshielded food container.

FIG. 7D depicts an alternative embodiment of the present invention utilizing an unshielded food container. A grid and susceptor combination is utilized similar to that shown in FIG. 7B, with the exception that microwave energy impinges from two directions, as shown by arrows 25'''.

The paperboard 23 is not essential to the operation of the present invention. The susceptor means 20 may comprise a thin film of metal 21 deposited upon a polyester substrate 22. This polyester plastic film may be wrapped around a food product 18, and a grid 19 wrapped around this composite structure. Alternately, the metallized polyester 22 may be adhesively bonded to a grid 19.

Design Factors

Performance of a microwave package constructed in accordance with the present invention can be adjusted using at least four different factors. The size of the holes 27 may be adjusted, the geometry of the holes may be changed, the impedance characteristics, e.g., resistivity and reactance, of the susceptor may be adjusted, and the distance of the susceptor 20 from the grid 19 may be adjusted. There are also at least four approaches to analyzing the grid/susceptor combination: (1) analyzing the performance characteristics utilizing a network analyzer; (2) actual performance tests in a microwave oven; (3) using an equivalent circuit model; and (4) using mathematical models. Although different approaches have been used for analysis, the agreement between all four approaches has been surprising.

Hole Size

Adjusting the hole size may increase or decrease the amount of power heating the food substance 18. For a given resistivity, increasing the hole size in the grid 19 will generally increase the percentage of power absorbed by the susceptor 20 and will generally increase the percentage of power transmitted through the grid/-susceptor combination, and vice versa.

Figure 8:
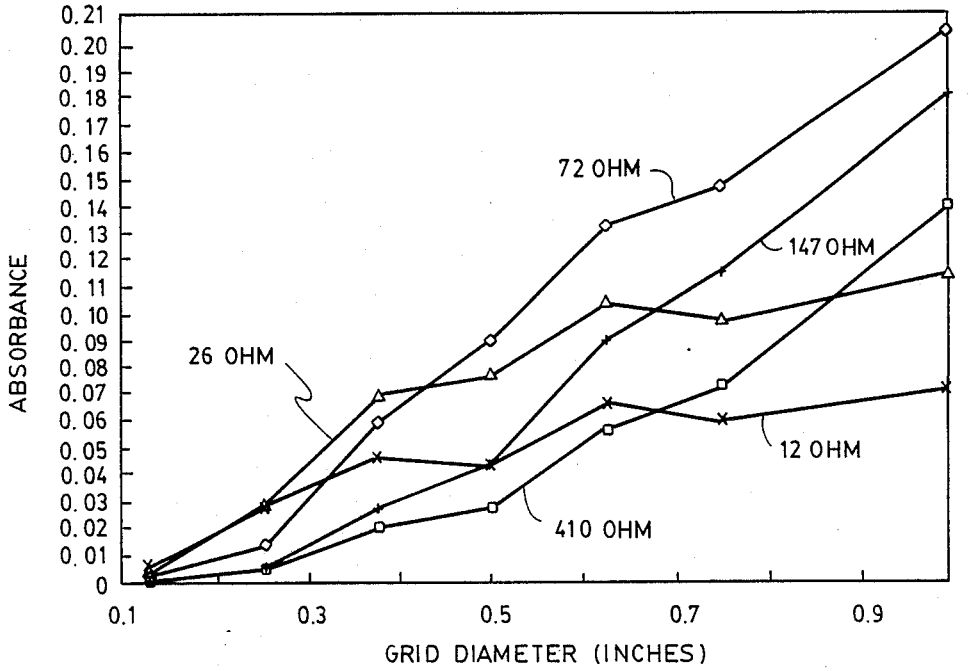
FIG. 8 is a graph depicting absorbance versus hole size for various susceptor resistivities.

The effect of the size of the holes 27 in the grid 19 is shown by the graph of FIG. 8. FIG. 8 represents a plot of the size of the openings 27 in the grid 19, versus the absorbance measured with a network analyzer. Each curve represents a different resistivity for the susceptor means 20. Absorbed power was measured for susceptors having resistivities of 12, 26, 72, 147 and 410 ohms per square. The grid 19 had circular holes in this example. For smaller hole sizes, the lower resistivity susceptors had greater absorption. For intermediate hole sizes, for example ¾ inch (1.9 cm) , an intermediate range susceptor having a resistivity of 72 ohms per square had maximum absorption. The waveguide utilized with the network analyzer that was used to make these particular measurements did not permit measurements upon grids having openings 27 larger than one inch. The data trend suggests that if the curve for the larger resistivity susceptors is extrapolated, e.g., the curve for the 147 ohms per square susceptor, the larger resistivity susceptors will eventually have greater absorption when the openings 27 are made sufficiently large.

Figure 9:
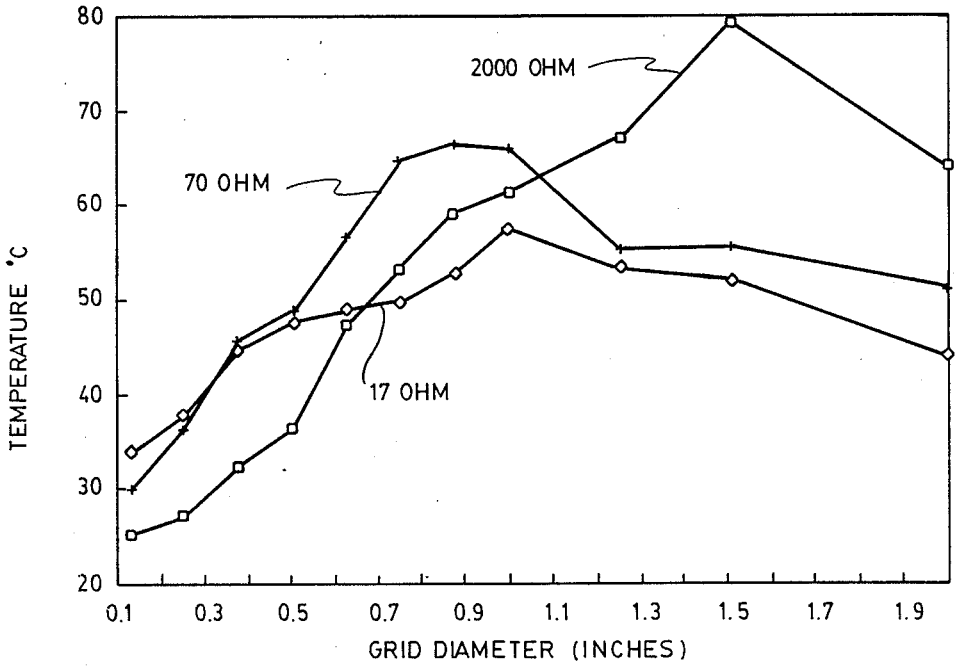
FIG. 9 is a graph plotting temperature versus hole size for various resistivity susceptors.

FIG. 9 is a graph which depicts temperature measurements made upon various size grids using three different susceptors having resistivities of 17, 70 and 2000 ohms per square. The temperature data was measured using an infrared camera aimed at the underside of the susceptor, i.e., the paperboard 23 side. Although the actual temperature of the metallized film 21 was not actually measured, the relative temperature measurements are significant. This measurement technique was utilized because attempts to measure the temperature of the thin film 21 by aiming the infrared camera directly at the metallized film 21 resulted in spurious reflected images. The experimental data reflected in FIG. 9 is intended to compare the relative temperatures. The absolute temperatures are not critical for this particular experiment.

FIG. 9 shows the results for grids 19 having openings as large as two inches (5.1 cm). In this experiment, for hole diameters larger than 1.2 inches (3 cm), the higher resistivity susceptors, (e.g., 2000 ohms per square), had greater absorption than the lower resistivity susceptors. For small size openings 27, e.g., 0.125 inch (0.32 cm), the low resistivity susceptor having 17 ohms per square resistivity had greater absorption. For intermediate size openings 27 in the grid 19, on the order of about 0.5 to about 1.0 inch (1.27 cm to 2.5 cm), the intermediate range susceptor having a resistivity of about 70 ohms per square had the greatest amount of absorption.

Figure 10:
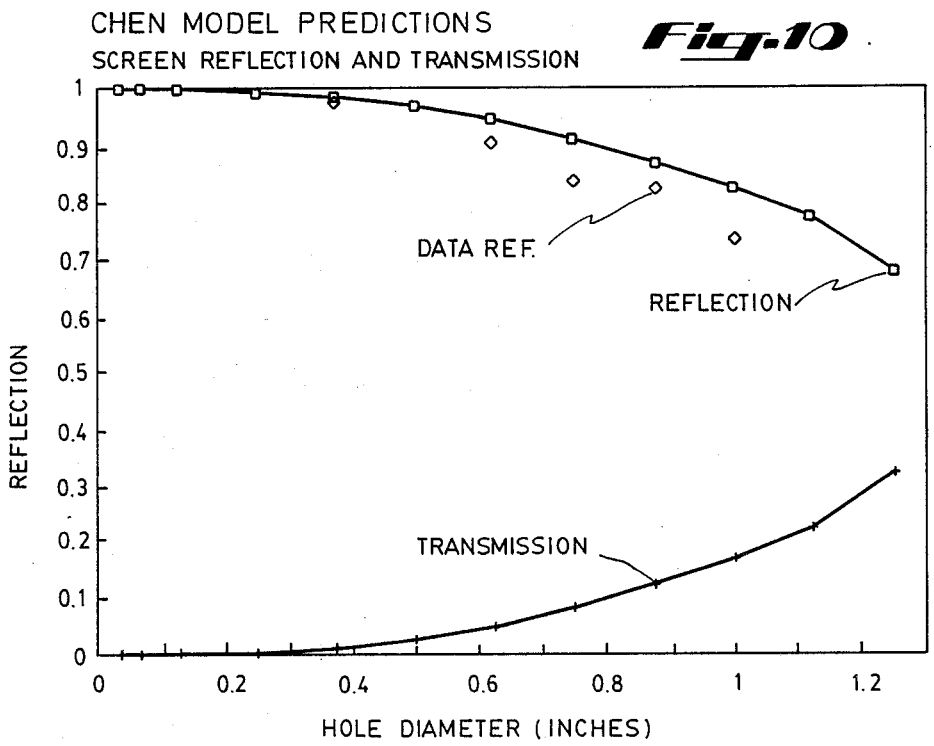
FIG. 10 is a graph depicting percentage of power reflected and transmitted for various size holes based upon a mathematical model.

FIG. 10 is a graph depicting calculations based upon a mathematical model referred to herein as the Chen model. The Chen model is more particularly described in an article entitled "Transmission of Microwave Through Perforated Flat Plates of Finite Thickness", by Chao-chun Chen, published in *IEEE Transactions on Microwave Theory and Techniques*, Vol. MTT-21, No. 1, pp. 1–6, (January 1973), the entirety of which is incorporated herein by reference. A comparison of reflection coefficients calculated using the Chen model, with reflection coefficients (for grids alone) measured using a network analyzer, is shown in FIG. 10. In FIG. 10, there is no absorption. The Chen model is based upon a model of a grid alone, without a susceptor. The Chen model assumes electrically thick grids made from good conductors. The Chen model does not include absorption in the mathematical model. Therefore, the transmission is equal to 100% minus the percentage of reflection. In this example, the reflection coefficient decreases as the hole diameter increases. Measurements made on grids with the network analyzer agree closely with the values predicted by the Chen model.

A preferred range of hole sizes for use in connection with the present invention is between about 0.125 inch (0.32 cm) and about 2 inches (5.1 cm). If the hole size is made too small, the amount of absorption in the susceptor means will usually be insufficient. If the hole size is made too large, the advantages of the present invention relating to uniformity of heating and control of reflectance will not be as apparent. The preferred range of hole size is dependent upon the frequency of the microwave radiation. The above preferred range of hole sizes may alternatively be expressed as about 2.6% of the wavelength to about 40% of the wavelength of the microwave energy in free space. A less preferred range which may give useful results in some applications, is about 0.65% of the wavelength to about 1 wavelength. In the present example, utilizing a microwave oven having a frequency of about 2450 MHz, this range may be expressed as about 1/32inch (0.03125 inch) (0.08 cm) to about 4.8 inches (12.2 cm). In this particular example, the term "wavelength" refers to the free space wavelength of the microwave energy, not the wavelength of the microwave radiation in the food or packaging material. The wavelength in air is essentially the same as the wavelength in free space. A grid 19 with openings 27 having a size between about ⅛ inch and about 2.4 inches is more preferred. An even more preferred range for the present invention is about 0.375 inch (0.95 cm) to about 0.875 inch (2.2 cm) for the hole size. This may be expressed as a range of about 7.8% of the wavelength to 18.2% of the wavelength of the microwave energy.

In the case of circular openings 27, the size is the diameter of the hole 27. In the case of square openings 27, the size is the width. For a rectangle, the size is the average of the length and width, i.e., the length plus the width, all divided by two. For other shaped holes, the size is the length of the major axis.

Susceptor Surface Impedance

For a given hole size, an optimum resistivity for the susceptor element 20 may be selected for peak heating. The size of the openings 27 and the resistivity of the susceptor 20 may both be varied in order to adjust the rate of heating of the food substance 18.

Figure 17:
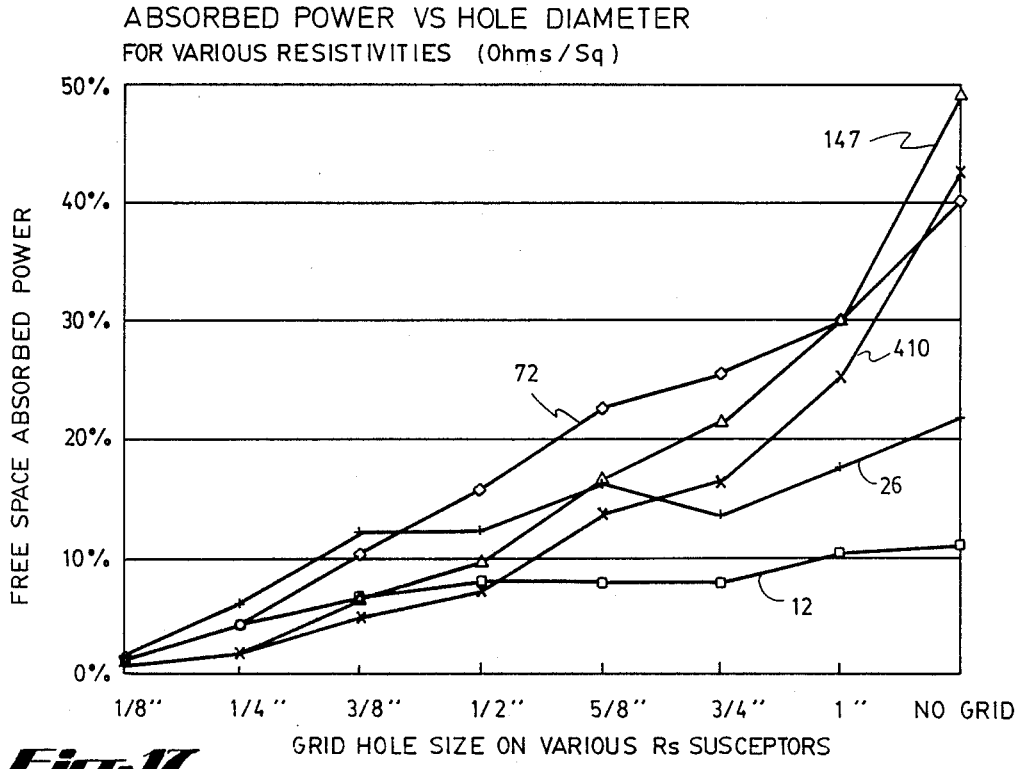
FIG. 17 is a graph depicting absorbed power as a function of hole size for various resistivity susceptors.
Figure 18:
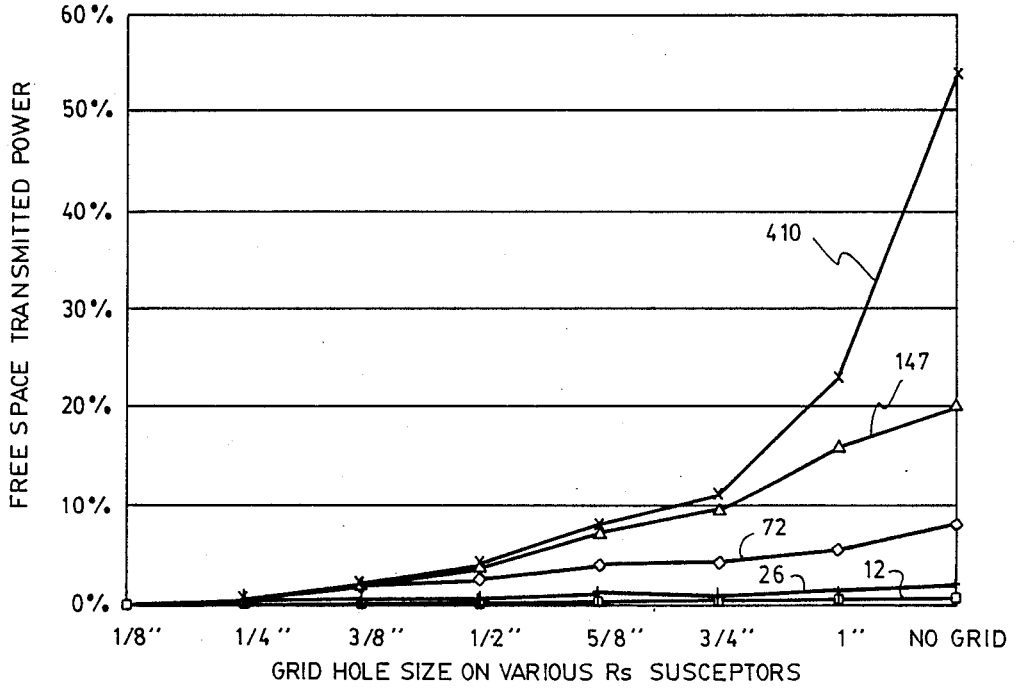
FIG. 18 is a graph depicting percentage of transmitted power as a function of hole size for various resistivity susceptors.
Figure 19:
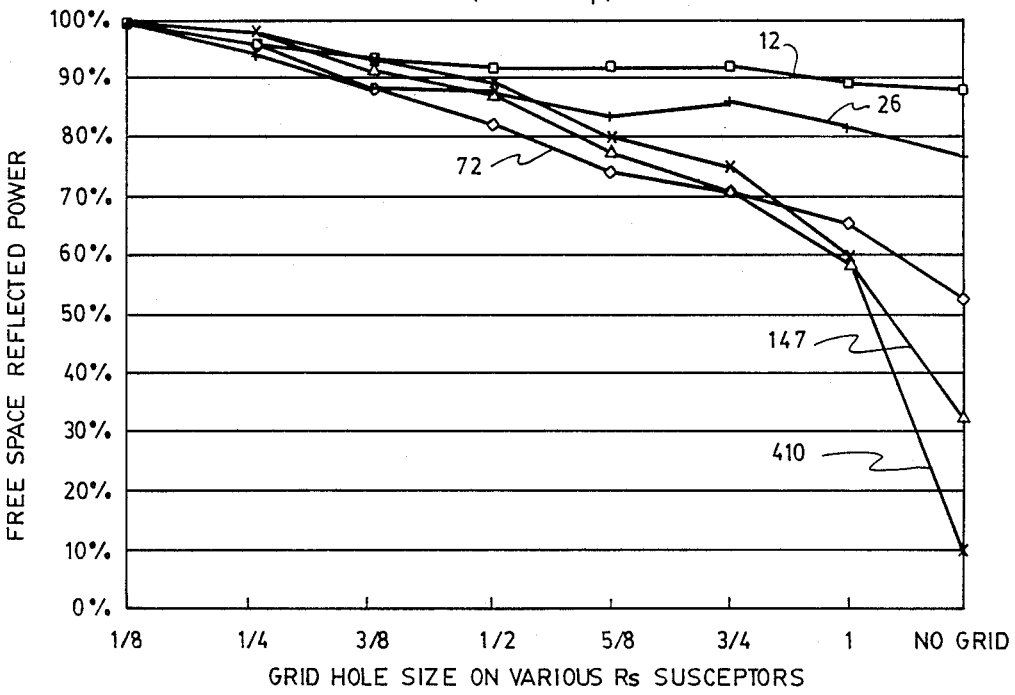
FIG. 19 is a graph depicting percentage of reflected power as a function of hole size for various resistivity and various grid and susceptor combinations.

FIGS. 17, 18 and 19 are graphs representing measurements taken using a network analyzer on grid/susceptor combinations having various resistivities for the susceptor 20 and various hole 27 sizes for the grid 19. In this experiment, the grids had circular openings 27. The openings 27 were arranged in an equilateral triangular lattice configuration. In each sample, the minimum width of the strips 28 between adjacent openings or holes 27 was maintained at about ⅛ inch (0.32 cm). The network analyzer was used to measure the resistivity of the various susceptors 20 employed in the experiment.

FIG. 17 is closely related to FIG. 8. Both graphs show the same experimental data. However, FIG. 17 includes the additional set of data points plotted to the far right of the graph showing absorbed power in free space for a susceptor 20 with no grid 19. In all cases, susceptors 20 were used which had not been exposed to microwave cooking.

As discussed above, as the size of the openings 27 is increased, the percentage of microwave energy which is absorbed by the susceptor 20 increases. Also, the percentage of microwave power which is transmitted through the grid/susceptor combination also increases as the size of the openings 27 is increased. This is shown by FIG. 18. FIG. 19 shows that, as the size of the openings 27 is increased, the percentage of microwave energy which is reflected decreases. These figures further show that this effect is, to some extent, a function of the resistivity of the susceptor 20.

The impedance presented by a susceptor may, in addition to having a surface resistance component, also have a surface reactance component. Thus, the susceptor surface reactance may be a factor to consider in the design of a grid/susceptor system.

For a given grid geometry and grid/susceptor separation, susceptor surface reactance may be adjusted to predetermine susceptor power absorption, for example, to maximize, minimize or attain any other desired degree of absorption. As mentioned above, the susceptor surface impedance $Z_S$ may be expressed as $Z_S = R_S + iX_S$, where $R_S$ is the surface resistance and $X_S$ is the surface reactance, both with units of ohms per square. The surface reactance measured for susceptors before exposure to microwave energy in a microwave oven may be between about 0 to about −100 ohms per square, while after use in microwave cooking without grids the surface reactance may be in the range of about −100 to about −800 ohms per square. The surface reactance is typically a negative imaginary number. This is believed to arise from the capacitive nature of the breaks which typically occur in the metallization layer 21 of a susceptor 20.

FIGS. 41, 42 and 43 are graphs showing a theoretical relationship between power absorption and susceptor surface reactance for a series of grid/susceptor combinations having various hole 27 sizes and various surface resistivities.

The theoretical relationship is based upon the scattering matrix formulation for shunt elements and empty waveguide from J. L. Altman, *Microwave Circuits*, pp. 370–71 (1964), the entirety of which is incorporated herein by reference. Scattering transfer matrixes may be derived from these formulations, using techniques such as are taught by M. Sucher and J. Fox, *Handbook of Microwave Measurements*, Chap. 4 (1963), the entirety of which is incorporated herein by reference.

For each curve shown in these figures, the grid openings 27 were circular and were arranged in an equilateral triangular lattice. The minimum width of the strips 28 between adjacent openings 27 was about ⅛ inch, and the separation between the grid 19 and the susceptor 20 was about 0.0048 inch (0.0122 cm). In FIG. 41, the holes 27 had a diameter of about ¼ inch. In FIG. 42, the holes 27 had a diameter of about one inch. In FIG. 43, the holes 27 had a diameter of about ⅝ inch. The curves in FIGS. 41, 42 and 43 show that susceptor absorbance peaks at a value of susceptor surface reactance which is dependent on the hole 27 size of grid 19.

FIG. 44 is a graph calculated for a grid identical to that in FIG. 43. However, for this case, a separation between the grid 19 and the susceptor 20 of about 0.048 inch (0.122 cm) was used. Comparison of FIGS. 43 and 44 shows that the susceptor absorbance versus reactance curve depends on the separation between the grid 19 and the susceptor 20. Thus, for a given hole size and a given grid and susceptor separation, the impedance of a susceptor, including its surface reactance, may be adjusted to increase (or maximize), or decrease, the amount of microwave power absorbed by the grid/susceptor system. In other words, the susceptor may be tuned to what is perhaps a matched impedance, for maximum microwave power absorbance.

The effect of surface reactance on susceptor power absorption also depends on the geometry of the grid 19. FIG. 45 is a graph showing a theoretical relationship between power absorption and susceptor surface reactance for a series of grid/susceptor combinations having various surface resistivities. For each curve, the grid openings 27 were ⅝ inch squares arranged in an equilateral triangular lattice. The width of the strips 28 between adjacent openings 27 was about ⅛ inch, and the separation between the grid 19 and the susceptor 20 was about 0.0048 inch (0.0122 cm). Comparison of FIGS. 43 and 45 shows that the susceptor absorbance versus reactance curve depends on the geometry of the grid 19.

For a given susceptor surface resistance, the grid 19 geometry, hole 27 size, and the separation between the grid 19 and the susceptor 20 are believed to interact to some degree. Accordingly, they must be iteratively adjusted to optimize susceptor heating for each particular case.

An experiment was performed to examine the effect of susceptor reactance on the absorbance of the grid/susceptor combination. The experiment was performed in WR-340 waveguide using a network analyzer. Susceptor reactance was varied by making a series of cuts through the susceptor metallization layer with a razor blade. The cuts were parallel to the long dimension of the waveguide cross-section and extended entirely across the susceptor surface. Susceptor reactance was measured without the grid and increased with the number of cuts across the susceptor surface. The susceptor 20 had an initial surface resistance of about 15 ohms per square. The grid 19 used in this experiment had square openings 27 located on a square lattice. The minimum width of the strips 28 between adjacent openings 27 was about 3/16 inch and the separation between the grid 19 and the susceptor 20 was about 0.00048 inch (0.00122 cm). The curves in FIG. 46, FIG. 47 and FIG. 48 show the absorbance, transmittance, and reflectance, respectively, of the grid/susceptor combination and the susceptor 20 alone as the susceptor reactance (negative) was increased by successive addition of cuts to the susceptor metallization layer. FIG. 46 shows that the absorbance of this particular grid/susceptor combination was maximized when the surface reactance was about −50 to about −150 reactive ohms per square and that the absorbance change for the grid/susceptor combination was substantially larger than that observed for the susceptor alone. FIG. 47 and FIG. 48 show that as surface reactance was added to the susceptor, the grid/susceptor combination substantially retained low transmittance and high reflectance while the susceptor alone underwent major (and in many product contexts, deleterious) changes in transmittance and reflectance.

It is believed that the initial reactance of a susceptor film can be affected by the amount of stress or strain introduced during susceptor manufacture, for example, by adjusting the film web tension or through modifications in the film-to-substrate bonding process. The capacitive reactance of the susceptor may be adjusted by making small cuts in the surface of the susceptor.

The above discussion has primarily been directed to thin film susceptors which are resistive, as a preferred embodiment of the present invention. However, other lossy susceptor means 20 may be utilized. For example, graphite may be used. Another example of such a suitable susceptor means is a susceptor comprising magnetic microwave absorbing material. A suitable magnetic microwave absorbing material for use as the susceptor means 20 is disclosed in U.S. Pat. No. 4,266,108, issued May 5, 1981, to Anderson et al., entitled "Microwave Heating Device and Method", the entire disclosure of which is incorporated herein by reference.

Magnetic microwave absorbing materials include materials having ferromagnetic or ferrimagnetic properties, a Curie temperature and an ability to heat when exposed or subjected to microwave radiation. Such materials include magnetic oxide materials that are known as ferrites. These materials tend to heat in response to the magnetic component of the microwave energy field.

Magnetic microwave absorbing materials are characterized by their relative magnetic permeability $\mu'$, and their relative magnetic loss factor $\mu''$. In the above discussion of thin film susceptors, where resistivity was used as a factor for designing a desired heating response, magnetic permeability would be similarly utilized in the case of magnetic microwave absorbing materials.

FIG. 31 is a tricoordinate graph of experimental data measured with a network analyzer using a grid 19 in combination with a susceptor means 20 comprising a magnetic microwave absorbing material. The magnetic microwave absorbing material was removed from a Microware brand crisper/griddle Model PM 400/145, manufactured by Anchor Hocking Corporation. The material was believed to have a composition of $Ba_2Mg_2Fe_{12}O_{22}$ in a binder material. A grid 19 having rectangular openings in a square lattice configuration was utilized. The openings in each grid had a constant height of ½ inch (1.27 cm) for each grid. The width of the openings varied. Grids were used with openings having widths of 0.25 inch (0.63 cm), 0.5 inch (1.27 cm), 0.75 inch (1.9 cm), 1.0 inch (2.5 cm) and 1.25 inches (3.2 cm). Because of the polarization of the microwave energy in the waveguide, only the dimension of the width of the openings in each grid was important for this experiment.

For each grid having a particular size opening, two measurements were made. One measurement was made looking through port 1 of the network analyzer. Another measurement was made looking through port 2 of the network analyzer. (See FIG. 31A.) Thus, the points plotted on the graph of FIG. 31 labeled as points "1", "3", "5", "7" and "9" represent measurements taken through port 1. The points plotted on FIG. 31 and labeled "2", "4", "6", "8" and "10" represent measurements taken through port 2 of the network analyzer. The points plotted on FIG. 31 which are labeled "11" and "12" represent measurements taken without any grid, through ports 1 and 2, respectively. Points "1" and "2" represent measurements for a grid having a width of 0.25 inch (0.63 cm). Points "3" and "4" correspond to a grid having a width of 0.5 inch (1.27 cm), and so on.

From FIG. 31, it can be seen that a susceptor means 20 using magnetic microwave absorbing material can be used to vary the percentage of power transmitted versus the percentage of power reflected, within limits, while the percentage of power absorbed remains relatively constant. This effect is most apparent for grids having openings larger than 0.75 inch (1.9 cm).

Combinations of susceptor means 20 may also be utilized. For example, a thin film susceptor using resistive heating may be combined with a susceptor using magnetic microwave absorbing material. Also, a single susceptor means 20 may be used employing both resistive heating and magnetic microwave absorption in the same material. A composite susceptor means 20 may be used having a plurality of layers of either resistive heating material or magnetic microwave absorbing material.

Another heating mechanism which may be utilized for a susceptor means in combination with a grid is an inedible dielectric heater package element. Lossy dielectric heating package materials heat in response to the electric component of the microwave energy. Such dielectric materials are characterized by a relative dielectric constant E' and a relative dielectric loss factor E''.

The susceptor means 20 may be a planar package element which heats responsive to microwave radiation. In general, the susceptor means 20 may be a lossy microwave energy absorber which is heated when exposed to microwave radiation.

The susceptor means 20 may also be characterized according to the penetration depth of the susceptor. Penetration depth is the distance over which the microwave power density diminishes to about 36.8% of its original value. For purposes of this disclosure, penetration depth for the susceptor means 20 is calculated based upon the following:

$$P = P_0 e^{-2xRe[\gamma]}$$

where P is the power density at a distance "x" within the susceptor material, and $P_0$ is the initial power density of the microwave field. $\gamma$ is the propagation constant for the susceptor material. Using Maxwell's equations for plane waves, the real portion of the propagation constant may be determined, for purposes of this invention, based upon the following:

$$Re[\gamma] = Re\left[\frac{2\pi i}{\lambda_0}\sqrt{(E' - iE'')(\mu' - i\mu'')}\right]$$

The values for E', E'', $\mu'$ and $\mu''$ may be measured for a particular susceptor material. $\lambda_0$ is the free space wavelength at the microwave oven operating frequency. At the oven operating frequency of 2.45 GHz used throughout the United States and elsewhere, $\lambda_0$ is about 12.24 cm. The power penetration depth maya then be calculated, based on the following relationship:

$$d = \frac{1}{2Re[\gamma]}$$

where d is the power penetration depth, and Re[$\gamma$] is the real part of the propagation constant for the susceptor material. The susceptor means 20 preferably has a penetration depth less than 1.3 inches. An even more preferred penetration depth for the susceptor means 20 is a penetration less than or equal to 0.65 inch. An even more preferred penetration depth for the susceptor means 20 is a penetration depth less than or equal to 0.001 inch.

The susceptor means 20 preferably has a low thermal mass. A preferred susceptor means should be operative to heat quickly when exposed to microwave radiation. A susceptor means having a large thermal mass could require too long for heating. If a susceptor means having a large thermal mass resulted in a long heating time for a food item, much of the convenience associated with microwave cooking would be lost.

The susceptor means 20 preferably is inexpensive and disposable. It is undesirable for the susceptor means to cost more than the cost of the food item which is being heated. A preferred susceptor means 20, when combined with the grid 19 and other package components, should not cost more than the cost of the food item 18. If the entire package, including the grid/susceptor combination, represents a significant portion of the total cost of the packaged food item, the susceptor means will be impractical for most packaged food applications. This consideration eliminates most ceramic materials and utensils as desirable susceptor means 20, for most packaged food applications. In such applications, the packaging is not intended for continuous reuse. Moreover, the packaging should not require a separate preheating step.

In this invention, the susceptor means heats to a temperature of about 150° F. (65.5° C.) during microwave heating of the food. The susceptor means preferably heats to a temperature of at least about 212° F. (100° C.). A more preferred temperature range for the susceptor means is 300° F. (149° C.) or greater. An especially preferred temperature range for the susceptor means is 350° F. (177° C.) or greater.

A thin film susceptor having a surface resistivity between about 1 ohm per square and about 10,000 ohms per square is preferred. A surface resistivity between about 5 ohms per square and about 5000 ohms per square is more preferred. A surface resistivity for the susceptor between about 30 ohms per square and about 800 ohms per square is even more preferred. A surface resistivity between about 50 ohms per square and about 70 ohms per square is especially preferred.

The grid 19 defines a relatively reflective first region, which essentially forms a lattice structure surrounding a plurality of second regions defined by the openings 27 having susceptor material 20 exposed to microwave radiation. The susceptor material 20 of the second regions preferably has a microwave power transmittance, when the susceptor material 20 is measured alone, which is greater than 0.003 percent. The susceptor material more preferably has a microwave power transmittance greater than 0.07 percent. Even more preferably, the susceptor material 20 has a microwave power transmittance greater than 1.9 percent.

Hole Geometry

The geometry of the grid 19 may also be adjusted to change the performance of the package. For example, circular openings 27 may be utilized. Alternatively, square openings 27 may be utilized. Also, circular openings 27 may be arranged in an equilateral triangular lattice, as shown in FIG. 38B. Circular openings may alternatively be arranged in a square lattice, as shown in FIG. 38A. Square openings 27 may be arranged in an equilateral triangular lattice, as shown in FIG. 38D. Also, square openings 27 may be arranged in a square lattice, as shown in FIG. 38C. These four alternatives are used as the basis for the curves plotted in FIG. 11. The curves were plotted using values calculated by the Chen model. These geometries are described in the Chen article, mentioned above, which is incorporated by reference.

Figure 11:
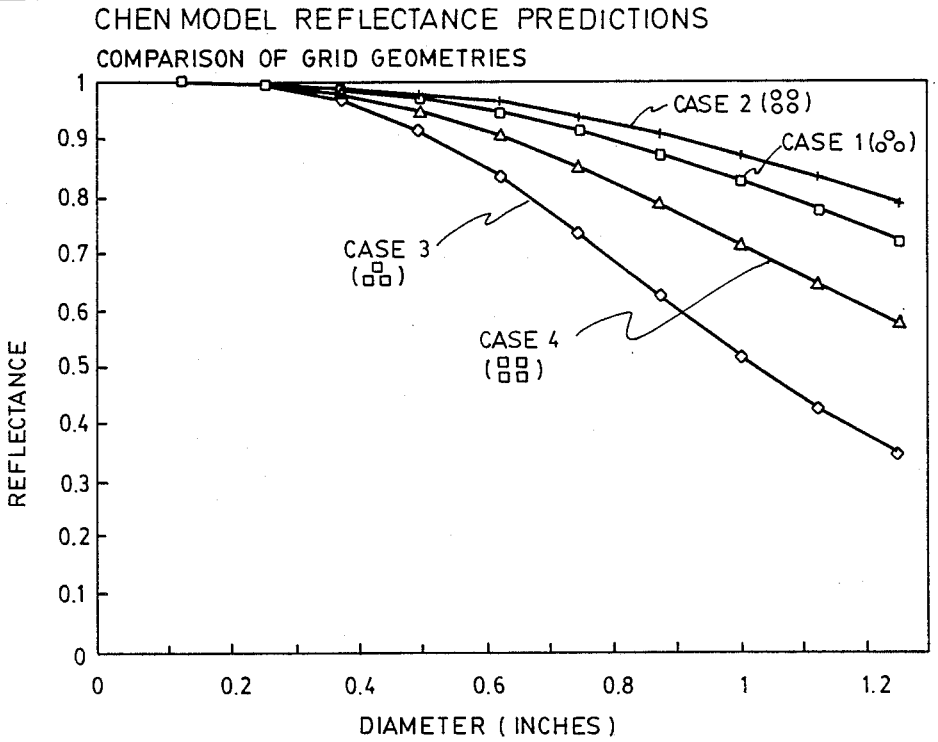
FIG. 11 is a graph plotting reflectance as a function of hole size for various grid geometries based upon a mathematical model.

FIG. 11 is a graph depicting the percentage of reflectance for these four different grid geometries, as a function of the diameter of the openings 27. In the case of square openings 27, the "diameter" is the length of the sides of the square opening 27.

FIG. 11 shows that a square lattice geometry is generally more reflective than a triangular lattice geometry, all other things being equal. For circular openings having a diameter equal to the height and width of a square opening, the grid with such circular openings will generally be more reflective than a grid with such square openings, all other things being equal. This can only be partially explained by the difference in percentage open area between such grids. It should be appreciated that each geometry will have its own impedance. The variation in reflectance, and impedance, is more than simply a function of percentage open area. A similar conclusion is apparent for equilateral triangular lattice grids having square openings and having circular openings.

In FIG. 11, case 1 represents circular openings with an equilateral triangular lattice. Case 2 represents circular openings with a square lattice. Case 3 represents square openings with an equilateral triangular lattice. Case 4 represents square openings with a square lattice. FIG. 11 represents calculations for a grid 19 considered alone, without an associated susceptor means 20.

Table I represents a comparison of Chen model calculations for various grid geometries using an opening size of 0.5 inch (1.27 cm), and 0.1 inch (0.25 cm) spacing, (i.e., the width of the strips 28 equals 0.1 inch (0.25 cm)). Table I compares data measured using a network analyzer with the calculations produced by the Chen model. Table II represents measurements made with a network analyzer using a grid 19 and susceptor 20 in combination. The susceptor 20 used in this example had a resistivity of about 125 ohms per square. The term "stagger lattice" is used in the tables as a shorthand expression for referring to a equilateral triangular lattice.

COMPARISON OF CHEN MODEL GRID GEOMETRIES 0.5" (1.27 cm) HOLE SIZE, 0.1" (0.25 cm) SPACING NETWORK ANALYZER DATA AVERAGE OF TWO PORTS

TABLE I

| | GRID ALONE | | | |
|---|---|---|---|---|
| | Hole Type | Lattice Alignment | Measured Reflection | Predicted Reflection |
| Case 1 | Circle | Stagger Lattice | 0.958 | 0.973 |
| Case 2 | Circle | Square Lattice | 0.973 | 0.981 |
| Case 3 | Square | Stagger Lattice | 0.902 | 0.917 |
| Case 4 | Square | Square Lattice | 0.911 | 0.951 |

TABLE II

| | GRID AND SUSCEPTOR | | | | |
|---|---|---|---|---|---|
| | Hole Type | Lattice Alignment | Reflection | Absorption | Transmission |
| Case 1 | Circle | Stagger Lattice | 0.779 | 0.187 | 0.034 |
| Case 2 | Circle | Square Lattice | 0.847 | 0.130 | 0.024 |
| Case 3 | Square | Stagger Lattice | 0.696 | 0.249 | 0.056 |
| Case 4 | Square | Square Lattice | 0.715 | 0.229 | 0.057 |

Referring to FIG. 38A, the circular openings 27 have a diameter "D" and a spacing between openings of "W". For circular openings 27, the width of the strips 28, and the spacing between openings 27, is considered to be the minimum distance between openings 27, shown as the distance "W" in FIG. 38A. The openings 27 have a center-to-center spacing, shown in FIG. 38A as "X".

The circular openings 27 in an equilateral triangular lattice have a diameter or hole size "D", and a center-to-center separation of "X". In the equilateral triangular lattice, the holes 27 have a center-to-center offset, shown as "Y" in FIG. 38B. The separation between openings 27 is shown as "W" In FIG. 38B.

FIG. 38C shows square openings 27 arranged in a square lattice. The openings 27 may also be rectangular in shape, having a height and a width which are not equal. The geometry shown in FIG. 38C corresponds with the grid geometry shown in FIG. 3A.

FIG. 38D shows a grid 19 having square openings 27 arranged in an equilateral triangular lattice configuration. The openings 27 have a size "D", shown in FIG. 38D. In the triangular lattice, the openings 27 have a center-to-center offset shown as "Y" in FIG. 38D. The openings 27 shown in FIG. 38D may also be rectangular in shape.

The square openings 27 shown in FIG. 38D have an edge-to-edge offset, identified as "Z".

Grid-Susceptor Separation

The adjustment of spacing between a grid 19 and a susceptor 20 may be varied. The adjustment of grid-susceptor spacing is a useful technique for varying the percentage of power absorbed and the percentage of power reflected by the grid/susceptor combination, within limits, while the percentage of power transmitted remains relatively constant. Grid-susceptor spacing can be better understood by referring to FIG. 30A.

Figure 30A:
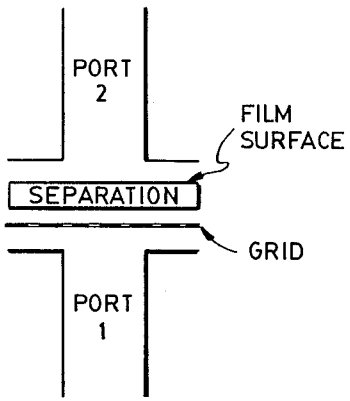
FIG. 30A is a graph showing an enlarged portion of a tricoordinate graph illustrating measurements taken with a network analyzer for a grid in combination with a susceptor using various distances of separation between the grid and the susceptor.
Figure 30A:
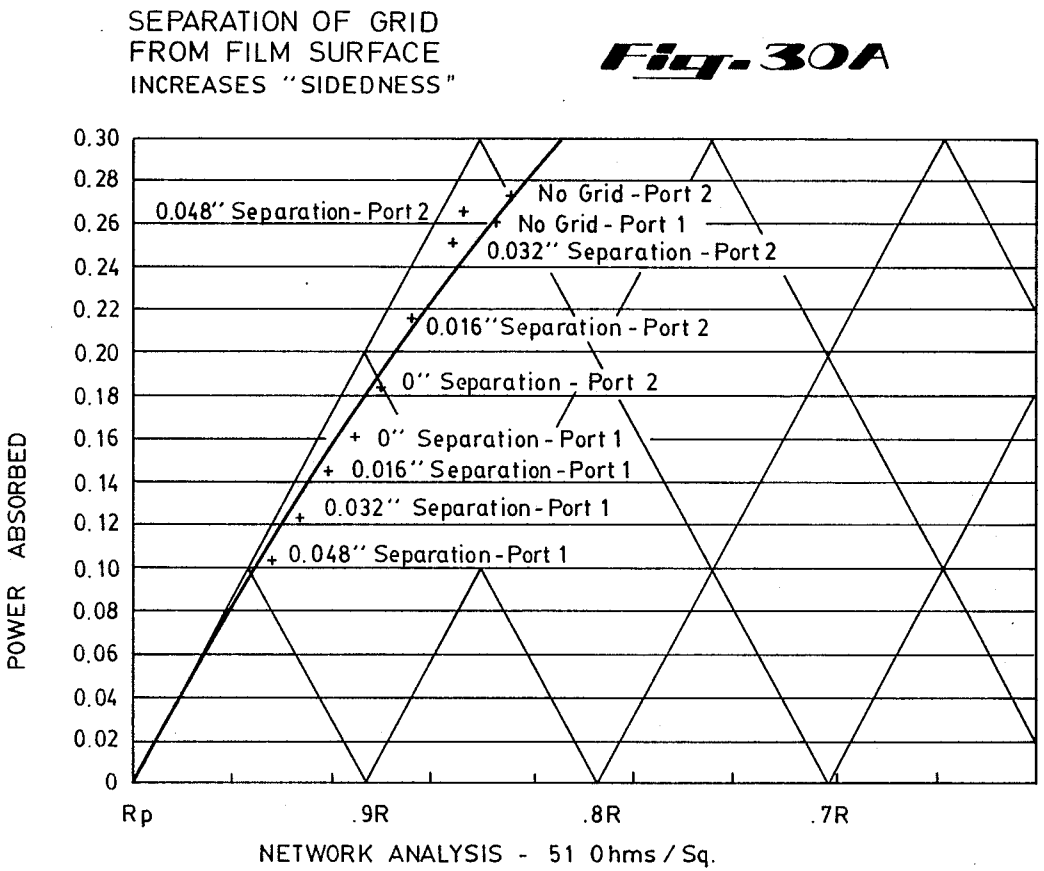

FIG. 30A is a graph in the form of a tricoordinate plot. To better understand FIG. 30A, it should be appreciated that the graph of FIG. 30A represents an enlarged view of the extreme lower left-hand corner of a tricoordinate plot, such as is shown in FIG. 5.

The measurements shown on FIG. 30A were made with a network analyzer. The plotted points show measurements alternatively through port 1, and port 2 of the network analyzer. (See FIG. 30AA.) Two points are plotted for each experiment. Each experiment used a different separation between the grid 19 and the susceptor 20. (One pair of points is plotted for an example utilizing a susceptor alone, with no grid.) The susceptor 20 used in these experiments had a surface resistivity of 50 ohms per square. Measurements were made without subjecting the susceptor 20 to microwave heating. The grid 19 utilized in these experiments had ½ inch (1.27 cm) squares arranged in a square lattice configuration. The separation between the holes was about ⅛ inch.

As the separation between the grid 19 and the susceptor 20 was increased, the distance between the points measured through port 1 and port 2 of the network analyzer increased. For example, with a separation between the grid and susceptor of 0.032 inch (0.08 cm), the measurement through port 1 resulted in a measurement of the following parameters: absorption about 12%; reflectance about 86%; and, transmission about 2%. For the same separation, the following parameters were measured looking through port 2: absorption about 25%; reflectance about 73%; and, transmission about 2%.

By adjusting the distance between the grid 19 and the susceptor 20, the relative percentage of power absorbed and the relative percentage of power reflected may be adjusted. The percentage of power transmitted remains relatively constant.

From FIG. 30A, it can also be seen that as the grid 19 and the susceptor 20 are moved further and further apart, the grid/susceptor combination, when viewed from the grid side, performs more and more like a grid alone. The grid/susceptor combination, when viewed from the susceptor side, performs more and more like the absorbance of a susceptor alone, however, without the transmission of microwave energy which would be characteristic of a susceptor alone.

The percentage of power transmitted may be varied by adjusting the hole size in the grid 19. For example, if the hole size of the grid 19 were made larger, the family of points plotted in FIG. 30A would then plot in an area of the tricoordinate graph more to the right, and upwardly, when viewed from the orientation of FIG. 30A.

Figure 30B:
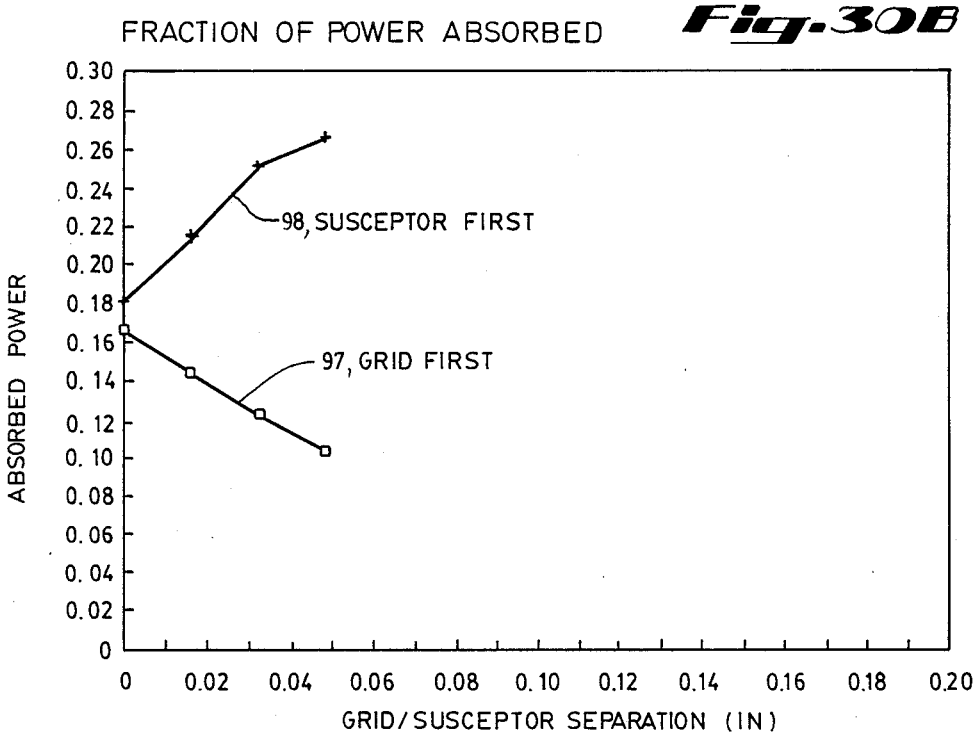
FIG. 30B is a graph showing power absorbed versus grid/susceptor separation.

FIG. 30B is a graph representing the same data which is shown in FIG. 30A. The vertical axis represents percentage power absorbed, and the horizontal axis represents the separation distance between the grid and susceptor. The lower line, identified with reference numeral 97 in FIG. 30B, represents the measurements taken through port 1. The graph line, identified with reference numeral 98 in FIG. 30B, represents the data points taken through port 2.

Figure 30C:
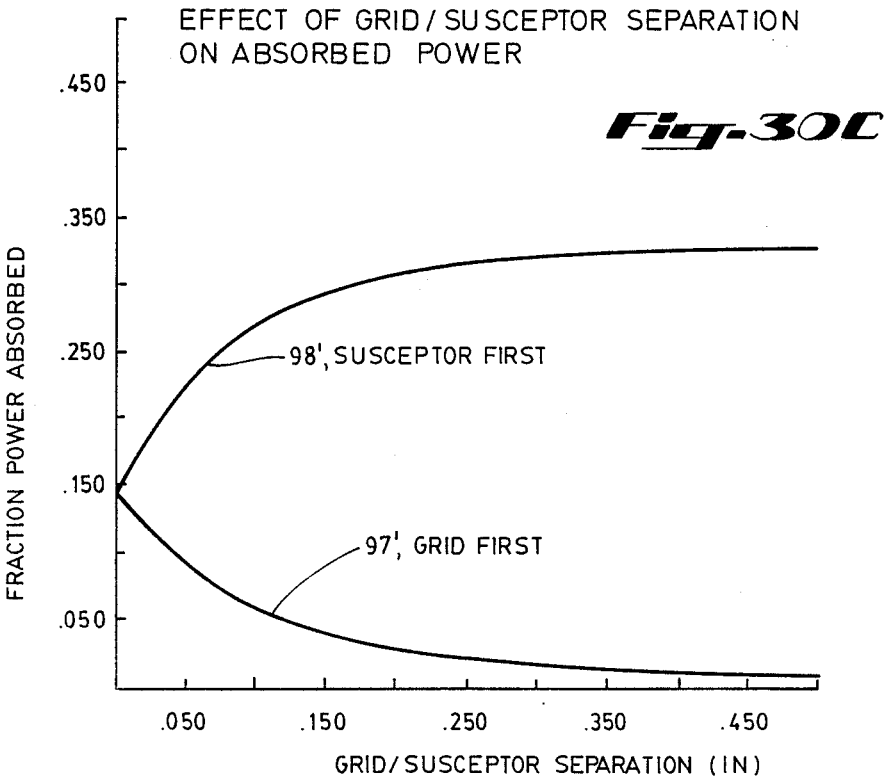
FIG. 30C is a graph showing calculated values for power absorbed versus grid/susceptor separation.

FIG. 30C is a graph, similar to FIG. 30B, showing percentage absorbed power versus the separation between the grid and susceptor, expressed in inches. The line indicated by reference numeral 98' represents the percentage power absorbed when viewed from the susceptor side. The line indicated in the graph by the reference numeral 97' represents the percentage power absorbed when viewed from the grid side.

The graph of FIG. 30C was calculated mathematically. The graph of FIG. 30C shows the trend of what happens as the grid and susceptor are separated by distances up to 0.5 inch.

The mathematical model used to plot the graph of FIG. 30C was developed by taking the scattering matrix formulation for shunt elements and empty waveguide from J. L. Altman, *Microwave Circuits*, pp. 370–71 (1964). Scattering transfer matrixes may be derived from these formulations, using techniques such as are taught by M. Sucher and J. Fox, *Handbook of Microwave Measurements*, Chap. 4 (1963).

The percentage power reflected and the percentage power transmitted from the combination of a grid a susceptor may be computed for a variety of distances separating the grid and susceptor. The percentage power absorbed may be assumed to be one minus the sum of the power reflected and the power transmitted for each distance of separation. The results computed in this manner were used to generate the graph of FIG. 30C.

The use of separation between a grid 19 and a susceptor 20 can be more easily analyzed, and may be more effective, when used in combination with a shielded package, or "closed" system. That is, if the microwave energy impinges upon the grid/susceptor combination and food from only one direction, the separation between the grid 19 and the susceptor 20 may be more easily utilized as a factor for controlling the heating of the food 18.

A separation between the grid and susceptor less than 0.5 inch is preferred. A separation between the grid and susceptor less than about 0.048 inch is more preferred. A separation between the grid and susceptor less than about 0.016 inch is even more preferred.

Interrelationship Between Hole Size, Hole Geometry, Resistivity and Spacing

The interrelationship between hole size, resistivity, spacing, and hole geometry may be effectively analyzed using at least two approaches. First, an empirical technique is described below. Second, an equivalent circuit model is developed and described.

By selecting a given hole geometry and grid-susceptor spacing, the effect of variations in resistivity and variations in the hole size in the grid may be effectively analyzed by empirically observing the heating characteristics of the system. Contour plots may be effectively utilized to assist in visualizing the response of the system.

Figure 12:
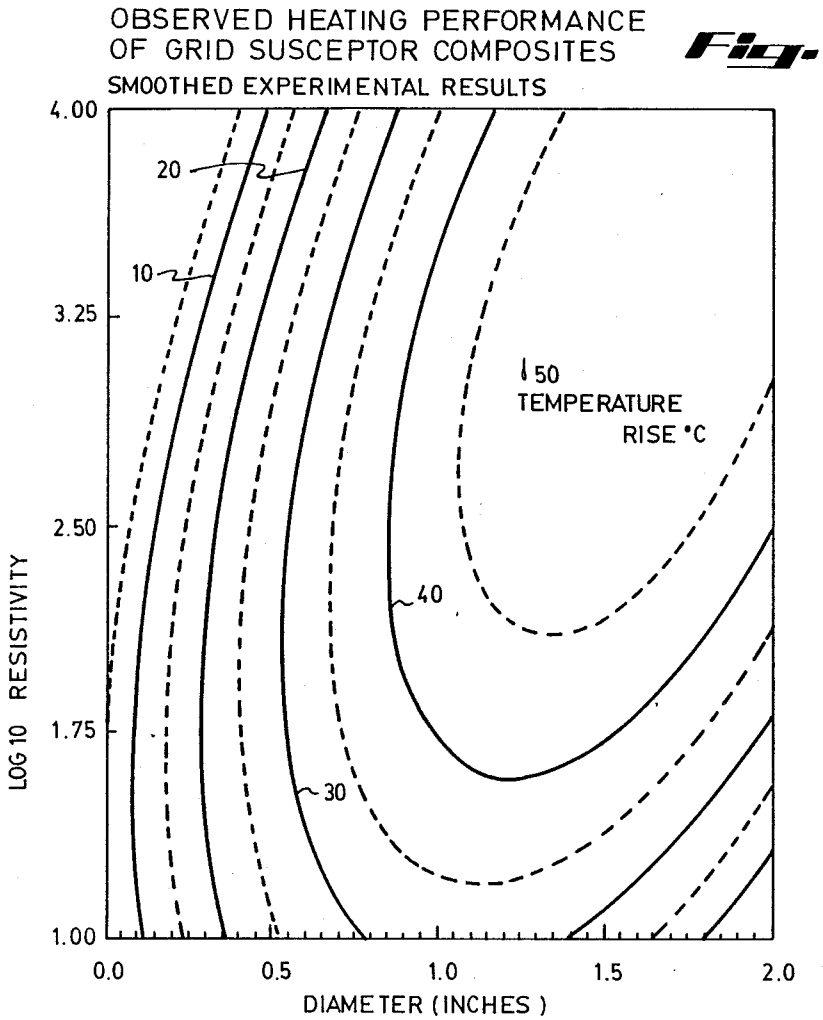
FIG. 12 is a graph depicting a contour plot of resistivity versus hole diameter showing observed heating performance for grid and susceptor combinations.

FIG. 12 is a graph depicting a contour plot. The horizontal axis of the graph represents the diameter of the openings 27 in the grid 19. In the particular example shown, the openings 27 are circular openings arranged in an equilateral triangular lattice. The vertical axis represents the $\log_{10}$ of the surface resistivity of the susceptor 20. Each contour line shows a given absorption value.

Using the contour plot of FIG. 12, for a given size of opening 27 in the grid 19, the resistivity value of the susceptor 20 may be optimized, for example, for maximum absorption. Alternatively, a resistivity for the susceptor 20 may be selected which provides less than maximum absorption where it is desirable to reduce the rate of heating of the composite package. Of course, the reverse approach may also be utilized. For a susceptor 20 having a given resistivity, the diameter of the openings 27 in the grid 19 may be selected to achieve the desired rate of heating.

A contour plot may also be produced for other grid geometries. The contour plot of FIG. 12 was produced experimentally by constructing a series of grids having various sizes of openings. One-eighth inch (0.3175 cm) increments in hole sizes was utilized to produce the contour plot of FIG. 12. For each grid 19 having openings 27 of a particular size, various susceptors 20 having different surface resistivities are utilized. For each grid 19 and susceptor 20 combination, the grid/susceptor combination is placed in a microwave oven and exposed to microwave radiation. An infrared camera aimed at the back of the susceptor 20 is used to measure the relative amount of heating of the susceptor/grid combination. In a preferred testing method, low power microwave radiation is utilized. An infrared camera measurement is made after a short initial heating period, for example, 10 seconds after microwave heating has been initiated during the microwave heating cycle. After the measurement is made, microwave heating may then be discontinued. Using the infrared camera temperature image analysis function, the temperature of the back surface of the grid/susceptor combination was averaged. Preferably, two identical measurements are taken and then averaged to produce a single data point. The data from these measurements were smoothed using a full quadradic model. The quadradic model was then used to plot the contour plot. In the illustrated example, the plot was made using a SAS Gcontour program produced by SAS Institute, Inc., of Cary, N.C. Other contour plot programs could also be utilized. The R squared value for the fit of the data to the model was 0.91. In the illustrated example, log base ten of the susceptor surface resistivity is utilized for the vertical axis of the contour plot. Data points representing the same final average temperature were then connected and plotted as isotherms.

An equivalent circuit model can be helpful in understanding the interrelationship between hole size and resistivity of the susceptor means. The development of an equivalent circuit model may best be understood by first considering FIG. 32.

FIG. 32 illustrates a single hole 27 in a grid 19. For purposes of developing this equivalent circuit model, only a single hole 27 will be considered. However, it should be understood that the grid 19 contains a plurality of openings 27. A susceptor means 20 is also included in the circuit model. In the illustrated example, the susceptor means 20 is coplanar with the grid 19. In the view shown in FIG. 32, a susceptor material 20 is located so that it is visible through the opening 27. In the illustrated example, the grid and susceptor combination is shown illustrated by a view taken from the grid side.

FIG. 32 depicts arrows 86 which are representative of currents which are believed to flow in the conductive grid 19 responsive to the effects of microwave radiation which impinges upon the grid/susceptor combination. For purposes of this circuit model, the currents represented by arrows 86 may be assumed to exist. However, the existence of such currents has been substantiated to some extent by experiments with slots which indicate resistive heating at locations corresponding to such current paths.

Voltage antinodes are believed to occur at about a mid-point 87 in the sides of the opening 27. In a circular opening 27, the voltage antinodes 87 would occur at opposite points around the circumference of the circular opening.

The direction of the currents 86 and the polarity of the voltages 87 illustrated in FIG. 32 represent instantaneous currents and voltages. After having the benefit of the teachings of this disclosure, it will now be appreciated by those skilled in the art that the currents 86 and voltages 87 rapidly alternate in a sinusoidal fashion responsive to the microwave radiation, and vary at the same frequency as the microwave radiation.

The circuit model developed below also includes a current 88 which flows in the susceptor 20 in response to the microwave radiation. This current is indicated generally by the arrow illustrated in FIG. 32, referred to with reference numeral 88. The illustrated direction of the current 88 is also a representation of an instantaneous current which will vary at the same frequency as the microwave radiation. The presence of the current 88 has been based in part upon experimental observations of the location of heating effects on a susceptor in combination with a grid or opening.

For purposes of the circuit model shown in FIG. 32, the current 86 is treated as a current induced due to inductance. The voltage 87 is treated as a charge which is capacitively stored. The current 88 is treated as a current through a resistive element.

This circuit may be expressed as an equivalent circuit model which is illustrated in FIG. 33.

FIG. 33 shows a source of electromotive force ("EMF"), illustrated as an equivalent source represented by a Norton constant current generator 89. In the case of a microwave oven, the EMF source 89 is typically the magnetron of the oven. The grid/susceptor combination may be characterized as having a capacitance "C" 90, an inductance "L" 91, and a resistance "R" 92. In the circuit model illustrated in FIG. 33, these are represented by lumped elements comprising capacitor 90, inductor 91 and resistor 92 connected in parallel.

The equivalent circuit model in FIG. 33 also includes a characteristic generator impedance $Z_c$, identified with reference numeral 94, associated with the source of EMF 89, and a downstream line impedance $Z_0$, identified with reference numeral 93. In this example, the grid/susceptor combination is assumed to be in free space. Thus, $Z_c$ and $Z_0$ are equal to the characteristic impedance of free space. In a microwave oven, these impedance values will change depending upon the oven design, and the placement of food in the oven.

The equivalent circuit shown in FIG. 33 is greatly simplified. Lumped elements of capacitance 90 and inductance 91 are used in developing this circuit model. A more accurate representation of a grid/susceptor combination might include distributed capacitance and distributed inductance, especially in view of the plurality of openings which are included in a typical grid. However, as will be seen more fully below, the simplified equivalent circuit illustrated in FIG. 33 has provided sufficiently accurate predictions to be useful in connection with the present invention.

In developing the equivalent circuit analysis set forth below, the opening 27 is assumed to be an inductor having an inductance given by the equation:

$$L = \frac{\mu_0 n^2 A}{l}$$

where $\mu_0$ is the permeability of free space, equal to $4\pi \times 10^{-7}$ webers per ampere-meter; n is the number of turns in the inductor, which is here assumed to be one turn; A is the area within the turns of the inductor, which is here assumed to be $\pi r^2$ for a circular opening 27; and e is the length of the electrical conductor defining the inductor, which is here assumed to be $\pi D$ for a circular opening 27. Of course, for the present example assuming a circular opening, "D" is the diameter of the circle and "r" is the radius of the circle.

In development of the circuit model, the resistance "R" 92 shown in FIG. 33 is assumed to be equal to the surface resistivity of the susceptor 20. For example, the resistance "R" 92 is assumed to have a value of 70 ohms where the susceptor 20 has a resistivity of 70 ohms per square.

Empirical measurements have shown that an opening 27 having a diameter of 2 inches (5.1 cm) is resonant in a microwave oven. In developing the equivalent circuit analysis set forth below, the natural frequency of the RLC circuit represented by the capacitor 90, inductor 91 and resistor 92, having a 2 inch (5.1 cm) diameter hole, was assumed to be $2.45 \times 10^9$ Hz.

Thus, the parallel admittances represented by the lumped capacitive, inductive and resistive elements, 90, 91 and 92, respectively, can be added. The admittance of the reactive components represented by the capacitor 90 and the inductor 91 are frequency dependent. Thus, the admittance of the parallel circuit represented by the capacitor 90, inductor 91 and resistor 92 can be expressed as:

$$Y = \frac{1}{R} + j\omega C + \frac{1}{j\omega L}$$

where $\omega$ represents the frequency of the microwave radiation.

The admittance represented by the line impedance $Z_L$ 93 and the generator impedance $Z_G$ 94 may also be added as follows:

$$Y = j\frac{1}{Z_G} + \frac{1}{R} + j\omega C - j\frac{1}{\omega L} + j\frac{1}{Z_L}$$

At resonance, the reactive admittance due to the capacitor 90 will cancel the reactive admittance due to the inductor 91. Therefore, at resonance, the admittance may be expressed as:

$$Y = j\frac{1}{Z_L} + \frac{1}{R} + j\frac{1}{Z_L}$$

Thus, admittance at resonance maya be alternatively expressed as $1/Z_T$, where $Z_T$ is the total impedance of the circuit at resonance.

A quality factor "Q" for a parallel circuit may be expressed as:

$$Q_p = \frac{\omega_0 L}{Z_T} = \frac{1}{\omega_0 C Z_T}$$

assuming a condition of resonance.

An admittance ratio, expressed as the ratio of the admittance at the natural frequency of the equivalent circuit as compared to the admittance at some other frequency, may be expressed as:

$$\frac{Y_0}{Y_\omega} = \frac{1}{1 + jQ\left(\frac{\omega}{\omega_0} - \frac{\omega_0}{\omega}\right)}$$

where $\omega_0$ is the natural frequency of the equivalent circuit, and $\omega$ is the frequency for which the admittance $Y_\omega$ is to be determined.

In order to rearrange this analysis to consider the effect of changing the size of the hole 27 in the grid 19, rather than expressing the frequency $\omega$ as the variable, the natural frequency $\omega_0$ can be assumed to be a variable which is a function of hole size. In the case of a microwave oven application, the frequency $\omega$ does not vary, but is the frequency of the microwave oven, i.e., 2.45 GHz. In order to do so, it can be assumed that the ratio of the natural frequency as a function of hole size may be expressed as:

$$\omega_0 = \frac{2\text{ in.}}{D} \times 2.45 \times 10^9 \text{ Hz}$$

where D is the diameter of the opening 27, expressed in inches, and $\omega_0$ is the natural frequency for that opening 27 having a diameter of D. This expression of the natural frequency as a function of the size of the opening may then be substituted into the above equation.

The impedance ratio is a reciprocal of the admittance ratio. From the above, an expression for the impedance $Z_\omega$ at a given frequency $\omega$ may be expressed as:

$$Z_\omega = \left[1 + \left(Q\left(\frac{\omega}{\omega_0}\right) - \left(\frac{\omega_0}{\omega}\right)\right)^2\right]^{-0.5} Z_T$$

Referring again to FIG. 33, the voltage between points "A" and "B" may be expressed as follows:

$$V_{AB} = I_G Z_\omega$$

where $V_{AB}$ is the voltage between points "A" and "B", and $I_G$ is the current of the EMF source 89. It is desirable to now solve for the current through the resistor "R", identified with reference numeral 92 in FIG. 33. The current $I_R$ through the resistor R may be expressed as:

$$I_R = \frac{V_{AB}}{R} = \frac{I_G Z_\omega}{R}$$

The power dissipated in the resistor "R" 92 may be expressed as the square of the current through the resistor multiplied times the resistor, which may be represented as:

$$P_s = I_S^2 R$$

$$P_s = \left(\frac{I_G Z_\omega}{R}\right)^2 R$$

$$P_s = \frac{I_G^2 Z_\omega^2}{R}$$

For present purposes, the relative response of the circuit model is of primary interest. A unit value for the input current $I_G$ is assumed. Thus, $P_s$ will be proportional to the following relationship:

$$\frac{Z_\omega^2}{R}$$

The expression for $Z_\omega$ may be substituted with the above expression. The power dissipated in the susceptor $P_s$ may be expressed as being proportional to the following expression:

$$\frac{\left[1 + \left(Q\left(\frac{\omega}{\omega_0}\right) - \left(\frac{\omega_0}{\omega}\right)\right)^2\right]^{-0.5} Z_T}{R}$$

The above discussion was developed for a circuit model based upon a single opening. To approximate the effect of an array of openings, the power dissipated in the susceptor $P_s$ is weighted by the fraction open area. The relative power $P_R$ absorbed by the grid/susceptor combination is then:

$$P_R = P_s F_O$$

where $F_O$ is the fraction open area for the grid. For a grid having circular openings 27 with a radius r, and a width of spacing 28 between holes, or margin, of m, the fraction open area $F_O$ is:

$$F_O = \frac{\pi r^2}{(2r + m)^2}$$

Figure 34:
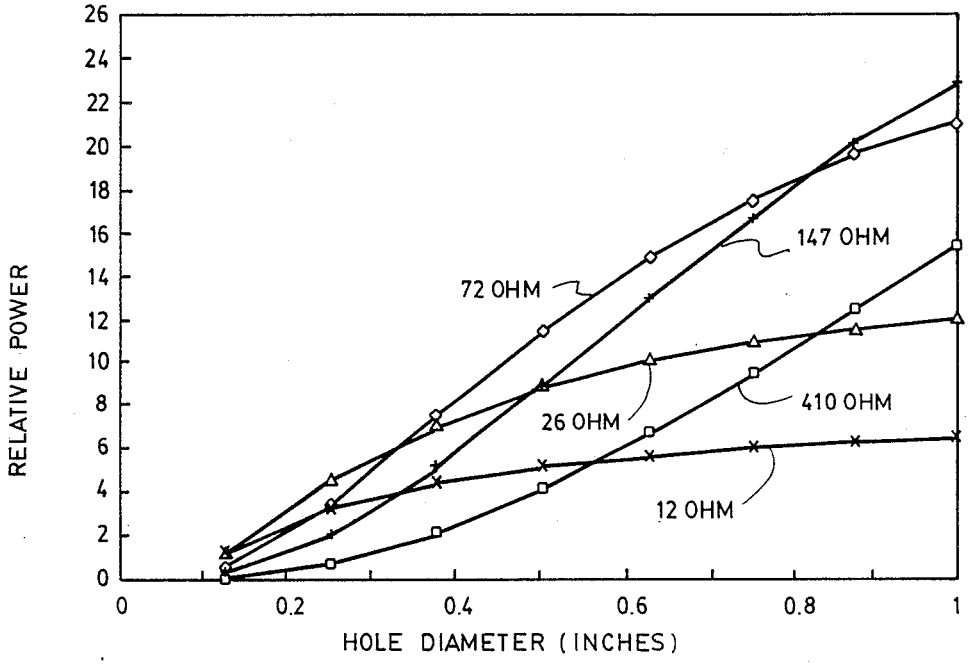
FIG. 34 is a graph depicting relative percentage of absorbed power as a function of hole diameter for various values of susceptor resistivity, which are calculated based upon an equivalent circuit model.

The above mathematical model based upon this equivalent circuit analysis was used to produced the graph depicted in FIG. 34. The graph shown in FIG. 34 shows relative power absorbed in the susceptor on the vertical axis, expressed as a percentage, versus hole diameter on the horizontal axis. Various curves are plotted for susceptors having resistivities of 12, 26, 72, 147, and 410 ohms per square. This mathematical model, based upon the above equivalent circuit analysis, may be compared with the results obtained empirically using measurements taken with a network analyzer, which are depicted in the graph of FIG. 8. The same trends as a function of hole diameter and variations in resistivity can be seen in both graphs shown in FIG. 34 and FIG. 8.

Figure 35:
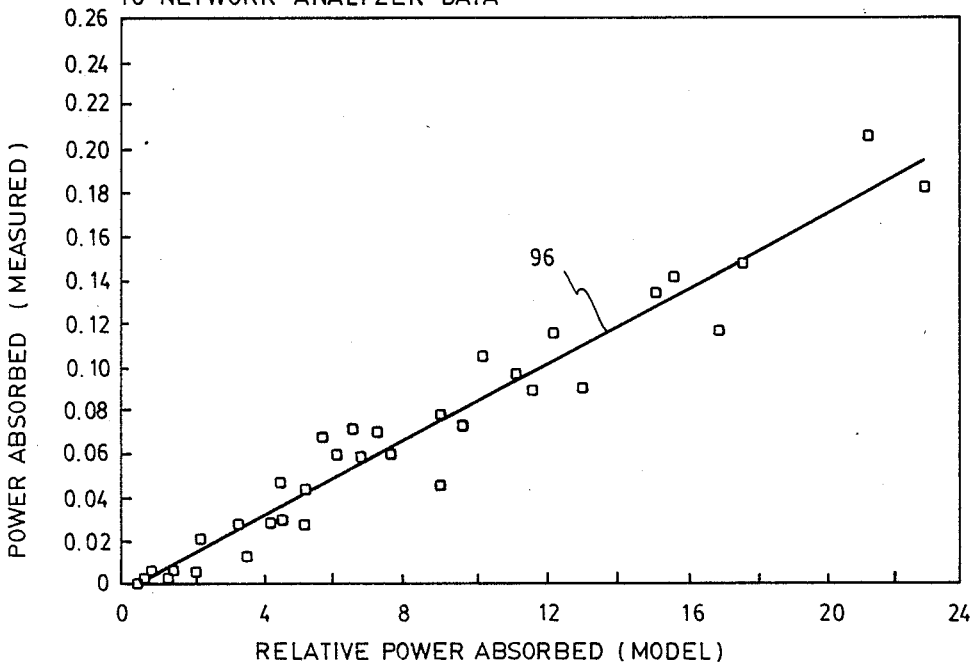
FIG. 35 is a graph comparing measured absorption values from FIG. 8 with calculated absorption values from FIG. 34.

The empirical results obtained, and plotted in the graph of FIG. 8, may be compared with the results obtained using the mathematical model, and shown in the graph of FIG. 34. A comparison of the relative power absorbed, (represented by the vertical axis in the graphs in FIGS. 8 and 34), are shown in the graph of FIG. 35. The relative power calculated, and shown in FIG. 34, is plotted on the horizontal axis of FIG. 35. The relative power absorbed, which was measured and shown by the vertical axis in FIG. 8, is plotted on the vertical axis of FIG. 35. If the mathematical model perfectly predicted the measured absorbance, all data points would fall upon a line 96 shown on FIG. 35 at a 45° angle on the graph. Line 96 represents the set of points having equal relative power absorbed.

The points shown in FIG. 35 represent a close agreement between the empirical measurements shown in FIG. 8 and the predicted values calculated with the mathematical model which are graphed in FIG. 34. Statistically, the agreement between the set of data points plotted in FIG. 35 has a linear regression correlation coefficient of 0.95.

Turning to FIG. 9, the measurements represented in that graph may be compared with the values predicted by the mathematical model, which are represented in the graph of FIG. 34. The same trends of power absorbed by the susceptor means, (which results in heating of the susceptor means), may be observed for various hole sizes and susceptor resistivity values.

FIG. 36 shows a graph of relative power absorption, represented by the vertical axis, versus hole size, represented by the horizontal axis. Various susceptor resistivities were utilized to produce the curve shown in FIG. 36. Each curve represents a different surface resistivity "R" used in the circuit model. Resistivities of 12, 26, 72, 147 and 410 ohms per square were used. FIG. 36 plots values for hole diameters up to 2 inches. The values calculated using the circuit model, and plotted in FIG. 36, may be compared with the experimental measurements which are plotted in FIG. 9.

The effects of adding a food load to the package may be represented in the equivalent circuit shown schematically in FIG. 33 by an impedance $Z_F$, identified with reference numeral 95. The food which is contained in a microwave package may affect the heating characteristics of a grid in combination with either a magnetic, or resistive, or dielectric heating susceptor means.

Adding a food load to the circuit model discussed above will have several effects. First, the impedance $Z_F$ added by the food load will tend to reduce the absorbance in the susceptor. Adding a food load which is a dielectric will affect the capacitance "C" of the circuit model. This in turn will have an effect upon the "Q" of the circuit model. Also, the natural frequency of the hole or opening in the grid will be changed due to the presence of the dielectric represented by the food load.

In general, with the addition of a food load, the optimum value of resistivity for the susceptor means will be changed for a given hole size. The reflection and transmission of the total system represented by the grid/susceptor combination and food load will also be different from that of the grid/susceptor alone. The empirical method discussed above, and contour plots, may be utilized to account for changes introduced by adding a food load.

Uniformity of Heating

This invention greatly improves the uniformity of heating of food, as compared to a conventional susceptor utilized alone without a grid.

FIG. 14C is a copy of an image taken with an infrared camera showing the heating pattern for a conventional susceptor used alone without a grid. This image shows hot spots which developed on the susceptor during microwave heating. Such hot spots are typical of conventional susceptors, when used alone, and result in uneven heating and/or cooking of the food item. For example, a pizza can be overheated along the outer perimeter, and can be heated insufficiently in the center region of the pizza. In the case of fish sticks, for example, the fish sticks on the outside can be overheated and the fish sticks on the inside can be heated insufficiently.

FIG. 14D is a copy of an image taken with an infrared camera showing a heating for a susceptor in combination with a grid. The uniformity of heating in the example shown in FIG. 14D may be compared with the hot spots shown in FIG. 14C.

FIG. 14C and FIG. 14D are black and white copies of color images. Black and white copies are used herein for convenience, and are believed to be sufficient for purposes of illustration. The original color images of FIG. 14C and 14D are incorporated herein by reference.

A grid 19 exhibits a phenomenon where energy is coupled between adjacent holes 27 in the grid 19. This coupling between adjacent holes 27 has the effect of making the heating of the susceptor 20 more uniform. This phenomenon of coupling between holes 27 can best be described by considering the effect of varying the spacing between adjacent holes 27.

Figure 15:
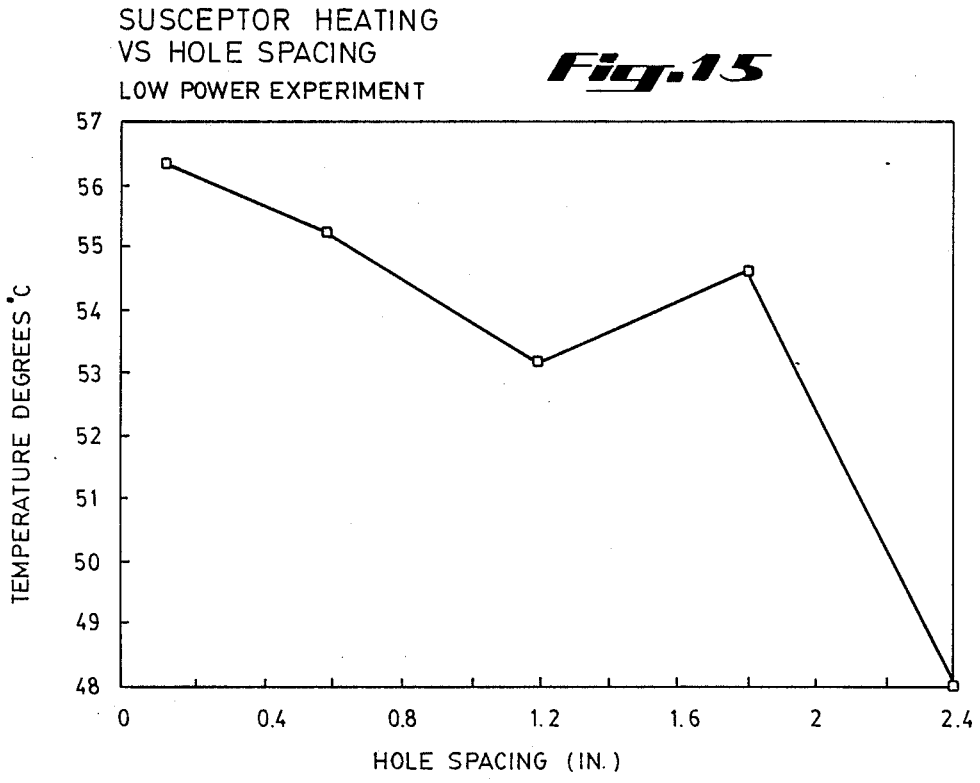
FIG. 15 is a graph depicting temperature due to heating as a function of spacing between holes.

It is desirable to have the openings 27 in the grid 19 spaced sufficiently close so that the openings 27 effectively share fields. FIG. 15 is a graph plotting the amount of heating of the susceptor 20 as a function of the spacing of the openings 27 in the grid 19. In this experiment, heating occurred at low power to minimize the deterioration of the susceptor 20 as a result of heating. The holes 27 in the grid 19 were circular holes having a one inch (2.54 cm) diameter. In this experiment, three holes in a row were utilized for the measurements. Temperatures were measured utilizing an infrared camera aimed at the backside of the susceptor 20. This method of measurement does not necessarily provide the actual temperature of the susceptor 20, but gives reliable indications of relative temperature.

In this experiment, the temperature measurements were affected by the orientation of the grid/susceptor combination in the oven. Therefore, ten measurements were made. For each measurement, the orientation of the three holes in the grid 19 were rotated to a slightly different position. The temperature measurements for the ten experimental runs were then averaged to produce a single data point, which is plotted on FIG. 15. This procedure was repeated for each of five different spacings between the holes.

The general trend shown by FIG. 15 is that the temperature increases as the spacing between adjacent holes decreases. As the spacing between holes decreases, the sharing of adjacent fields between holes increases. There also seems to be an increase in the maximum temperature reached when the holes were closely spaced.

Figure 16:
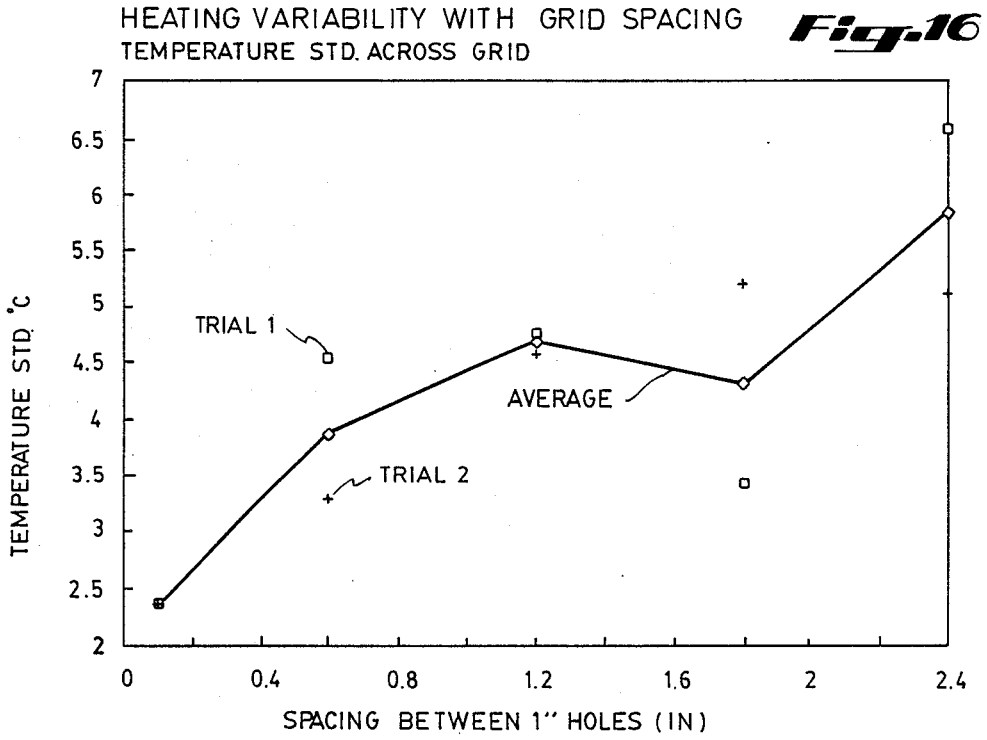
FIG. 16 is a graph depicting uniformity of heating by plotting the standard deviation of experimental temperature measurements taken with an infrared camera as a function of spacing between holes.

FIG. 16 is a graph depicting the standard deviation of temperature variation over a grid 19 as a function of the spacing between the openings 27 in the grid 19. In this experiment, a grid having circular openings of one inch (2.54 cm) diameter with a square lattice configuration was utilized. An infrared image of the heating of the grid/susceptor combination was then taken using an infrared camera, similar to that shown in FIG. 14A. Using a spot function programmed in commercially available software provided in conjunction with the infrared camera, the maximum temperature in each opening 27 was determined. The standard deviation of this collection of maximum temperatures was then computed using standard statistical techniques and that value is shown in FIG. 16. Two trial runs were taken, and FIG. 16 shows the average between the two trials.

As shown in FIG. 16, the general trend is toward more uniform heating of the grid/susceptor combination, (i.e., lower standard deviation), as the spacing between the openings 27 decreases.

A spacing between openings 27 less than or equal to one inch will provide satisfactory results in practice. A spacing between openings 27 of less than ½ inch (1.3 cm) is preferred. The most preferred spacing is about ⅛ inch (0.32 cm). Spacings less than ⅛ inch (0.32 cm) are difficult to achieve in practice because of limitations in available materials and due to mechanical difficulties experienced with such thin strips of metal 28.

Susceptors, (without using a grid), tend to heat unevenly. Susceptors also tend to heat preferentially at the edges, so that susceptors tend to heat more at the edges than in the center. The problems of uneven heating in susceptors is exacerbated by the circumstance of uneven electric fields in the ovens. Many consumer microwave ovens will have uneven field strengths. Where the fields are stronger, the susceptors will tend to heat more. Thus, the combination of all these factors tends to result in a great deal of unevenness in the heating of a food substance using a susceptor alone.

An experiment was performed to compare the difference between a susceptor heated alone, and a susceptor/grid combination which was also heated. Both examples were heated in a low power microwave until the same average temperature was reached by each. An infrared camera was used to make temperature measurements. FIG. 37A and FIG. 37B are copies of one set of infrared images taken with the infrared camera during this experiment. Table III shows the results of the measurements taken. Multiple measurements were taken and averaged. Table III gives the averaged measurements.

TABLE III

| | Minimum | Maximum | Average | Standard Deviation |
|---|---|---|---|---|
| Susceptor | 32.4° C. | 46.5° C. | 37.2° C. | 3.00° C. |
| Susceptor/Grid | 33.3° C. | 43.1° C. | 36.3° C. | 1.76° C. |

The measurements set forth in Table III for the susceptor alone represent averages for two experimental runs. For the susceptor, the average minimum temperature was 32.4° C. and the average maximum temperature was 46.5° C. The average of the average temperatures for the susceptor alone was 37.2° C. Using a statistical analysis contained in the thermal imaging software package accompanying the infrared camera system, a standard deviation for the temperatures measured over the total area of the susceptor was computed. The average standard deviation for the two runs was 3.0° C. The infrared camera used here, and in other examples in this specification, was an Agema Infrared Systems, Model Thermovision 870 infrared camera. A thermal image computer, Model TIC-8000 running CATS Version 4 software was used for the statistical analysis.

The numbered listed in Table III for the susceptor/grid represent averages of three experimental runs. In the case of the grid/susceptor combination, the average minimum temperature was about 33.3° C. and the average maximum temperature was about 43.1° C. The average of the average temperatures was 36.3° C. The average standard deviation for the temperatures measured was only 1.76° C.

The susceptor/grid combination had much more uniform heating than was the case with a susceptor used alone.

FIG. 37A and FIG. 37B are black and white copies of color infrared images taken with the infrared camera. For convenience, black and white figures have been used. However, the full color images are incorporated herein by reference.

Referring to FIG. 37A, the maximum temperature was reached at a relatively hot spot in the upper right hand portion of the figure. The maximum temperature in this measurement was found to be 45.4° C. The minimum L temperature shown in FIG. 37A was 30.5° C. The minimum and maximum temperatures shown in Table III are averages of those which were measured.

In FIG. 37B, the maximum temperature reached was 43.3° C. The minimum temperature reached was 35.5° C. A comparison of FIG. 37A with FIG. 37B shows much more uniform heating with the grid/susceptor combination, than with the susceptor alone.

In this experiment, the susceptors used had a resistivity of about 70 ohms per square. The grid had an equilateral triangular lattice geometry with circular openings having a diameter of about ¼ inch (0.64 cm). A spacing of ⅛ inch (0.32 cm) between openings was used. The susceptor and grid were essentially in contact with each other. The technique of taking temperature measurements from the back side of the susceptor was used in this experiment, for the reasons described above. The temperature measurements provide a relative indication of heating differences.

The above-discussed uniformity of heating due to the grid/susceptor combination has also been observed when a food item 18 is included. A pizza was prepared in a conventional oven, a pizza was prepared using a susceptor alone, and a pizza was prepared using a grid/susceptor combination in accordance with the present invention. Measurements were made with an infrared camera to determine the uniformity of heating. Measurements of the heating of the bottom of the pizza showed uniformity of heating using the grid/susceptor combination which was as good as or better than that achieved with a conventional oven. Table IV shows a comparison of the measurements taken.

TABLE IV

| | Minimum | Maximum | Average | Standard Deviation |
|---|---|---|---|---|
| Susceptor | 71.6° C. | 145° C. | 101° C. | 15.0° C. |
| Grid and Susceptor | 89.7° C. | 130° C. | 116° C. | 6.3° C. |
| Conventional Oven | 84.9° C. | 117° C. | 102° C. | 6.6° C. |

The cooked crust was observed after the pizza had been heated in each case. With the grid/susceptor combination, the browning of the crust was more uniform in this experiment than the browning of the crust which was achieved in a conventional oven. The browning of the crust was significantly better than the browning which was achieved using a susceptor alone. Using a susceptor alone, only the outermost perimeter of the bottom of the pizza was browned.

A grid and susceptor combination having a composite microwave power transmittance, or transmissivity, less than 50 percent, when the grid/susceptor combination is measured alone, is preferred. A grid and susceptor combination having a composite microwave power transmittance, or transmissivity, less than 25 percent is more preferred. A grid and susceptor combination having a composite microwave power transmittance less than 10 percent is even more preferred. A grid and susceptor combination having a composite microwave power transmittance less than 5 percent is especially preferred. A grid and susceptor combination having a composite microwave power transmittance less than 2 percent is more especially preferred.

The grid and susceptor combination must have a composite microwave power transmittance greater than $3 \times 10^{-4}$ percent.

It is desirable to have a heater for a microwave food package which has a composite microwave power transmittance which does not substantially change during microwave cooking. For example, in FIG. 6, the composite microwave power transmittance of the examples shown changed less than 3 percentage points after microwave heating.

A grid and susceptor combination preferably has a composite microwave power transmittance which changes less than 20 percentage points after microwave cooking. This is measured by first measuring, using a network analyzer, the composite microwave power transmittance before microwave cooking, of the grid and susceptor combination alone. This gives an initial transmittance $T_1$. The entire package, including the food item, is then placed in a microwave oven and heated for the predetermined heating time determined by the food item. The grid and susceptor combination is removed and measured alone in the network analyzer to determine the composite microwave power transmittance $T_2$ after microwave cooking. The change $T_C$ is preferably less than 0.20 ($T_C = T_1 - T_2$), or 20 percentage points. For example, if $T_1$ is 5 percent, or 0.05, then $T_2$ is preferably less than 25 percent, or 0.25.

A more preferred grid and susceptor combination has a composite microwave power transmittance which changes less than 15 percentage points. An even more preferred grid and susceptor combination has a composite microwave power transmittance which changes less than 10 percentage points. An especially preferred grid and susceptor combination has a composite microwave power transmittance which changes less than 5 percentage points. A more especially preferred grid and susceptor combination has a composite microwave power transmittance which changes less than 4 percentage points as a result of microwave heating. An even more especially preferred grid and susceptor combination has a composite microwave power transmittance which changes less than 3 percentage points as a result of microwave heating.

Grid Thickness

Figure 13:
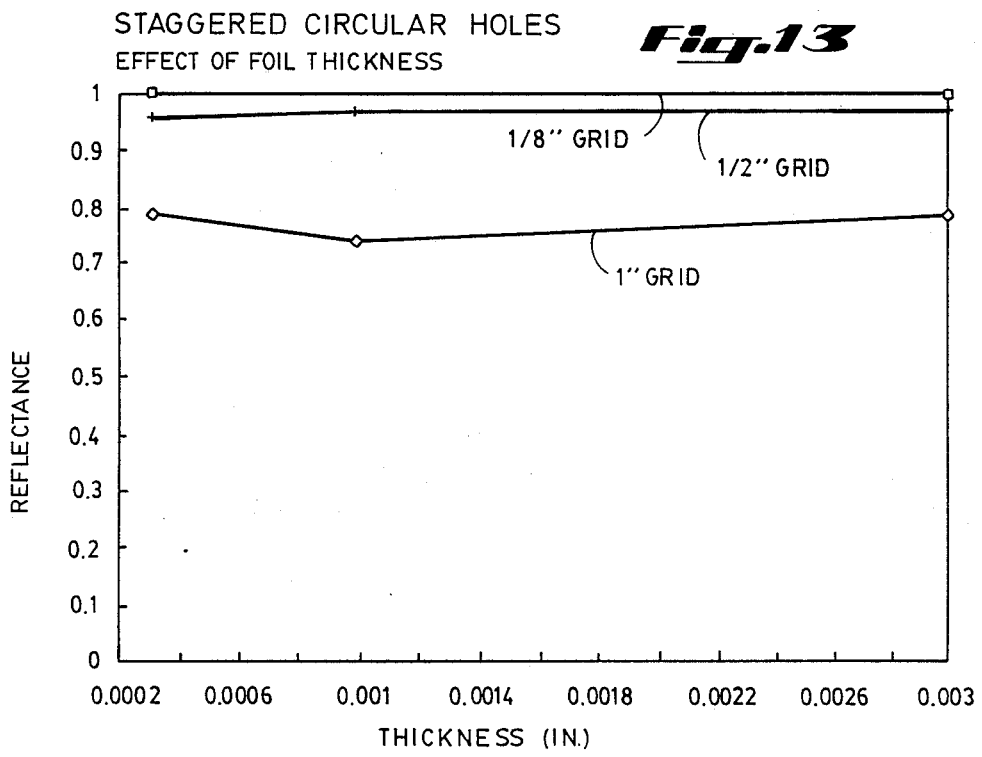
FIG. 13 is a graph depicting percentage of microwave power reflected as a function of the thickness of the foil grid.

FIG. 13 is a graph representing a plot of the reflectance of the grid 19 alone as a function of the thickness of the grid 19. Thickness ranges started with a grid thickness of about 3/10000 of an inch (0.00076 cm). This thickness was chosen because it is generally the thinnest rolled foil which was considered practical. A thickness as large as 0.003 (0.0076 cm) inch was utilized, which represents a relatively thick aluminum foil for packaging applications.

In FIG. 13, three different curves are shown. Each curve represents the diameter of the openings 27 in the grid 19. The grid geometry utilized was case 1—circular openings with an equilateral triangular lattice.

FIG. 13 shows that, for the range of thicknesses which are practical for the foil grid 19, the reflectance is virtually unaffected by the thickness of the grid 19.

If the thickness of the grid is made too thin, the mechanical integrity of the grid may be adversely affected. Also, if the thickness of the grid is made too thin, the electrical resistance of the strips 28 may become appreciable, and as a result, the strips 28 of the grid may heat sufficiently to cause the conductivity of the strips 28 to be broken. If this happens, it may adversely affect the electrical integrity of the grid. In some applications, this may be undesirable.

Package Design Procedure

A preferred technique for designing a package for a given food product involves an optimization procedure which goes through iterations. To start, a food product may be cooked in a microwave oven using nothing but a conventional susceptor. In examples where the present invention is most advantageous, the results of cooking the food product with the susceptor alone will typically be unsatisfactory. The results of this cooking test, however, are used to evaluate a starting point for the design of a package utilizing the present invention. The product resulting from heating with a susceptor alone is evaluated. If the interior of the food heats too much, or is too tough, or other indications of overheating are observed, shielding of the top of the package may be indicated. If the edges of the food are overheated, too tough, or otherwise show indications of absorbing too much microwave energy, side shielding may be indicated. In most applications, a starting point for a package design may be a package having top and side shielding, with a grid/susceptor combination forming the bottom of the package. For many applications, it is useful to start with a grid/susceptor combination having the following: a grid with square openings in a square lattice configuration, where the openings have a height and width equal to about ½ inch. The width of the strips of the grid, i.e., the spacing between the holes, may be 3/16 inch. A susceptor having a surface resistivity of about 70 ohms per square may be used initially. The susceptor may be placed at the bottom of the package, with the grid in contact with it and immediately above it. The food may then be placed on top of the grid, so that the grid is interposed between the susceptor and the food. The food is then heated in a microwave oven using a package according to this initial design. The resulting product is evaluated.

The design factors discussed above may then be used to optimize microwave heating of this package. If the microwave heating time is too long, openings may be cut in the shielding, or the size of the openings in the grid may be increased. Once the heating time is within a desirably short range of time, the package may be optimized or fine-tuned.

For example, if the surface of the food is overheated, various design factors may be changed to compensate. The hole size may be made smaller to decrease the surface heating of the food. Alternatively, the resistivity of the susceptor may be changed to move surface resistivity to a less optimum point. If a contour plot such as is shown in FIG. 12 is developed, adjustments of hole size and resistivity may be made in accordance with such a contour plot developed for the particular food item in question. If the surface is underheated, opposite steps may be taken.

If less reflection is desired, a triangular lattice geometry may be used. If more uniformity is desired, the spacing between openings may be reduced, and the size of the holes ma be reduced. Decreasing the size of the holes may require the adjustment of other design factors, such as the resistivity of the susceptor, in order to compensate for the overall reduced heating which may result.

If the susceptor is placed between the grid and the food, the distance between the grid and the susceptor may be increased to reduce the overall heating of the susceptor. If the grid is placed between the susceptor and the food, increasing the separation between the grid and the susceptor will increase the heating of the susceptor, within limits. In such an example, however, separation between the food and susceptor will also occur. Thus, the overall heating of the food may be affected to the extent that the food is not directly in contact with the susceptor. As the spacing between the grid and the susceptor is increased, the susceptor will tend to behave more and more like a susceptor used alone without a grid.

For a given hole size and grid/susceptor spacing, the impedance of the susceptor, including its surface reactance, may be optimized or matched to increase the absorbance, if desired.

In designing a package in accordance with the present invention, the reflectance, absorbance and transmittance of the grid/susceptor combination is considered independently of the effect that the presence of food has upon the parameters. Using the iterated process described above, the performance characteristics of the grid/susceptor combination may be adjusted to optimize the package without requiring a detailed analysis of the parameters which result when the food is present.

In a preferred package design, the susceptor means should not be allowed to overlap the area of the grid. If an outer edge of the susceptor means is exposed, it will tend to severely overheat. The grid should be the same size as, or slightly larger than, the area of the susceptor means.

ALTERNATIVE EMBODIMENTS

EXAMPLE 1

Figure 20:
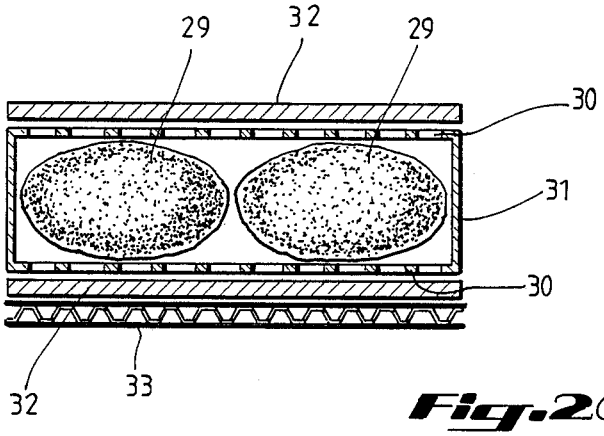
FIG. 20 illustrates an alternative embodiment of the invention.

FIG. 20 shows an alternative embodiment of the present invention. In this example, six Pizza Rolls brand hot snacks 29, made by The Pillsbury Company, were placed inside a package comprising two grids 30 connected by shielded walls 31. The grids 30 and shielded walls 31 were conductive, and were made of aluminum foil in this example. Two susceptors 32 were provided on either side of the grids 30 on the side remote from the hot snacks 29. In this example and in the examples discussed hereinafter, the susceptors 32 and grids 30 are functionally the same as the susceptor means 20 and grid 19 described above. Also, in this particular example, a corrugated medium 33 made of paper supported the package.

In this example, the grids 30 had openings 34 in the shape of ½" × ½" (1.27 cm) squares. The susceptors 32 were approximately 70 ohms per square. Complete aluminum foil shielding 31 was provided around the sides of the package.

In this example, frozen snacks 29 were microwaved 1 ½ minutes on one side. The entire package was flipped over and heated an additional 1 ½ minutes on the other side. Six hot snacks (90 grams) were cooked using this method. This produced hot snacks 29 having a crisp exterior and a moist interior.

EXAMPLE 2

The same package was used with Banquet brand microwave chicken nuggets. Six frozen chicken nuggets were cooked 1 minute and 15 seconds on one side, and for a similar time period on the other side. This cooking method produced chicken nuggets having a crisp exterior and a moist interior.

EXAMPLE 3

Figure 21:
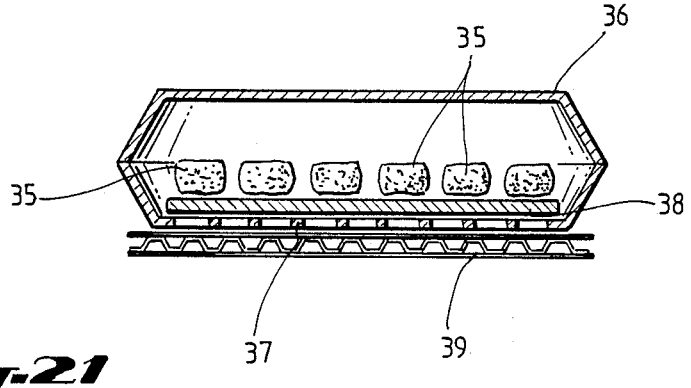
FIG. 21 illustrates an alternative embodiment of the invention.

FIG. 21 illustrates an alternative embodiment for french fries 35. The french fries 35 were completely enclosed in a shielded container 36, having a grid 37 along the bottom portion thereof. A susceptor 38, having an oil coating on the polyester side, supported the french fries 35, and was in direct contact therewith. The entire package was supported on a corrugated medium 39. The grid 37 had about 70% open area. As shown in FIG. 21, the top and sides of the package was completely shielded with an aluminum shield 36.

In this example, frozen french fries 35 were heated for 1 ½ minutes. The top shield 36 was then removed to flip the french fries 35 over. The shield 36 was replaced, and the fries 35 were heated for an additional 1 ½ minutes. This produced browned, crispy fries with a tender, moist interior. The crispness was similar to pan-fried potatoes, the french fries 35 were crisper than oven-baked french fries, although not necessarily as crisp as freshly deep-fat-fried french fries. The french fries used were partially cooked frozen french fries 35.

EXAMPLE 4

Figure 22:
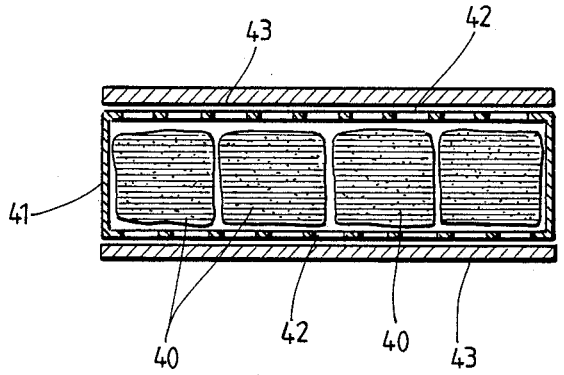
FIG. 22 illustrates an alternative embodiment of the invention.

FIG. 22 illustrates an example of the invention used in connection with fish sticks 40. In this example, four fish stick pieces 40 (100 grams) were prepared in a package having aluminum shielded sides 41, with grids 42 directly adjacent the top and bottom of the fish sticks 40. Susceptors 43 were provided on the top and bottom of the package immediately adjacent to the grids 42, located on the side of the grids 42 remote from the fish sticks 40.

In this example, the package of frozen fish sticks 40 was heated 1 minute and 15 seconds, and was then inverted and heated an additional 1 minute and 15 seconds. The fish sticks 40 heated in this manner had a tender interior and a crisp exterior. In the past, fish sticks heated in a microwave oven on a standard susceptor typically resulted in fish sticks where the end pieces of fish were overcooked. The grid/susceptor system shown in FIG. 22 eliminated nonuniform cooking of the fish sticks 40. Van De Kamp's brand fish sticks were used in this example.

EXAMPLE 5

Using a package of the same construction as shown in FIG. 22, frozen Van De Kamp's brand microwave fish fillets were heated in a microwave oven. In this example, best results were observed when the grids 42 above and below the susceptors 43 were constructed having an open area between 40% and 60%. Microwave cooking time was between 6 and 8 minutes. Using a conventional susceptor, only the bottom of these fish fillets is normally crisp. The grid/susceptor system shown in FIG. 22 when used in connection with such fish fillets produced a crisp top and bottom on the fish fillets, and eliminated toughening of the perimeter of the fish fillets which had been previously experienced.

EXAMPLE 6

Figure 23:
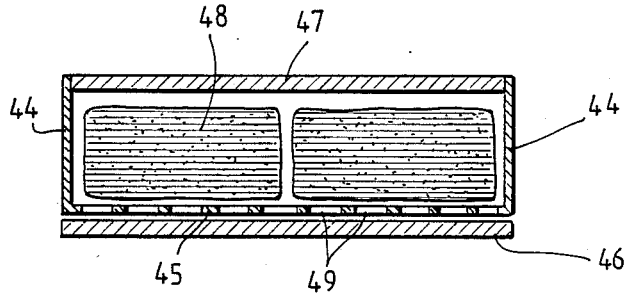
FIG. 23 illustrates an alternative embodiment of the invention.

FIG. 23 shows an alternative embodiment using a package which is only partially shielded. Only the sides 44 of the package is shielded using aluminum shielding. A grid 45 in combination with a susceptor 46 was provided at the bottom of the package. A susceptor 47 was provided alone at the top of the package. This package was used for microwave cooking of fish fillets 48.

In this example, the grid 45 had an open area percentage of 25%. The grid had openings 49 in the form of ½" × ½" (1.27 cm) squares. The susceptor 46 had a resistivity of approximately 70 ohms per square. A similar susceptor 47 was used for the top of the package.

In this example, two pieces of fish fillet 48 (120 grams) were cooked for 1 ½ minutes configured as shown with the grid/susceptor system on the bottom. The package was then flipped, and heated for an additional 1 ½ minutes with the susceptor 47 on the bottom.

This produced fish fillets 48 having browned, crisp batter with a tender fish interior.

EXAMPLE 7

Figure 24:
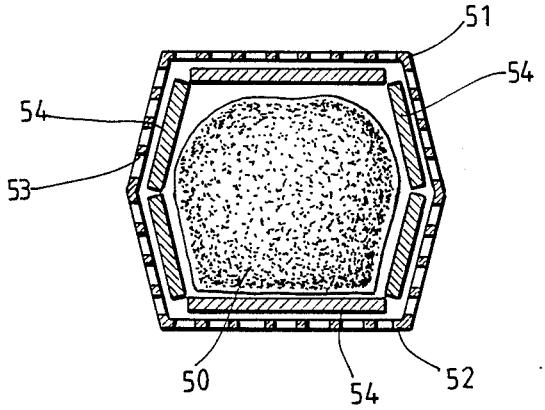
FIG. 24 illustrates an alternative embodiment of the invention.

FIG. 24 illustrates an embodiment used for cooking bread 50 in a microwave oven. Baking bread in a microwave oven is a challenge. The baking time must be slow enough for the bread to rise and establish a good cell structure. Crust formation and browning are highly desirable in baking bread. Conventional microwave cooking offered no means for slowing the heating rate. Conventional microwave cooking would result in coarse irregular cell structure in the bread because steam would be generated too rapidly for the bread structure to contain it. A package constructed in accordance with the present invention slowed the heating rate and produced some crust browning during microwave cooking.

In this example, Rhodes brand frozen yeast bread was heated in a microwave oven using two aluminum bread pans 51 and 52. One bread pan 51 was inverted and formed the top of the package. Both bread pans 51 and 52 had ½" × ½ (1.27 cm) square holes cut in the pans. This formed a grid 53 completely surrounding the bread 50. The grid 53 was fully lined on the inside with susceptors 54.

In this example, the bread dough was defrosted and proofed at ambient temperature. The package and bread 50 were then placed in a microwave oven and heated for 22 minutes. In this example, about 454 grams of bread 50 was cooked. This cooking time compares with a cooking time of about 35 to 40 minutes in a conventional oven. The volume of the bread loaf 50 appeared to be good, and the cell structure was observed to be regular. The bottom and sides of the bread 50 were browned. Some browning occurred on the top of the bread 50, but the bread was not uniformly browned.

EXAMPLE 8

Figure 25:
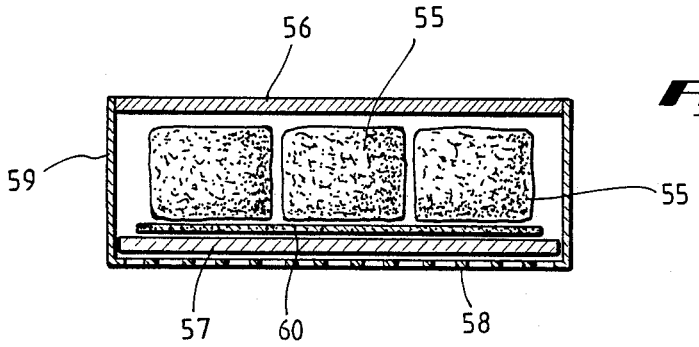
FIG. 25 illustrates an alternative embodiment of the invention.

FIG. 25 illustrates an example used to heat caramel rolls 55. Eight caramel rolls 55 were prepared by heating between two susceptors, a first susceptor 56 on top having a resistivity of about 1000 ohms per square, and a second susceptor 57 on the bottom having a resistivity of about 70 ohms per square. The bottom susceptor 57 was placed coplanar with, and immediately above, a grid 58 made by cutting openings in the bottom of an aluminum pan. The sides 59 of the aluminum pan provided shielding. A mixture of melted butter and caramel topping 60 was placed upon the bottom susceptor 57. Heating time for the eight rolls 55 was about six minutes. In this example, the caramel on the bottom turned out very well, and a golden brown top for the rolls 55 was produced. The rolls 55 were not tough.

In this example, different resistivity susceptors 57 and 56 were used to achieve maximum browning on the top of the rolls 55, and better caramelization on the bottom. When this example was attempted with two susceptors both having a resistivity of about 70 ohms per square, no caramelization occurred before the bread was unacceptably toughened. An attempt to use grids 58 over both the top susceptor 56 and the bottom susceptor 57 slowed the cooking of the bread, and the bottom browned but the top did not brown. Removing only the top grid and staying with the 70 ohms per square susceptor resulted in too much heating of the bread. Top browning occurred, but the bread was unacceptably tough. The best product was achieved when a high resistivity susceptor 56 of approximately 1000 ohms per square was used without a grid on top of the rolls 55.

EXAMPLE 9

Figure 26:
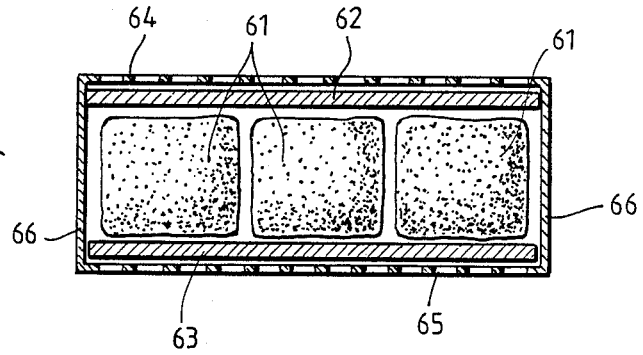
FIG. 26 illustrates an alternative embodiment of the invention.

FIG. 26 illustrates another example in which Pillsbury "1869" brand refrigerated biscuits 61 were prepared. Four biscuits 61 were placed in a package between a top susceptor 62 and a bottom susceptor 63. The susceptors 62 and 63 both had a resistivity of about 70 ohms per square. A top grid 64 and a bottom grid 65 were placed coplanar with, and immediately adjacent to, the susceptors 62 and 63. The grids 64 and 65 were placed next to the susceptors 62 and 63, respectively, on the sides remote from the biscuits 61. Shielding 66 was provided on the sides of the package.

In this example, the four biscuits 61 were heated in a microwave oven for about four minutes. The tops and bottoms of the biscuits 61 were browned. The cell structure of the bread 61 was somewhat dense, but no excess toughening from overcooking was noticed.

EXAMPLE 10

Figure 27:
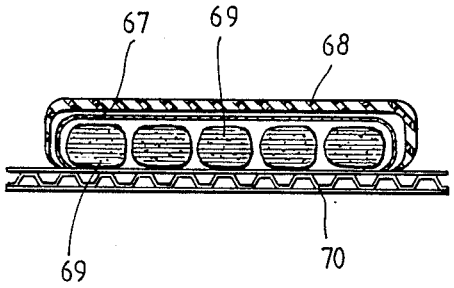
FIG. 27 illustrates an alternative embodiment of the invention.

FIG. 27 illustrates an example where an unsupported susceptor film 67 was used in connection with a flexible foil grid 68. The susceptor 67 comprised a flexible sheet of polyester, containing a metallized coating deposited thereon. The metallized polyester 67 was wrapped around five fish sticks 69.

The aluminum foil grid 68 was folded and crimped along the three open edges, taking care not to have any loose edges that might form a critical gap and arc. Slits were cut in the polyester film 67 along the edges of each fish stick 69 on both the top and bottom for venting purposes. This assembly was then placed upon a corrugated paper pad 70. The package was placed in a microwave oven and exposed to microwave radiation for two minutes. The package was then flipped over and exposed to microwave radiation for another two minutes.

After microwave heating, considerable moisture condensation was observed on the polyester film 67. The susceptor film 67 had a slightly melted look around the edges of each square in the grid 68, but was otherwise intact. Overall crispness of the breading of the fish sticks 69 was believed to be equal to that achievable on a standard susceptor. Both the top and the bottom of the fish sticks 69 were crisp. The fish sticks 69 were more evenly cooked than fish sticks which had been cooked alone or on a standard susceptor.

EXAMPLE 11

Figure 28:
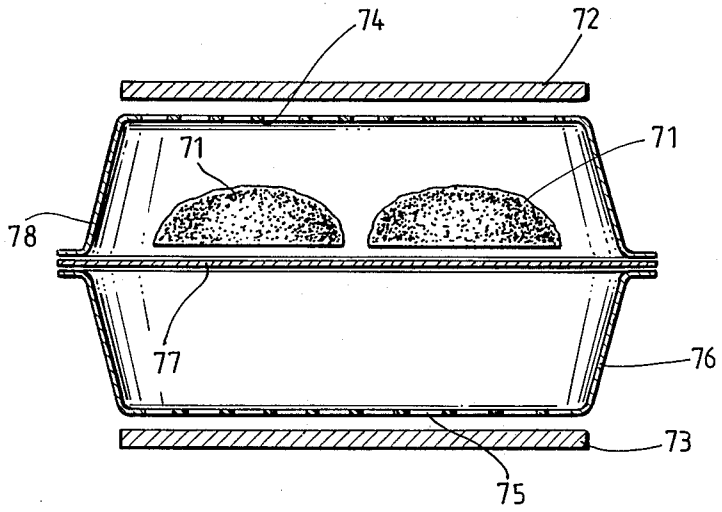
FIG. 28 illustrates an alternative embodiment of the invention.

FIG. 28 illustrates an example where cookies 71 were heated in a microwave oven. In this example, a top susceptor 72 and a bottom susceptor 73 were provided on the top and bottom of the package, respectively. Immediately adjacent to each susceptor 72 and 73 was a top grid 74 and a bottom grid 75, respectively.

In this example, the grid/susceptor combination 72, 74 and 73, 75 do not contact the food 71. Instead, the susceptors 72 and 73 heat the air inside the package, baking the cookies 71 much like a conventional oven. Thus, the present invention can be used to simulate a baking environment in a conventional oven, when it is desirable to do so.

The grid 75 was made by cutting circular holes in the bottom of an aluminum foil pan 76. The holes in the grid 75 were ¾ inch (1.9 cm) in diameter with ⅛ inch (0.3175 cm) spacing between the openings. Circular openings with an equilateral triangular lattice structure were utilized. An aluminum foil sheet 77 generally bisected the package and provided a support for the cookies 71. The top of the package was similarly formed from an inverted aluminum foil pan 78. The grid 74 cut in the top of the inverted pan 78 had a similar geometry. The aluminum foil sheet 77 was made from one mil thick aluminum foil. The edges where the bottom pan 76 and the top pan 78 join together were carefully sealed with the foil 77 to prevent leakage of microwave energy. Thus, the sides of the pans 76 and 77 formed shielding 79.

The top susceptor 72 and the bottom susceptor 73 each had a resistivity of about 70 ohms per square. Six cookies 71 were placed in the package, each having a net weight of about 15 grams. A Pillsbury brand refrigerated chocolate chip cookie dough was used to form the cookies 71.

The resulting cookies 71 which were heated in a microwave oven turned out like cookies baked in a conventional oven. The cookies spread during cooking to a generally uniform thickness. The surface appearance of the cookies 71 was typical of a conventional oven baked cookie. Light even browning of the surface of the cookies 71 was achieved. The cookies were heated in a microwave oven for six minutes to achieve these results.

Prior attempts to make a cookie in a microwave oven using just a susceptor were unsatisfactory. The cookie prepared in this manner would not spread adequately. Browning of the surface of the cookie was unsatisfactory. The top surface would not brown, and the bottom surface would be overly browned.

EXAMPLE 12

FIG. 29 illustrates another example for heating biscuits 80 in a microwave oven. This particular package is suitable for refrigerated dough products in general. The biscuits 80 were placed upon a conventional aluminum foil tray 81. Unlike the above-described examples, the foil tray 81 did not have any openings cut in the bottom of the tray 81. Immediately below the tray 81, a susceptor 82 was placed in contact with, and supporting the bottom of, the tray 81. Immediately below the susceptor 82, a grid 83 was provided.

A grid 84 was provided on the top of the package. The grid 84 was secured in sealing engagement with the tray 81 to prevent microwave leakage around the grid 84. A top susceptor 85 was also provided on the side of the grid 84 remote from the biscuits 80. The susceptors 82 and 85 both had a resistivity of about 70 ohms per square.

In this example, uniform browning on the bottom of the biscuits 80 was achieved. The biscuits 80 rose adequately and had a good cell structure. The top of the biscuits 80 browned where they contacted the top grid/susceptor combination 84, 85. The combination of the grid 83 and the susceptor 82 on the bottom of the package provided a very uniform heating of the bottom of the foil tray 81.

EXAMPLE 13

FIG. 29A shows an example utilizing the invention having a completely unshielded package. In this example, a Pillsbury brand Microwave French Bread Pizza was utilized. The package was modified to include the insertion of a grid 100 cut from aluminum foil. The grid had ½ inch square holes cut in an equilateral triangular lattice configuration. The spacing between the holes was ⅛ inch.

The commercially available french bread pizza had a susceptor tray 99 which rested upon a corrugated paper pad 102. The french bread pizza 101 was removed from the tray 99, and the grid 100 inserted between the french bread pizza 101 and the susceptor tray 99.

The cooking time in this example was increased by 15 seconds over the heating time for the commercially available product. The results were improved over the commercially available product in that the crispening of the crust of the french bread pizza 101 was more uniform.

EXAMPLE 14

A pizza package was constructed in accordance with FIGS. 3 and 4, except that the susceptor 20 was made from microwave magnetic absorbing material. The microwave magnetic absorbing material was removed from a commercially available microwave browning utensil, i.e., a Microware brand crisper/griddle Model PM 400/145, by Anchor Hocking Corporation. When heated in a microwave oven for the same period of time, the pizza 18 was satisfactory.

EXAMPLE 15

In this example, various hole sizes were tested for temperature variation in susceptor heating. Square holes were used in all instances where a grid was used. A grid was used in all instances, except two control cases, where a susceptor was heated alone.

In Case 1, a single 10 inch wide square hole was used. The "grid" was a ¼ inch wide conductive strip around the outside edges of a square susceptor, slightly larger than 10 inches in width. In Case 2, four square openings having a width of about 5 inches were used. In Case 3, 16 square openings having a width of about 2.5 inches were used. In Case 4, 64 square openings having a width of about 1.25 inches were used.

Temperature measurements were made with an infrared camera, and the minimum, maximum, average temperature and standard deviation measurements were taken in the manner described herein for such measurements.

TABLE V

| | Minimum | Maximum | Average | Standard Deviation |
|---|---|---|---|---|
| Control 1 | 28.0° C. | 61.2° C. | 31.2° C. | 3.1° C. |
| Control 2 | 28.3° C. | 49.8° C. | 31.1° C. | 2.2° C. |
| Case 1 | 28.0° C. | 35.6° C. | 30.8° C. | 1.5° C. |
| Case 2 | 27.6° C. | 38.6° C. | 32.0° C. | 2.0° C. |
| Case 3 | 27.3° C. | 37.2° C. | 30.3° C. | 1.9° C. |
| Case 4 | 27.1° C. | 38.1° C. | 29.6° C. | 1.9° C. |

The holes 27 may have various shapes. The holes may be circular (see FIG. 39B), square (see FIG. 39A and FIG. 39M), triangular (see FIG. 39C), hexagonal (see FIG. 39D and 39E), "U" shaped (see FIG. 39L and FIG. 39P), rectangular (see FIG. 39G), cross-shaped (see FIG. 39J), and oval (see FIG. 39F). The holes 27 may include various shaped reflective patches 103 within the hole 27, such as a reflective circle 103 within a circular shaped hole 27, as shown in FIG. 39H. Alternatively, a reflective square or rectangle 104 within a square or rectangular hole 27 may be used, as shown in FIG. 39I. Crescent shaped holes 27 may be used, as shown in FIG. 39K.

The geometry of the holes may take various forms. In addition to the square lattice and equilateral triangular lattice described above, the geometry may be radial. In addition, differential geometry may be used where different spacing is provided between holes 27 in the grid 19, as shown in FIG. 390, or different size holes may be used in various regions of the grid 19, as shown in FIG. 39M and FIG. 39N. In addition, different shaped holes may be used in various locations of the grid.

The susceptor means 20 is preferably a thin film of aluminum metallized on a polyester substrate. The heater or susceptor 20 may alternatively be another type of thin film susceptor, a dielectric material having a dielectric loss factor E" greater than 2, a microwave magnetic absorbing material, graphite, or combinations of such materials, or a composite structure composed of different layers or dispersed portions of such materials.

The package 17, 16 enclosing the food item 18 may be partially shielded, as shown in FIG. 3 and FIG. 4. Alternatively, the package enclosing the food item may be totally shielded (except for the grid/susceptor combination), totally unshielded (except for the grid/susceptor combination), or partially shielded. Alternatively, a grid/susceptor combination may be wrapped around a food item, and may itself comprise the package in which the food item is heated in a microwave oven.

The grid is preferably an aluminum foil lattice structure. However, the grid may also be hot stamped metal, metallized films such as aluminum, stainless steel, copper or steel, or the grid may be a wire mesh. The grid may comprise interwoven strips of metal or overlaid strips of metal 105, as shown in FIG. 40F and FIG. 40E. The grid may be formed from a sheet of metal having holes punched therein. The grid may comprise expanded metal, punched and upset metal sheets. The grid could alternatively be formed from a lattice structure formed from overlapping spiral and radially cut strips.

The preferred susceptor and grid configuration is a planar grid in contact with, or spaced less than 0.048 inch (0.122 cm) from, a planar susceptor. Alternative arrangements may include susceptor material 20 filling the holes 27 in the grid 19, as shown in FIG. 40A and FIG. 40B. Optionally, a sheet of backing material 106, such as paper, may be provided. In FIG. 40A, the holes 27 in the grid 19 are completely filled with susceptor material 20. In FIG. 40B, the holes 27 are not completely filled. The holes 27 may be circular, square, or some other shape, leaving an annular opening space around the susceptor material 20. Referring to FIG. 40D, susceptor material 20 may be placed behind the grid 19 in the form of patches, circles or squares of susceptor material which preferably are geometric shape as the holes 27, and slightly larger than the size of the holes 27 so that the susceptor means 20 overlaps the hole 27. Other arrangements include a grid lattice 19 embedded or encased in a susceptor medium 20, as shown in FIG. 40C. In addition, the grid 19 may be constructed so that it is sandwiched between susceptor sheets.

The grid preferably has a microwave power reflectance more than 40 percent when the grid is measured alone. More preferably, the grid has a microwave power reflectance which is more than 85 percent, when measured alone. A microwave power reflectance more than 95 percent for the grid, when measured alone, is even more preferred.

A spacing 28 between adjacent openings 27 in the grid 19 which is less than one inch is preferred. A spacing between openings 27 less than ½ inch is more preferred. A spacing less than or equal to about 3/6 inch between openings 27 is even more preferred. Openings having a spacing which is less than or equal to about ⅛ inch is especially preferred.

Measurement Procedures

In the above descriptions, measurements of resistivity, reflectance, transmission, absorbance, etc., were all taken at room temperature (21° C.) unless otherwise specified.

In the above descriptions, measurements taken with a network analyzer all involved the procedure described below, unless otherwise specified. The procedure may best be understood with reference to FIG. 49 and FIG. 50. A Hewlett Packard Model No. 8753A network analyzer 107 in combination with a Hewlett Packard Model No. 85046A S-parameter test set were used. All measurements were made at the microwave oven operating frequency of 2.45 GHz. All measurements were made at room temperature, unless otherwise specified. All measurements are made using WR-284 waveguide 108, unless otherwise specified. The measurements graphed in FIG. 30A and in FIG. 30B were made using a WR-340 waveguide. Measurements of reflectance, transmission and absorption for a grid/susceptor combination, in the above discussion of design factors, should be made without the presence of a food item.

Measurements are preferably made by placing a sample 109 to be measured between two adjoining pieces of waveguide 108. Conductive silver paint 110 is preferably placed around the outer edges of a sample sheet which is cut slightly larger than the cross-sectional opening 111 of the waveguide. Colloidal silver paint 110 made by Ted Pella, Inc. has given satisfactory results in practice. The sample 109 is preferably cut so that it has an overlap of about 50/1000 inch (0.127 cm) around the edge. The waveguide is calibrated according to procedures specified and published by Hewlett Packard, the manufacturer of the network analyzer.

Scattering parameters, $S_{11}$, $S_{12}$, $S_{21}$ and $S_{22}$, are measured directly by the network analyzer. These measured parameters are then used to calculate the microwave power reflectance, power transmittance, and power absorbance.

The reflectance looking into port 1 is the magnitude of $S_{11}$ squared. The reflectance into port 2 is the magnitude of $S_{22}$ squared. The transmittance looking into port 1 is the magnitude of $S_{21}$ squared. The transmittance looking into port 2 is the magnitude of $S_{12}$ squared. The power absorbance, looking into either port 1 or port 2, is equal to one minus the sum of the power reflectance and the power transmittance into that port.

The complex surface impedance of an electrically thin sheet is obtained from the measured scattering parameters using formulas presented in "Properties of Thin Metal Films at Microwave Frequencies", by R. L. Ramey and T. S. Lewis, published in the Journal of Applied Physics, Vol. 39, No. 1, pp. 3883–84 (July 1968), along with the information in J. Altman, *Microwave Circuits*, pp. 370–71 (1964). For unused susceptor material, the impedance is essentially all resistive. For highly conductive grids, the impedance is entirely reactive.

Conclusion

The present invention is particular concerned with microwave environments of the type encountered in microwave ovens. The present invention is particularly applicable in microwave environments were the average rms electrical field strength is greater than 1 v/cm. In a typical application involving the present invention, the food package including a grid/susceptor combination is intended for use in the enclosed cavity of a microwave oven having a power input of at least 10 watts, more typically in excess of 400 watts.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of the teachings herein. The full scope of the invention shall be determined by a proper interpretation of the claims, and shall not be unnecessarily limited to the specific embodiments described above.

What is claimed is:

1. A food package for a microwave oven, comprising:

a first sheet of material defining susceptor means for heating in response to microwave radiation;

a second sheet of material defining a grid, the grid having a conductive surface surrounding transmissive apertures, the grid modifying the performance characteristics of the susceptor means, the grid being in close proximity to the susceptor means;

a food item, the food item being located in heating relationship with the susceptor means; and, the grid and the susceptor being located on the same side of the food item.

2. The food package according to claim 1, wherein:

a substantial portion of the susceptor means is substantially planar.

3. The food package according to claim 2, wherein:

the grid is substantially planar.

4. The food package according to claim 1, wherein:

the grid and susceptor means are substantially coplanar with each other.

5. The food package according to claim 3, wherein:

the grid and susceptor means are substantially parallel to each other.

6. The food package according to claim 4, wherein:

the grid and susceptor means are spaced from each other by a distance of 0.048 inch or less.

7. The food package according to claim 4, wherein:

the grid and susceptor means are spaced from each other by a distance less than or equal to about 0.016 inch.

8. A food package for a microwave oven having a microwave frequency, comprising:

a food item having a surface to be heated;

a grid having a plurality of transmissive areas and having a conductive reflective region interlacing the transmissive areas, the reflective region providing a conductive path around individual transmissive regions at the microwave frequency of the microwave oven; and, susceptor means located sufficiently close to the surface of the food item to heat the food item and being located on the same side of the food item as the grid, the susceptor means being responsive to microwave radiation to heat sufficiently to produce a positive temperature differential with respect to the surface of the food item.

9. A food package for a microwave oven, comprising:

a food item to be heated in a microwave oven, the food item having a surface to be heated;

susceptor means located sufficiently close to the surface of the food item to heat the food item, the susceptor means being responsive to microwave radiation to heat sufficiently to produce a positive temperature differential with respect to the surface of the food item;

grid means located in close proximity to the susceptor means and on the same side of the food item as the susceptor means, the grid means being substantially reflective to a microwave field, the grid means being operative to substantially maintain reflectiveness during microwave heating, the grid means being operative to transmit a portion of microwave energy which impinges upon the grid means through to the susceptor means;

the grid means and the susceptor means being mutually cooperative to substantially maintain a composite level of transmissiveness during microwave heating.

10. A food package for a microwave oven having a microwave frequency, comprising:

a food item having a surface to be heated;

a grid having a plurality of transmissive areas and having a conductive reflective region interlacing the transmissive areas, the reflective region providing a conductive path around individual transmissive regions at the microwave frequency of the microwave oven;

a heater, the heater being located in close proximity to the grid and on the same side of the food item as the grid, the heater being exposed to a microwave field modified by the grid, the heater being operative to heat when exposed to a microwave field, the heater being located in heating relationship with the surface of the food item.

11. A food package for a microwave oven, comprising:

a food package enclosing a food item to be heated in a microwave oven, the package being at least partially shielded from microwave radiation;

the package including:

a planar susceptor, having a thin film of aluminum metallized on a polyester substrate, adhesively laminated to a sheet of solid bleached sulfate paperboard, the susceptor having a surface resistivity between about 1 ohm per square and about 10,000 ohms per square;

a planar aluminum foil grid, having a plurality of openings in a lattice configuration, the openings being a size between about 1/32 inch and about 4.8 inches;

the openings having a spacing between adjacent openings which is less than 1 inch, the grid having a microwave power reflectance more than 40 percent when the grid is measured alone; and, the grid and susceptor being located on an unshielded side of the package, the grid and susceptor being spaced apart less than 0.5 inch, the grid and susceptor forming a composite having a microwave power transmittance less than 50 percent when the composite is measured alone without the presence of the food item, the grid and susceptor composite being in close proximity to the food item.

12. The package according to claim 11, wherein:

the resistivity of the susceptor is between about 5 ohms per square and about 5000 ohms per square.

13. The package according to claim 11 wherein:
the resistivity of the susceptor is between about 30 ohms per square and about 800 ohms per square.

14. The package according to claim 11, wherein:
the resistivity of the susceptor is between about 50 ohms per square and about 70 ohms per square.

15. The package according to claim 11, wherein:
the size of the holes in the grid is between about $\frac{1}{8}$ inch and about 2.4 inches.

16. The package according to claim 11, wherein:
the size of the holes in the grid is between about $\frac{3}{8}$ inch and about $\frac{7}{8}$ inch.

17. The package according to claim 11, wherein:
the separation between the grid and susceptor is less than about 0.048 inch.

18. The package according to claim 11, wherein:
the separation between the grid and susceptor is less than about 0.016 inch.

19. The package according to claim 11, wherein:
the grid and susceptor composite has a microwave power transmittance less than 25 percent.

20. The package according to claim 11, wherein:
the grid and susceptor composite has a microwave power transmittance less than 10 percent.

21. The package according to claim 11, wherein:
the grid and susceptor composite has a microwave power transmittance less than 5 percent.

22. The package according to claim 11, wherein:
the grid and susceptor composite has a microwave power transmittance less than 2 percent.

23. The package according to claim 11, wherein:
the grid has a microwave power reflectance more than 85 percent when measured alone.

24. The package according to claim 11, wherein:
the grid has a microwave power reflectance more than 95 percent when measured alone.

25. The package according to claim 11, wherein:
the openings have a spacing between adjacent openings which is less than $\frac{1}{2}$ inch.

26. The package according to claim 11, wherein:
the openings have a spacing between adjacent openings which is less than or equal to about 3/16 inch.

27. The package according to claim 11, wherein:
the openings have a spacing between adjacent openings which is less than or equal to about $\frac{1}{8}$ inch.

28. The package according to claim 11, wherein:
the openings are square openings.

29. The package according to claim 11, wherein:
the openings are circular openings.

30. The package according to claim 11, wherein:
the openings in the grid are arranged in a square lattice.

31. The package according to claim 11, wherein:
the openings in the grid are arranged in an equilateral triangular lattice.

32. The package according t claim 11, wherein:
the susceptor has a reactance optimized to substantially maximize absorbance of the grid and susceptor.

33. The package according to claim 11, wherein:
the susceptor has a reactance between about −50 to about −150 reactive ohms per square.

* * * * *

UNITED STATES PATENT AND TRADEMARK OFFICE

CERTIFICATE OF CORRECTION

PATENT NO. : 4,927,991

DATED : May 22, 1990

INVENTOR(S) : Dan J. Wendt, Jonathon D. Kemske, Peter S. Pesheck

It is certified that error appears in the above—identified patent and that said Letters Patent is hereby corrected as shown below:

Column 5, line 8, before "37B" insert -- FIG. --; line 10, before "in" insert -- grid --.

Column 8, line 42, "mean" should be -- means --.

Column 10, line 63, "susceptor" should be --susceptors--.

Column 21, line 6, "maya" should be -- may --.

Column 22, line 67, "a" should be -- an --.

Column 27, line 66, "e" should be -- l --.

Column 28, line 47, "maya" should be -- may --.

Column 33, line 63, delete "L".

Signed and Sealed this

Fourteenth Day of January, 1992

*Attest:*

*Attesting Officer*

HARRY F. MANBECK, JR.

*Commissioner of Patents and Trademarks*